US009574404B2

(12) United States Patent
Tunget

(10) Patent No.: US 9,574,404 B2
(45) Date of Patent: Feb. 21, 2017

(54) HIGH PRESSURE LARGE BORE WELL CONDUIT SYSTEM

(71) Applicant: Bruce A. Tunget, Aberdeen (GB)

(72) Inventor: Bruce A. Tunget, Aberdeen (GB)

( * ) Notice: Subject to any disclaimer, the term of this patent is extended or adjusted under 35 U.S.C. 154(b) by 108 days.

(21) Appl. No.: 14/382,215

(22) PCT Filed: Mar. 1, 2013

(86) PCT No.: PCT/US2013/000057
§ 371 (c)(1),
(2) Date: Aug. 29, 2014

(87) PCT Pub. No.: WO2013/176705
PCT Pub. Date: Nov. 28, 2013

(65) Prior Publication Data

US 2015/0021018 A1 Jan. 22, 2015

(51) Int. Cl.

| | |
|---|---|
| ***E21B 17/01*** | (2006.01) |
| ***E21B 19/00*** | (2006.01) |
| ***E21B 7/06*** | (2006.01) |
| ***E21B 33/068*** | (2006.01) |
| ***E21B 41/00*** | (2006.01) |
| ***E21B 17/00*** | (2006.01) |

(52) U.S. Cl.
CPC ..... *E21B 7/061* (2013.01); *E21B 17/00* (2013.01); *E21B 33/068* (2013.01); *E21B 41/0007* (2013.01); *E21B 41/0035* (2013.01)

(58) Field of Classification Search
CPC .... E21B 17/085; E21B 41/0035; E21B 17/01; E21B 17/18; E21B 43/105; E21B 17/00; E21B 17/1035; E21B 33/068; E21B 41/0007; E21B 19/00
See application file for complete search history.

(56) References Cited

U.S. PATENT DOCUMENTS

| | | | | |
|---|---|---|---|---|
| 6,854,487 | B2 | 2/2005 | Witemyre et al. | |
| 2006/0191691 | A1* | 8/2006 | Lohbeck ..... | E21B 43/105 166/382 |
| 2009/0205737 | A1 | 8/2009 | Dinon et al. | |

* cited by examiner

*Primary Examiner* — Zakiya W Bates

(57) ABSTRACT

Well conduit system and methods using a first outer conduit wall and at least one second inner conduit wall positioned through a wellhead to define an annulus with radial loading surfaces extending across the annulus and radially between at least two of the conduit walls to form passageways through subterranean strata concentrically, wherein an inner pipe body of greater outer diameter is inserted into an outer pipe body of lesser inner diameter by elastically expanding the circumference of the outer pipe body and elastically compressing the circumference of the inner pipe body, using a hoop force exerted therebetween. Releasing the hoop force after insertion will release the elastic expansion and compression of the pipe bodies to abut the radial loading surfaces within the annulus for sharing elastic hoop stress resistance and thereby forming a greater effective wall thickness, capable of containing higher pressures than the conduit walls could otherwise bear.

36 Claims, 23 Drawing Sheets

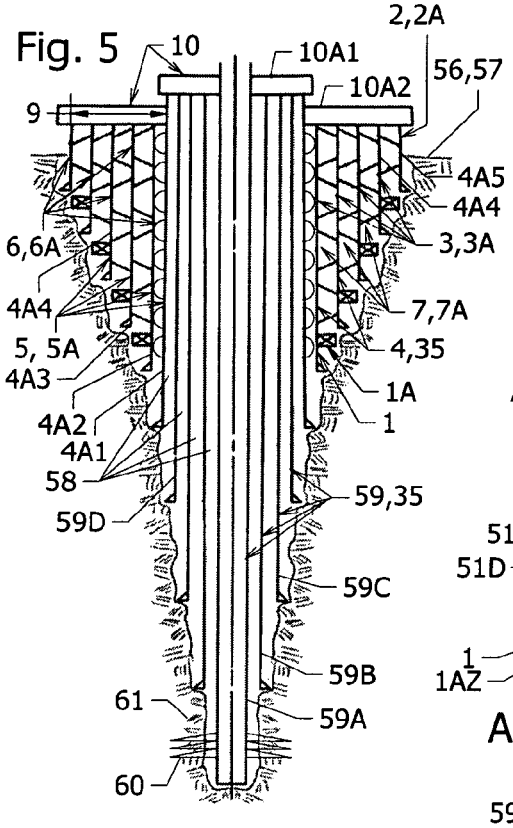
Fig. 5
10
10A1
2,2A
10A2
56,57
9
4A5
4A4
6,6A
3,3A
4A4
7,7A
5, 5A
4,35
4A3
1A
4A2
1
4A1
58
59,35
59D
59C
59B
61
59A
60
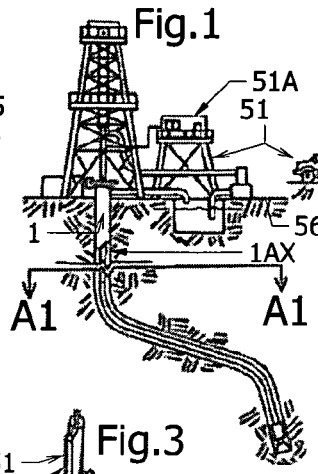
Fig.1
51A
51
1
56
1AX
A1
A1
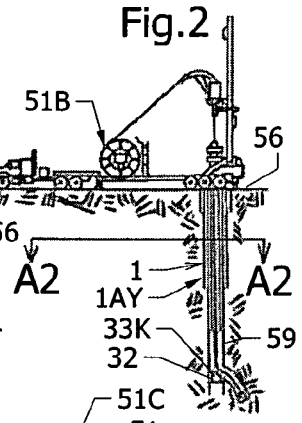
Fig.2
51B
56
1
A2
A2
1AY
33K
59
32
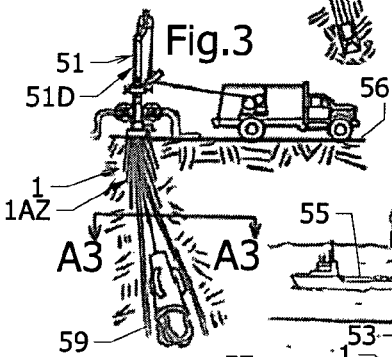
Fig.3
51
51D
56
1
1AZ
A3
A3
59
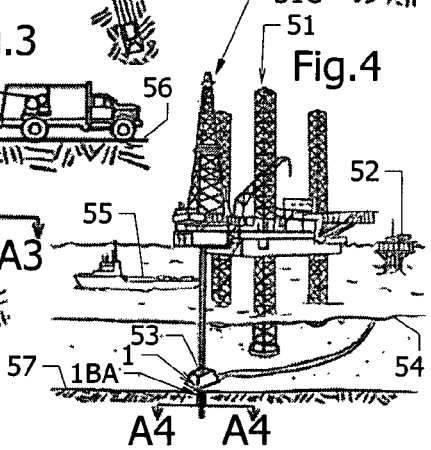
51C
51
Fig.4
52
55
53
1
57
1BA
54
A4
A4
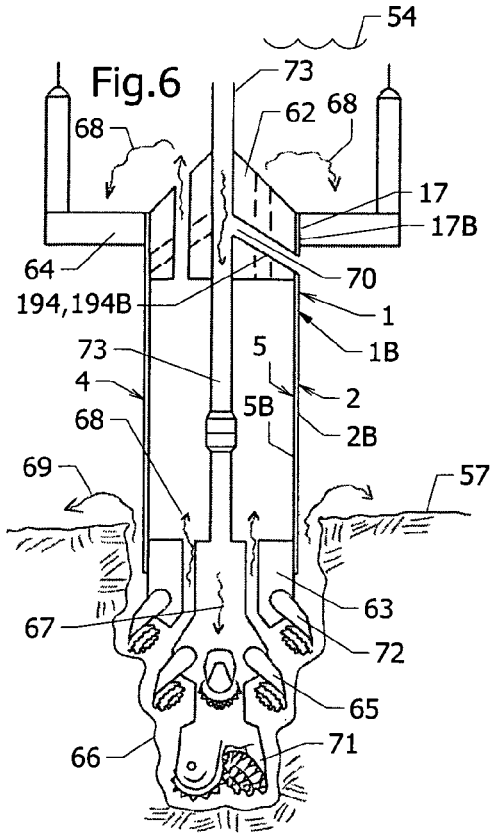
54
Fig.6
73
62
68
68
17
17B
64
70
194,194B
1
1B
73
5
4
2
5B
68
2B
69
57
63
67
72
65
66
71
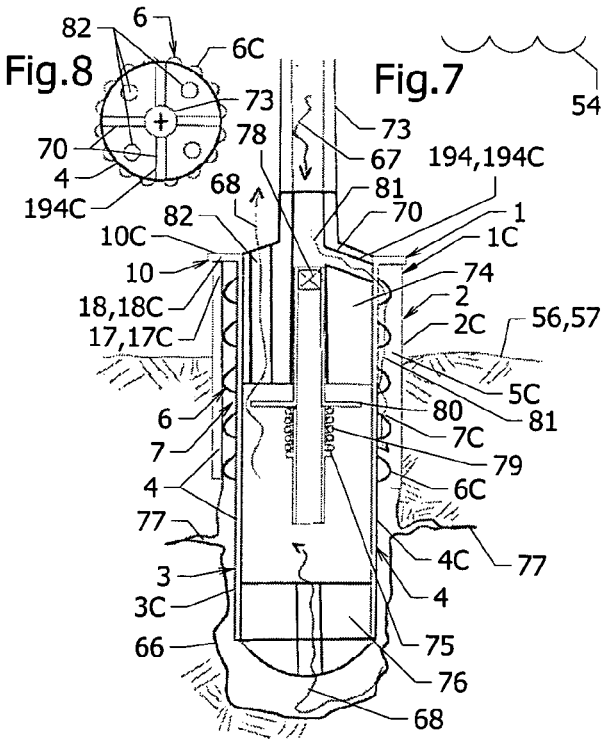
82
6
6C
Fig.8
73
70
4
194C
Fig.7
54
73
78
73
67
194,194C
68
81
82
70
1
10C
1C
10
74
18,18C
2
17,17C
2C
56,57
5C
80
81
6
7C
7
79
4
6C
77
4C
77
3
4
3C
75
66
76
68

B
C
B
1D
3
1
2
2
3
6
D
SECTION B-B

DETAIL C
7
4
2D
5D1
6D
1D
5D
1
3D
7
5D2
6
4
83D
83D 83D
3
7
9
1
1D
8D
2
6
8
4
5D
4

DETAIL D 5, 5E1
4E2
4E1
2,2E
1
84
1E1
6E1
8
6
9
6E3
8E
84
3,3E2
83E1
85
7
3,3E1

84
7
3E1
5,5E1
1
86
1E2
86
8E2
85
3E2
6,6E2
86
83E2
5,5E2
84

8
8
2
83F
1
8
1F
6F
9
87
88
8
3
5
4
7
8
8

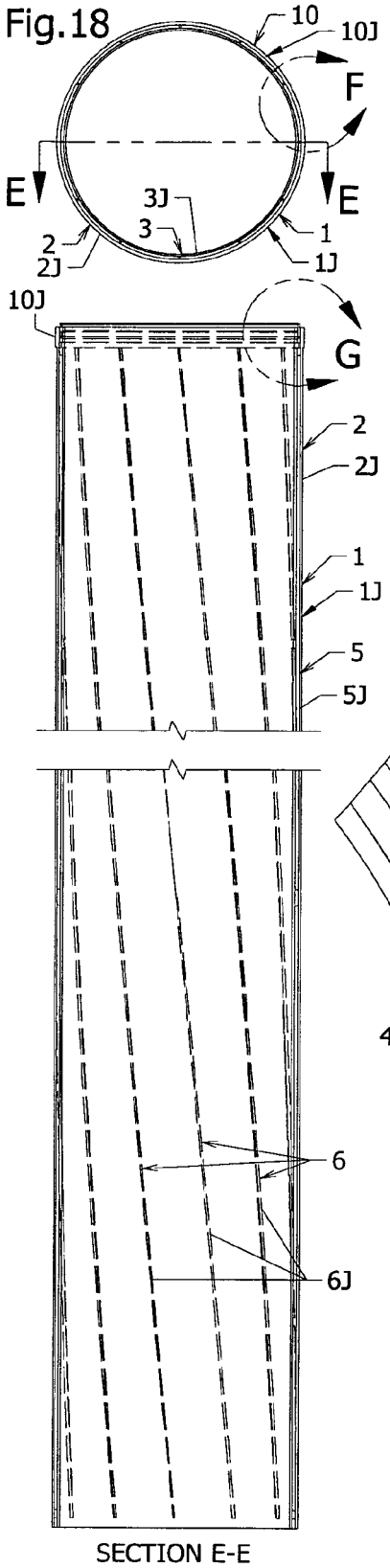
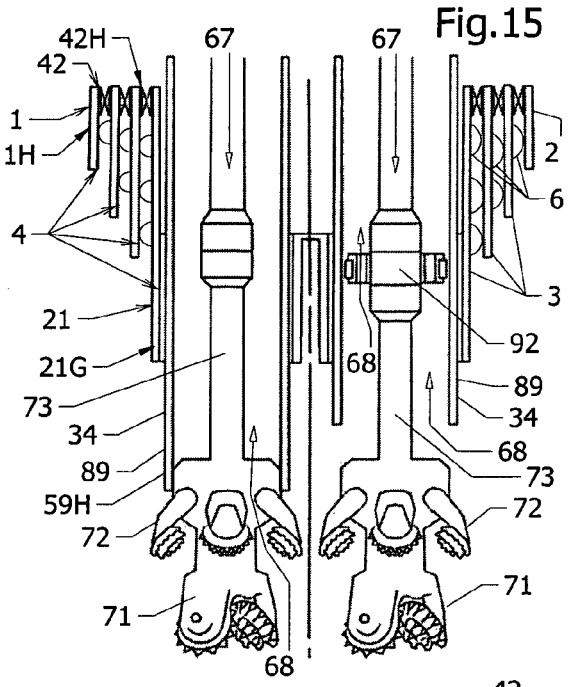
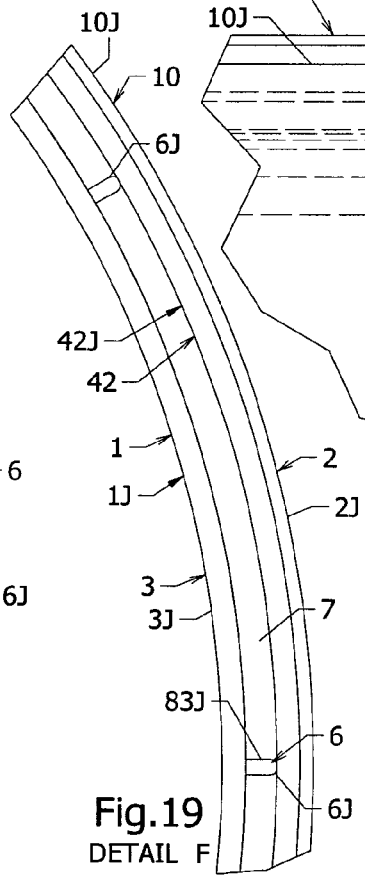
Fig.19
DETAIL F
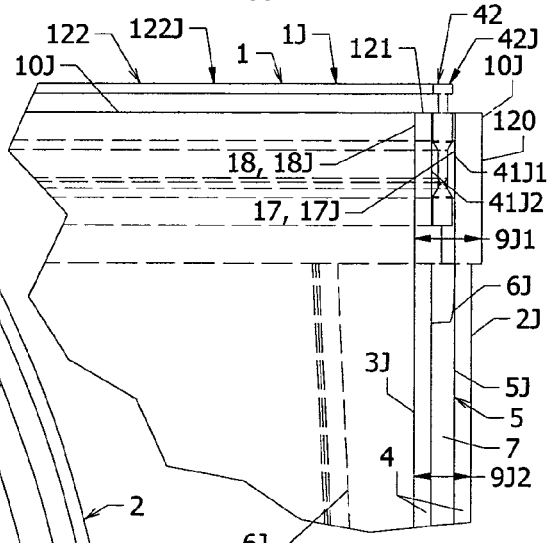
Fig.20
DETAIL G

Fig.21
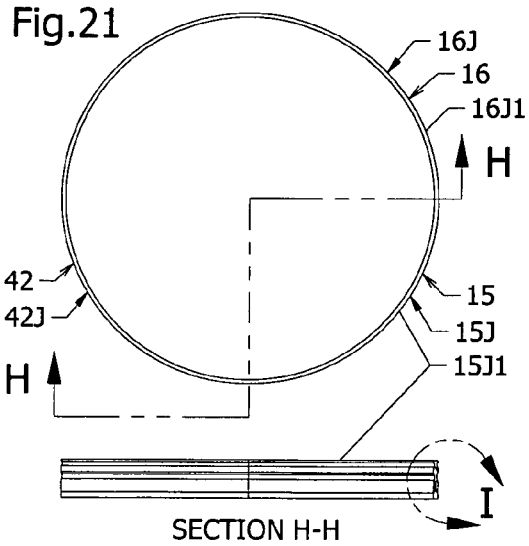
Fig.24
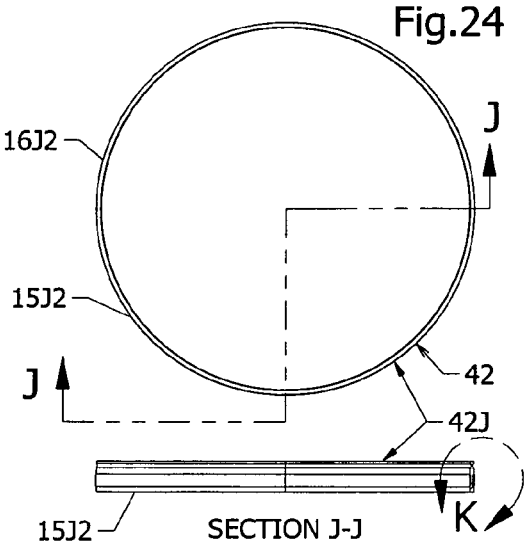
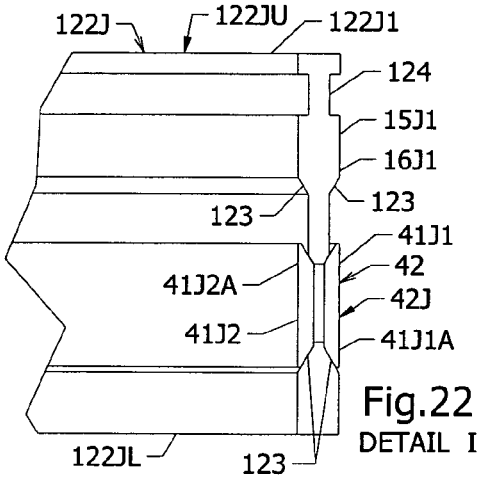
Fig.22
DETAIL I
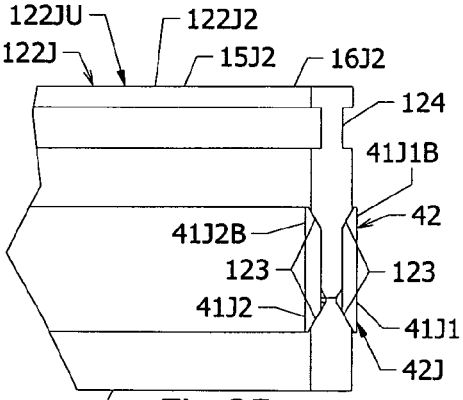
Fig.25
DETAIL K
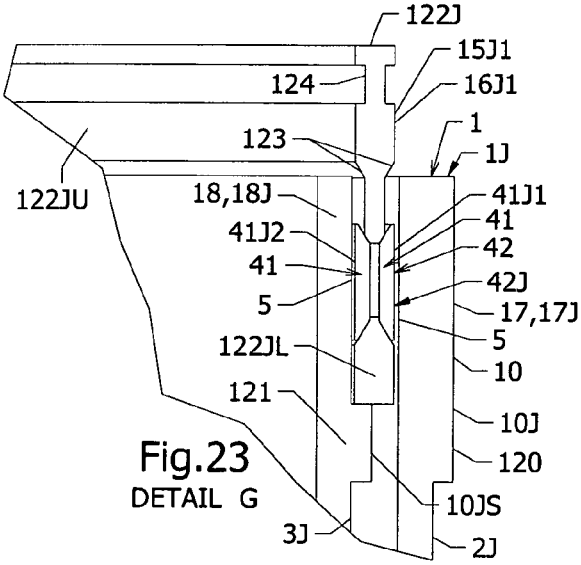
Fig.23
DETAIL G
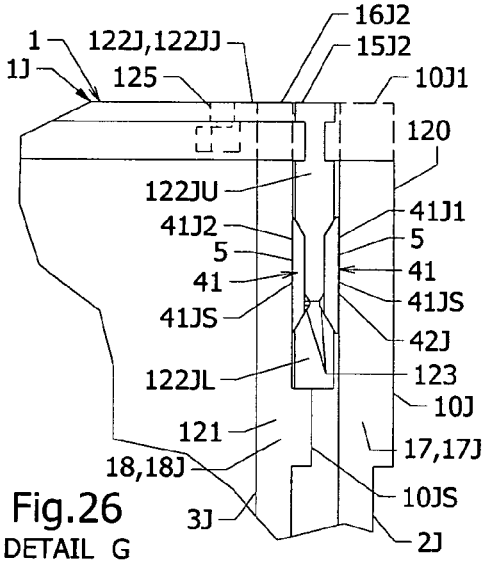
Fig.26
DETAIL G Fig.27
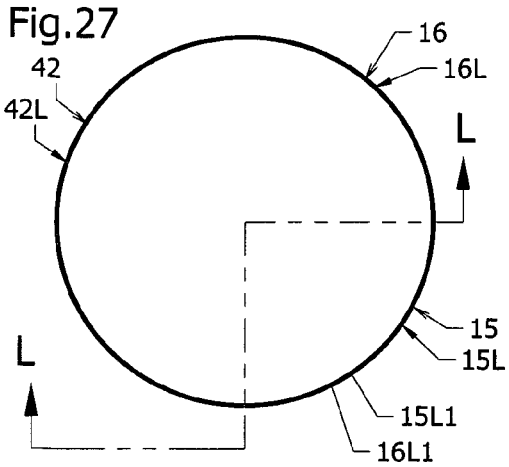
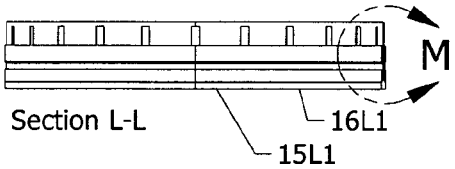
Fig.30
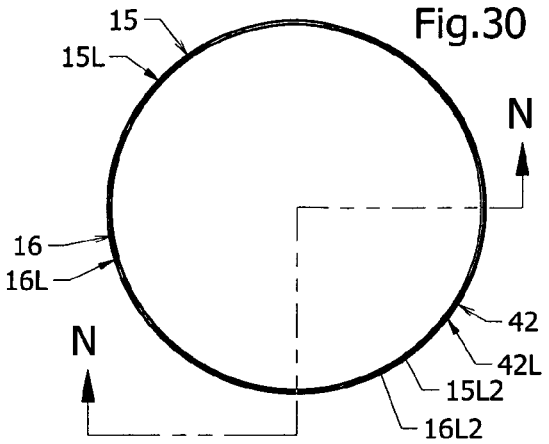
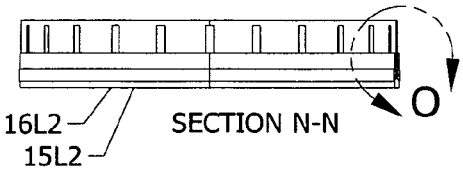
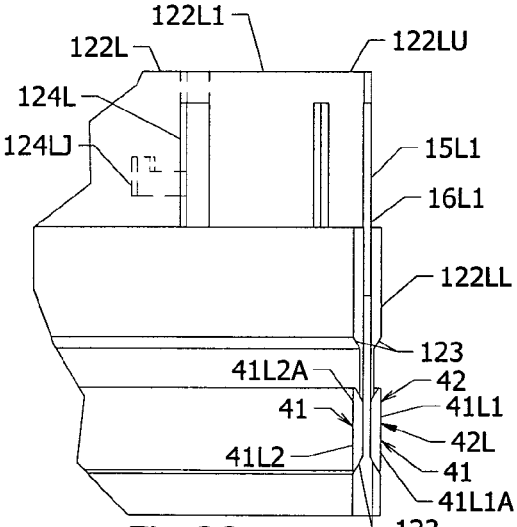
Fig.28
DETAIL M
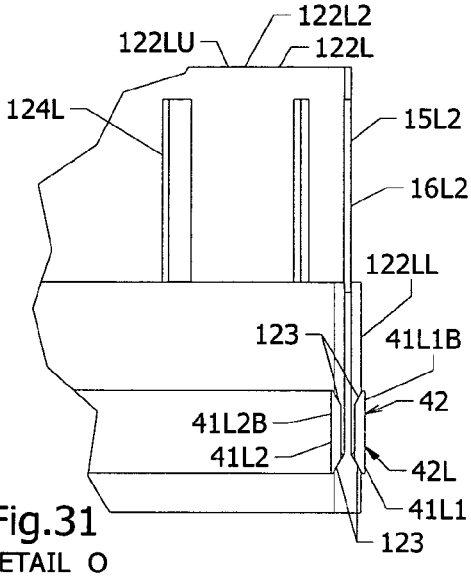
Fig.31
DETAIL O
Fig.29
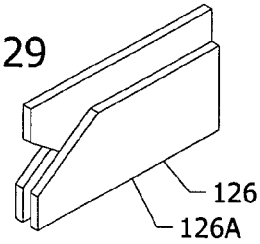
Fig.32
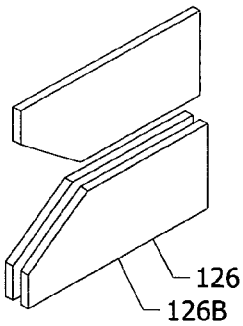

DETAIL G

DETAIL Q

DETAIL R

DETAIL P

Fig.38
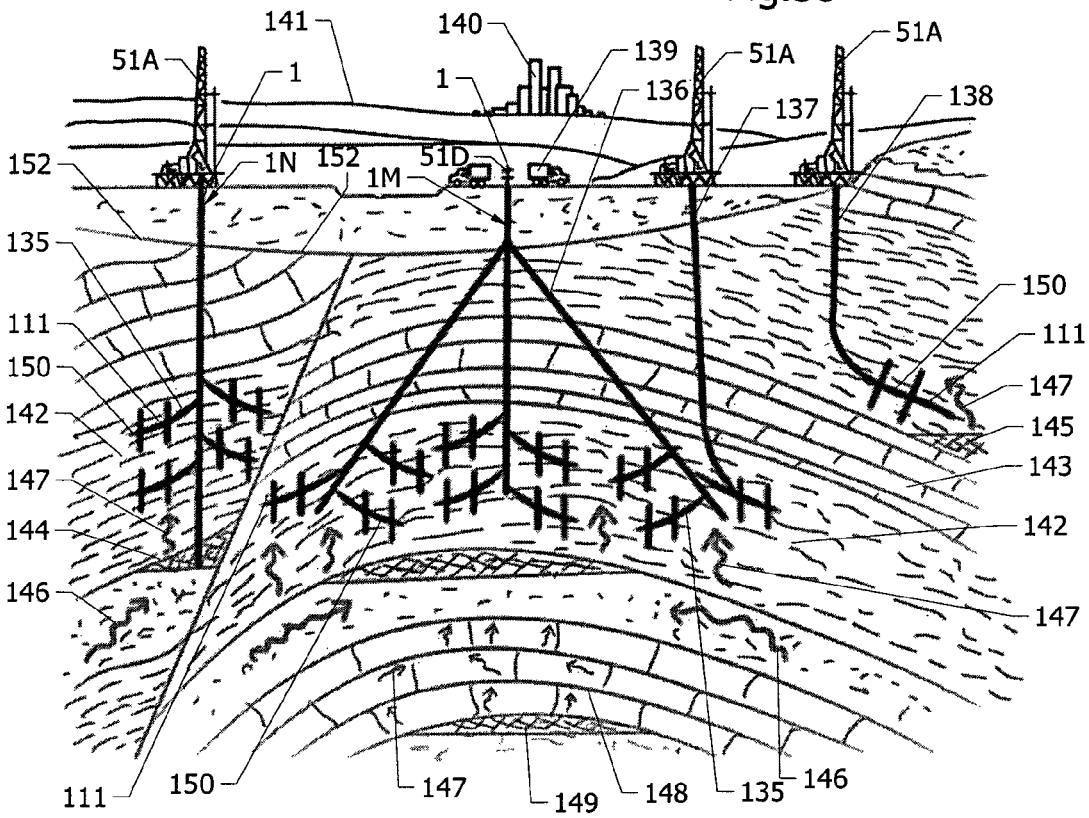
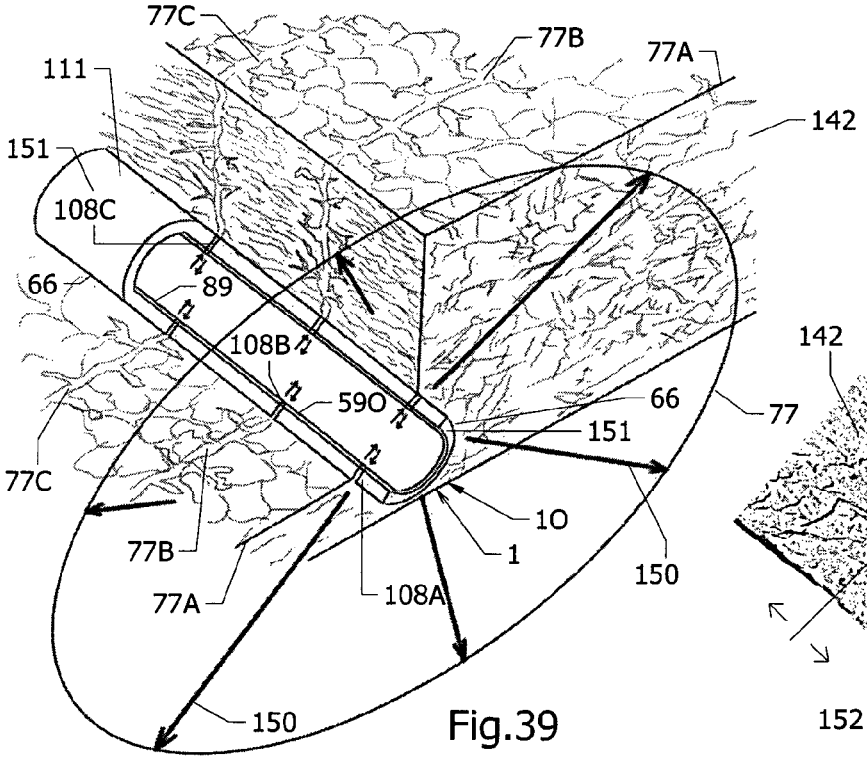
Fig.39
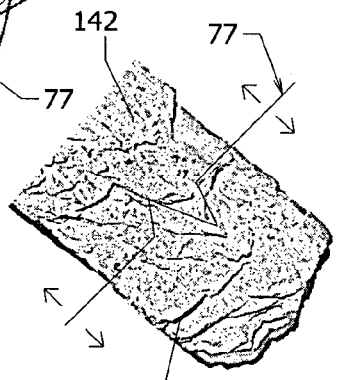
Fig.40

S
S
10
10T
14
14T
1
1T
164
14T
15
16
49
49A
14
10
10T
160C
159B
158
159
18T2
9,9T2
18
159A
160B
T
161
5
156
17
6
160A
2
9,9T1
2T
4
1
1T
3T1
3
3T2

SECTION S-S

DETAIL T
194T2
129
159A
157
156
10T
1T
158
160B
194T1
194
3T1
3T2
4

15
158
6,6T2
15
158
6,6T1
1
1T
3
3T1
15T2
15
157
162
3
3T2
18
162
163
161
194,
194T1
18T1
15
15T3
157
156
17T
15T1
15
161
156
2
2T
34
15
49
49A
14T
14
16
10
10T
194,
194T3
16
158
163
18T2
18
194,
194T2
16
162
163
161
194,
194T1
49A
49
34
1
14
1T
14T
18
18T2
18
18T1
17
17T
2T
66
3T1
3T2

Fig.55
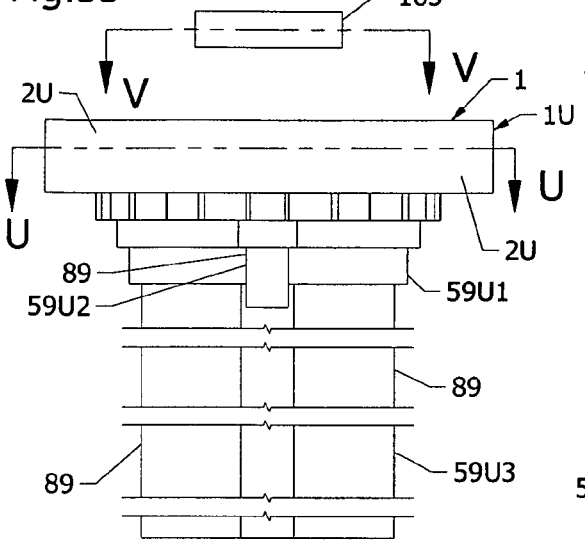
Fig.58
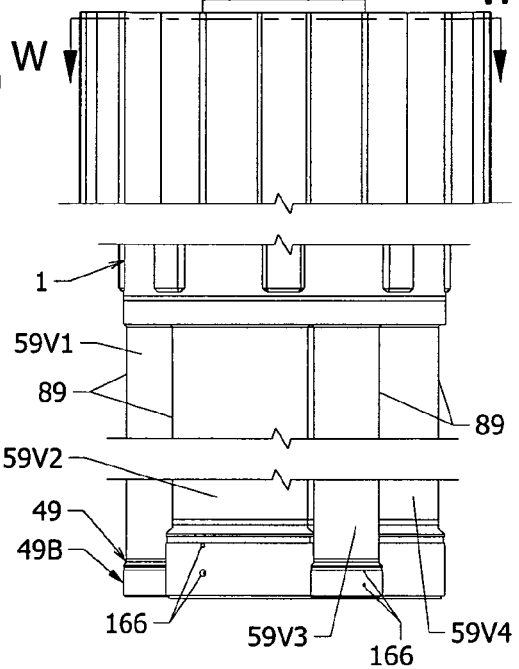
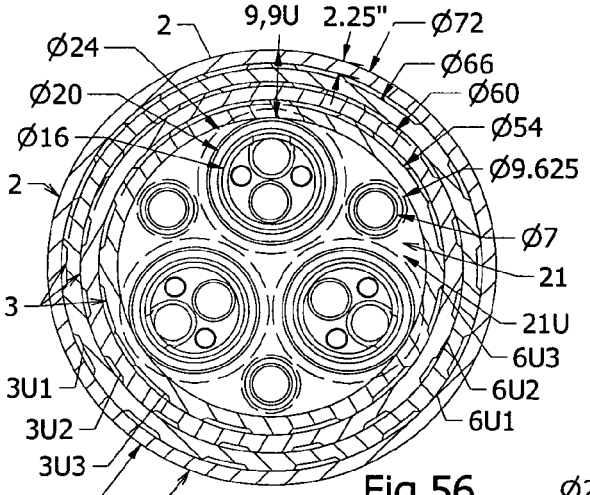
Fig.56
SECTION U-U
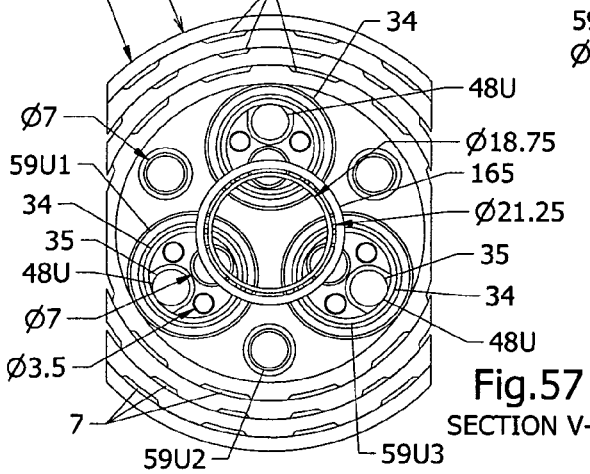
Fig.57
SECTION V-V
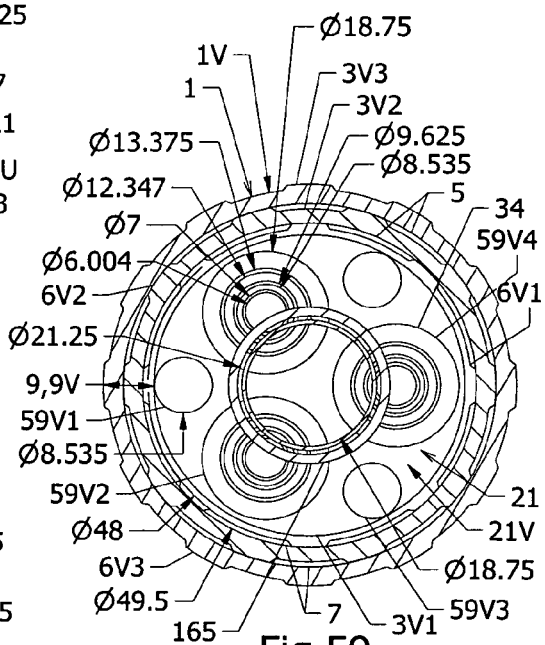
Fig.59
SECTION W-W

DETAIL X

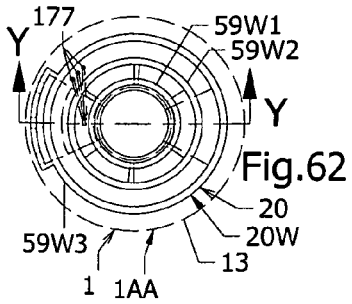
Fig.62
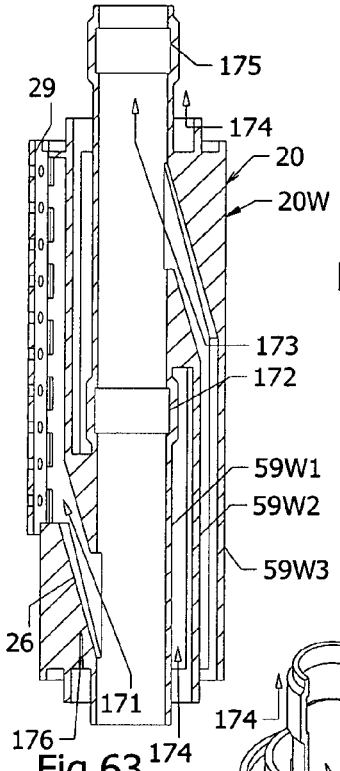
Fig.63
SECTION Y-Y
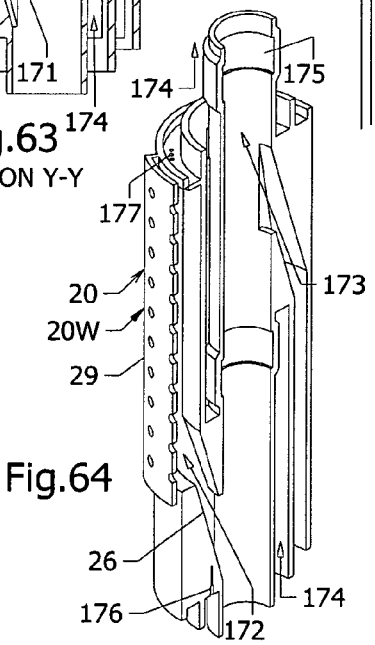
Fig.64
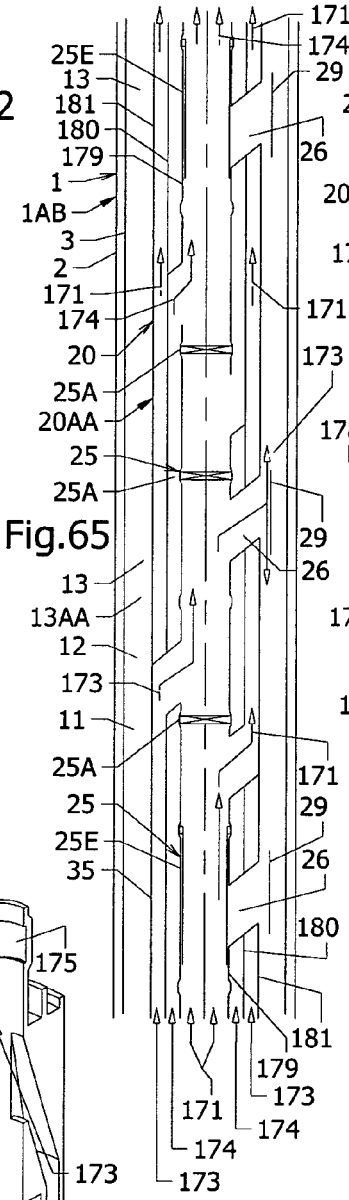
Fig.65
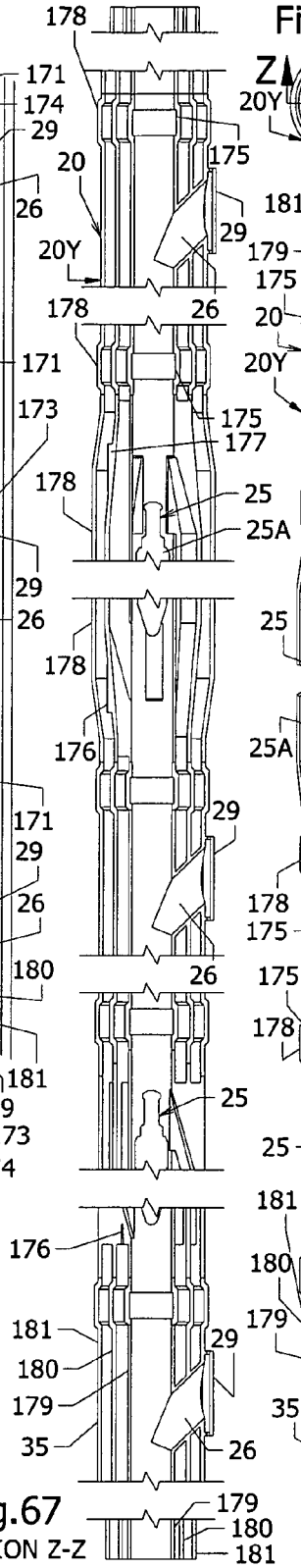
Fig.67
SECTION Z-Z
Fig.66
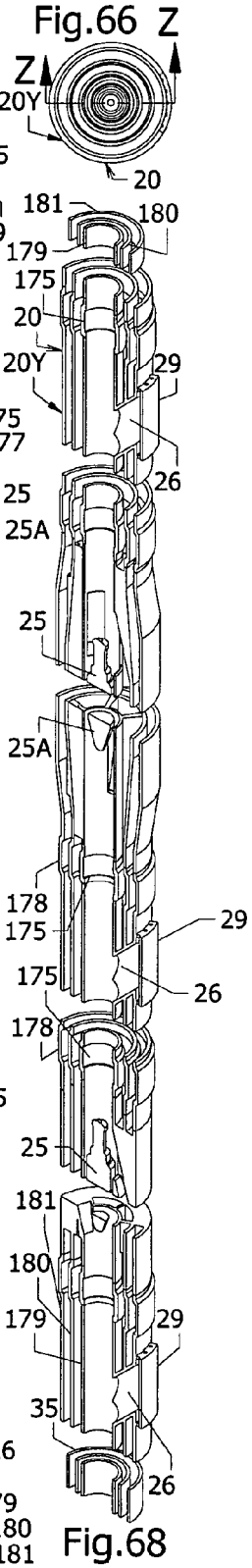
Fig.68

35
201
202
20
21
21Y
34
183
182
184

184
179
180
181
182
AA
AA
20
21
21Y
183
179
180
181
20
21
21Y
202
201
201
203
203
182
184
183

SECTION AA-AA
204
182
183

AB
AB
20Z
20
179
175
200
176C
180
181
24
24Z1
200
20Z2
25
25A
178
176B
176A

SECTION AB-AB 200
175
24
24Z2
20Z1
25
25A
178X
175
176
200
175
24
24Z3

49E
21Z1
59Y7
49G
49
59Y3
59Y1
AF
34
34Y
59Y5
6
AE
30
21
170
21Z3
49F
59Y6
AD
21Z2
AC
59Y2
59Y4
49D
205
207
206
21Z3
170
30,
208
209

SECTION AG-AG

DETAIL AX

DETAIL AH

SECTION AI-AI

DETAIL AJ

DETAIL AK
AI
AJ
AK
AH
21
21Z1
3
34
49D
46
49
46Y
34X
231
34
49
49C
132
45
6
230
232
211
210
213
212
166B
233
166
166A
236
235
226
166C
229
229U
229L
227
228
225
166E
166D
166F
212

AL
AL
1
1Y
6
5
7
4
9,9Y
49G
11
12
13
30
170

238
59Y7
1
1Y
3Y1
3
3Y2
3Y3
59Y1
59Y7
13Y
200B
240
175
20Y
200
26
29
175
240
25
25A,
25C 175
20Y
26
29
240
175
25A,
25C
240
34Y
26
29
49G
59Y1
59Y7
175
30
170
238
239
3

175
20Z
24Z1
59Y1
59Y7
25A
34
34Y
21Y
175
49G
24Z2
25A
21Z3
175
49F
24Z3
25A
34
182

Fig.106
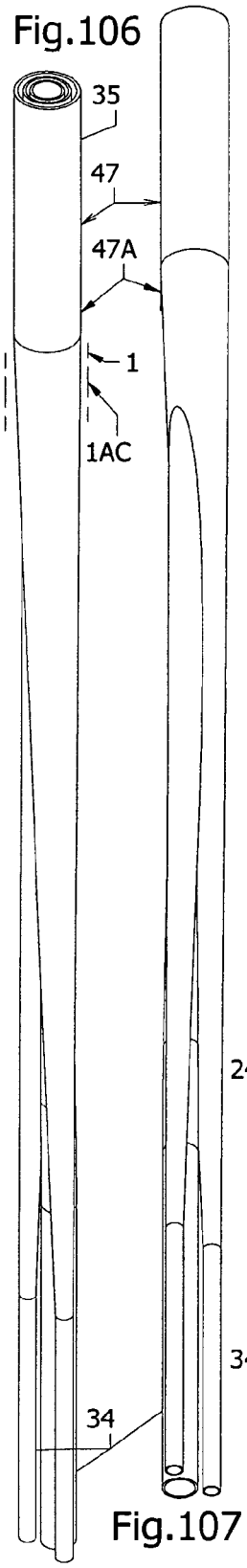
Fig.107
Fig.109
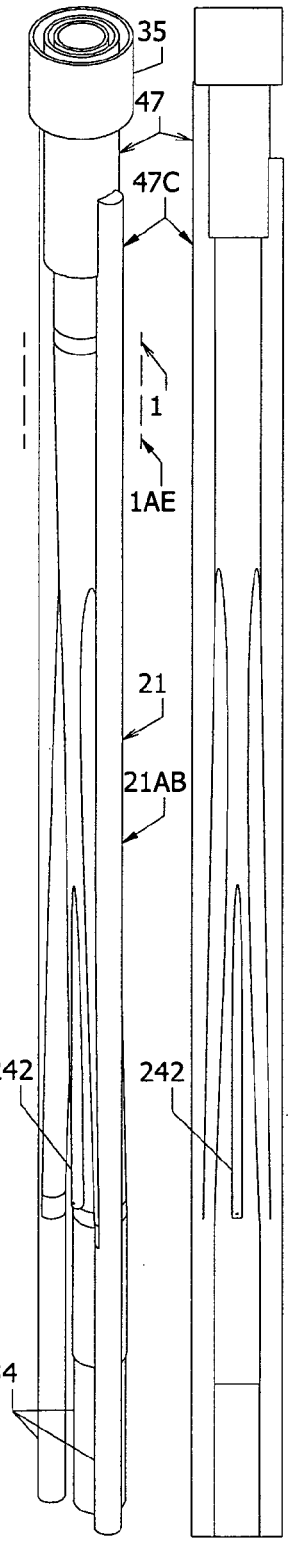
Fig.110
Fig.111
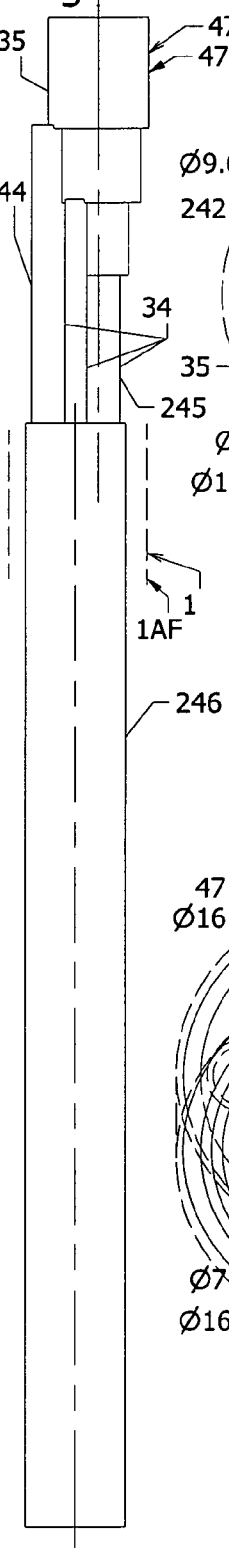
Fig.108
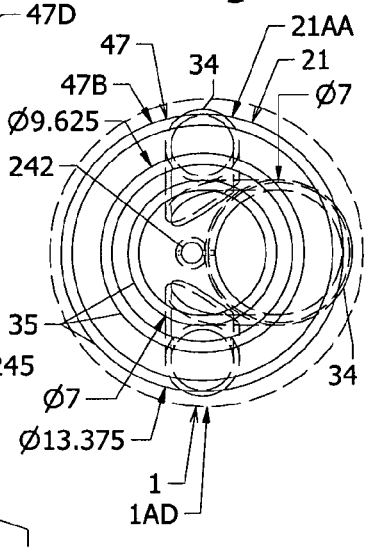
Fig.112
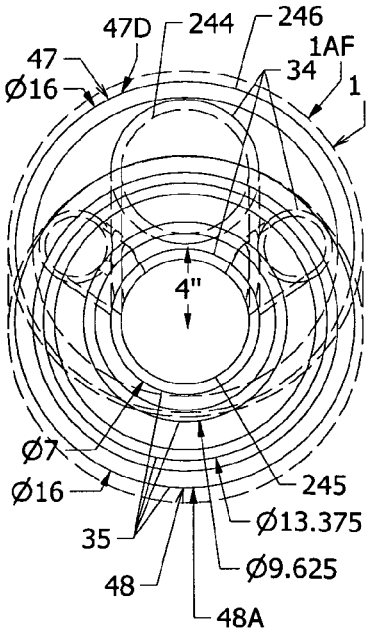

AM
AM 48
48B
49
49H
199
198
198
1
1AG
199
33C
33
247
21J
198
21
198
199
248
49
49I
251

SECTION AM-AM
AN
246
AO
199

DETAIL AN
246
49H
247
198
246
21J
246

49H
246
247
21J
195
196
33K
33K1
255
25
254
253
197
252

195
25
256
25A 25B
25
195
46
32
243
257
258
25C
25
256
259

DETAIL AO
21
198
248
199
251
49I
250
25
25D
32

248
251
200J
250
249

AP
AP
48
48C

AQ
AQ 48D
198
263
AT
AT
48
48E
199

AU AU
48
48F

DETAIL AR
195
33K1A,
33K1B
33K
33K1
198
197
199
49H
49
49I
48
48D
21
1
1AH
48
198
48C
198
1
1AI 25E
25
199
33
33D
33C
AR
46
198
AS
33D
198
199
46
49
49J
49J

SECTION AP-AP

SECTION AQ-AQ
263
48
48E
1
1AJ
198
199
198
33
33E
46

DETAIL AS
49
49J
250
198
250
199
33K
33K2
33K2B
198
196
34
48
48G
262
33
33G
197
261
260
195
263
199

DETAIL AW 48F
33
33F
34
196
33K
197
260
33K2
195
33K2A
1
1AK
198
33

SECTION AU-AU
AV
AV 48G
48
195
196
33K2
AW
260
262
199
1
1AL
261
198
34

SECTION AV-AV

HIGH PRESSURE LARGE BORE WELL CONDUIT SYSTEM

CROSS-REFERENCE TO RELATED APPLICATIONS

The present application is a national patent application that claims priority to Patent Cooperation Treaty (PCT) Application having PCT Application No. PCT/US2013/000057, entitled High Pressure Large Bore Well Conduit System," filed Mar. 1, 2013, which claims priority to United Kingdom Patent Application having Number GB1203649.7, entitled "High Pressure Large Bore Well Conduit System," filed Mar. 1, 2012, which claims priority to Patent Cooperation Treaty Application Number US2011/000377, entitled "Manifold String For Selectively Controlling Flowing Fluid Streams of Varying Velocities In Wells From A Single Main Bore," filed Mar. 1, 2011 and published under WO2011/119198A1 on 29$^{th}$ Sep. 2011; United Kingdom Patent Application having Number GB1104278.5 published under GB2479432A on 12 Oct. 2011, of the same title, filed 15 Mar. 2011, PCT Application Number US2011/000372, entitled "Pressure Controlled Well Construction and Operation Systems and Methods Usable for Hydrocarbon Operations, Storage And Solution Mining," filed Mar. 1, 2011 and published under WO2011/119197A1 on 29 Sep. 2011; and United Kingdom Patent Application having Number GB1104280.1, published under GB2479043A on 28 Sep. 2011, of the same title, filed 15 Mar. 2011, all of which is incorporated herein in its entirety by reference.

FIELD

The present application relates, generally, to well conduit systems and methods usable to form and to maintain one or more passageways through subterranean strata, below a wellhead assembly. Specifically, conduits of the well conduit system include radial loading surfaces for abutting one conduit to another and comprise continuous elastically compressible and expandable pipe body circumferences, wherein the effective diameter of one conduit is greater than the other for forming a containment system that is able to contain higher pressures than conventionally installed conduits of the same size.

BACKGROUND

When exploiting subterranean deposits, such as those associated with waste fluid disposal of contaminated water and carbon dioxide (CO2) sequester, salt production and salt cavern storage, geothermal steam and hydrocarbons, high pressure containment conduits of sufficient diameter are useful to access subterranean depths. A need exists for systems and methods to increase the pressure bearing efficiency of a well, such as through use of larger diameter conduits to improve the integrity of the well and the placement of subterranean apparatuses, e.g. separators, heat exchangers, side-track side pocket whipstocks and other apparatuses usable for extracting and processing injectable and producible fluids from one or more wells, in a more efficient and/or environmentally conscious manner than is currently practiced.

Embodiments of the present well conduit system can communicate fluids through large diameter, higher-pressure, conduit containment to provide significant pressure bearing improvement over conventional well designs, which can include the well designs of the present inventor, as disclosed in United Kingdom Patent GB2465478B entitled "Apparatus And Methods For Operating A Plurality Of Wells Through A Single Bore," incorporated herein in its entirety by reference. The present inventor's apparatus and methods of use, as disclosed in United Kingdom Patent GB2471760B entitled "Apparatus And Methods For Subterranean Downhole Cutting Displacement, And Sealing Operations Using Cable Conveyance," incorporated herein in its entirety by reference, may be used within the well conduit systems and methods of the present invention for maintenance, boring via side-pockets, and/or abandonment. In addition, embodiments of the present invention may incorporate the teachings of the systems and methods disclosed in UK Patent Application GB1021787.5, entitled "Managed Pressure Conduit Systems And Methods For Boring And Placing Conduits Within The Subterranean Strata," published under GB2475626A on 25 May 2011, which is incorporated herein in its entirety by reference, for particular uses.

The present invention can provide significant and distinctive improvements over the teachings of existing systems and methods. For example, conventional systems and methods are described in Yang et al., in Chinese Patent Application CN102226378A, entitled "Reinforced Riser Pipe Combined Structure And Construction Method;" Morgan and Sinclair in U.S. Patent Application No. US 2011/0068574 A1, published 24 Mar. 2011 entitled "Pipe Connector Device;" Gallagher and Lumsden in U.S. Pat. No. 5,954,374 entitled "Pipe Connectors," filed 18 Apr. 1997 and issued 21 Sep. 1999; Bilderbeek and Hendrie in U.S. Pat. No. 7,740,061 B2, entitled "Externally Activated Seal System For Wellhead," filed 24 Sep. 2007 and issued 22 Jun. 2010; Cook et al. in U.S. Pat. No. 7,147,053 B2, filed 13 Aug. 2004 and issued 12 Dec. 2006, entitled "Wellhead:" Berg et al. in U.S. Pat. No. 6,698,610 B2, entitled "Triple Walled Underground Storage Tank," filed 28 Feb. 2002 and issued 2 Mar. 2004;" Berg, Sr. in U.S. Pat. No. 6,820,762 B2, filed 7 Jan. 2002 and issued 23 Nov. 2004, entitled "High Strength Rig For Storage Tanks;" Wright, et al. in U.S. Pat. No. 7,823,635 B2, entitled "Downhole Oil and Water Separator and Method," filed 23 Aug. 2004 and issued 2 Nov. 2010; Thompson in U.S. Pat. No. 7,857,060 B2, entitled "System, Method and Apparatus For Concentric Tubing Deployed, Artificial Lift Allowing Gas Venting From Below Packers," filed 10 Oct. 2008 and issued 28 Dec. 2010; Choi in U.S. Pat. No. 5,474,601, entitled "Integrated Floating Platform Vertical Annular Separator For Production of Hydrocarbons," filed 2 Aug. 1994 and issued 12 Dec. 1995;" Ford in U.S. Pat. No. 7,703,509 B2, entitled "Gas Anchor And Solids Separator Assembly For Use With Sucker Rod Pump," filed 2 Mar. 2007 and issued 27 Apr. 2010; Williams in U.S. Pat. No. 7,604,464 B2, entitled "Mechanically Actuated Gas Separator For Downhole Pump," filed 22 Jun. 2005 and issued 20 Oct. 2009; Lai, et al. in U.S. Pat. No. 7,645,330 B2, entitled "Gas-Liquid Separator Apparatus," filed 27 Oct. 2006 and issued 12 Jan. 2010; Ehlinger, et al. in U.S. Pat. No. 7,849,918 B2, entitled "Centering Structure For Tubular Member And Methology For Making Same," filed 21 Jul. 2008 and issued 14 Dec. 2010; Sizer in U.S. Pat. No. 3,448,803, entitled "Means For Operating A Well With A Plurality Of Flow Conductors Therein," filed 2 Feb. 1967 and issued 10 Jun. 1969; Hosie et al. in U.S. Pat. No. 7,395,877 B2, entitled "Apparatus And Method To Reduce Fluid Pressure In A Well Bore," filed 26 Sep. 2006 and issued 8 Jul. 2008; Brown in U.S. Pat. No. 2,975,835, filed 7 Nov. 1957 and issued 21 Mar. 1961, entitled "Dual String Cross-Over Tool"; Wilson et al. in U.S. Pat. No. 7,445,429 B2 entitled "Crossover Two-Phase Flow Pump," filed 14

Apr. 2005 and issued 4 Nov. 2008; Fredd in U.S. Pat. No. 4,453,599, entitled "Method And Apparatus For Controlling A Well," filed 10 May 1982 and issued 17 Jun. 1984; Browne et al. in U.S. Pat. No. 6,298,919 B1, entitled "Downhole Hydraulic Path Selection," filed 2 Mar. 1999 and issued 9 Oct. 2001; Edwards et al. in U.S. Pat. No. 6,170,578 B1, entitled "Monobore Riser Bore Selector," having an effective filing date of 13 Oct. 1998 and issuance on 9 Jan. 2001; Simpson, et al. in UK Patent Application publication number GB 2,429,722 A, published 7 Mar. 2007, entitled "Crossover Tool For Injection And Production Fluids;" Zackman, et al., in UK Patent GB 2,387,401 A, entitled "Crossover Tool Allowing Downhole Through Access;" Argumugam, et al., in U.S. Pat. No. 7,967,075 B2, entitled "High Angle Waterflood Kickover Tool," filed 22 Aug. 2008 and issued 28 Jun. 2001; Jackson, et al. in U.S. Patent Application Publication No. US 2007/0267200 A1, published 22 Nov. 2007, entitled "Kickover Tool And Selection Mandrel System"; Dinning in U.S. Pat. No. 3,799,259, entitled "Side Pocket Kickover Tool," filed 12 Apr. 1972 and issued 26 Mar. 1974; Schraub in U.S. Patent Application Publication No. US 2004/0060694 A1, published 1 Apr. 2004, entitled "Kick-Over Tool For Side Pocket Mandrel"; Pratt in U.S. Pat. No. 7,207,390 B1, entitled "Method And System For Lining Multilateral Wells," filed 5 Feb. 2004 and issued 24 Apr. 2007; and Roth, et al. in U.S. Pat. No. 6,810,955 B2, entitled "Gas Lift Mandrel," filed 22 Aug. 2002 and issued 2 Nov. 2004, each of which is included in its entirety by reference.

By way of example, Yang et al discloses ribbed reinforcement of an internal conduit that is loosely placed and cemented within an outer conduit (e.g., loosely-placed T-shaped ribs that are frictionally unsuitable for adjoining long pipe bodies since the weakest point, which is the rib of the T-shape, is subject to plastic deformation and failure if subjected to forces used in the present systems and methods). For example, embodiments usable within the scope of the present disclosure utilize the abutment of radial loading surfaces and conduits that may be elastically expanded and compressed during installation using hoop forces, wherein the release of the hoop forces causes the release of the elastic memory of the conduits' pipe bodies, which adjoins one pipe body to the other.

Hoop stress conduit joint connectors are disclosed in Morgan and Sinclair, and Gallagher and Lumsden, which due to their high cost of manufacture, as compared to screwed and coupled connections, are not widely used in most conventional well designs. For example, Morgan et al describes large diameter high-pressure connectors, with exceedingly tight machining tolerances. Embodiments usable within the scope of the present disclosure can, conversely, enable the application and use of lower-cost, hoop stress strengthening between pipe body walls.

Similar to Morgan, et al., Bilderbeek and Hendrie also describe the use of hoop stress to secure conduits within a wellhead, through a relatively high cost procedure with relatively tight tolerances of manufacture, as compared to conventional wellheads requiring less pressure integrity. A need exists for a lower-cost well conduit system that includes and uses low-tolerance, hoop stress sharing conduits, at and below an integrated wellhead, and can further incorporate use of large diameter conduits to replace the large diameter flanges, which are required by Bilderbeek and Hendrie, for securing conduit hangers.

Bilderbeek and Hendrie also teach the use of a compression olive to hang conduits within a wellhead. Embodiments usable within the scope of the present disclosure can improve upon this practice by providing single olive (41) arrangements, which can be suitable for installation of conduits having hoop stress sharing loading surfaces and including double (42) olive (41) arrangements for securing conduits and sealing apparatus between large bore high pressure conduits, enabling at least partial replacement of the thick metal, large diameter, restraining hoops required by the prior art and the conventional applications of compression olives.

Cook, et al. describes the expansion of conventional sized tubular conduits within a conventional sized wellhead, where "each inner casing is supported by intimate direct contact pressure between an outer surface of the inner casing and an inner surface of the outer casing."

The Cook, et al., wellhead includes a conventionally sized well design, e.g., "generally to well bore casings, and in particular to well bore casings that are formed using expandable tubing." As is common in conventional practice, the Cook, et al., teachings are restricted to the maximum conventional rotary table diameter of 49.5 inches (124.25 cm), despite its growing obsolescence with the advent of top drives. Furthermore, Cook, et al., teaches a "telescoping effect" for solid conduits that cannot accommodate the use of hoop stress sharing, as described herein.

Cook, et al. also teaches the use of higher yield strength materials to increase pressure integrity, which is a conventional alternative to embodiments of the present disclosure, which include hoop stress sharing.

A need exists for systems and methods that can rely upon the effective wall thickness of rigid conduits, rather than expandable conduits. For example, a pipe body having an outer diameter of 122 centimeter (cm) (48 inches), having a material with a yield of 275.8 newtons per millimeter squared (N/mm2) (40,000 psi), a wall thickness of 5.7 cm (2.25 inches), can be combined with a conduit formed from the same grade of material and having an outer diameter of 137 cm (54 inches) and a wall thickness of 5.7 cm (2.25 inches). A high compression strength cement can be placed within the annulus between the two pipe bodies and radial extending load surfaces, to enable the sharing of the hoop stress resistance between the pipe bodies. This arrangement may, in combination, form an effective wall thickness of 0.133 cm (5.25 inches), which can comprise an outside diameter of 137 cm (54 inches), and which is capable of supporting 469.2 bar (6800 psi) of internal yield pressure and 484.1 bar (7000 psi) of collapse pressure, according to a standard API bulletin 5C3 calculation. If a 930.8 N/mm2 (135,000 psi) yield material is used, the internal yield pressure, or burst pressure, can increase to 1583.6 bar (22,960 psi), and the collapse pressure can increase to 1633.9 bar (23,690 psi) with the API 5C3 calculation.

Accordingly, a need exists for systems and methods that can provide a higher conduit burst pressure and collapse pressure, and can also provide more usable space within the conduit for various applications, including, e.g., a plurality of wells from a single wellhead and well bore fluid processing, with separation and heat exchanging apparatuses. Accordingly, as described in the present disclosure, applying loading surfaces along the axial length of two adjoined conduits and using their abutment to share hoop stresses represents a significant improvement over conventional cemented centralizers, such as those described in Ehlinger, et al., because, while cement has compressive strength, it does not possess sufficient elasticity. Further, it is not the practice in conventional well design to rely on the intermittent placement of centralizers within cement for increased pressure bearing capacity, due to the natural uncertainties of engagement between casings.

Berg et al. and Berg Sr. relate to shallow tanks for service stations that store already-processed hydrocarbons, and do not relate to use with subterranean tanks engaged to a wellhead or usable for processing subterranean deposits. A need exists for systems and methods that enable installation of tanks during drilling, and securement of tanks to a wellhead and/or capable of interaction with processing apparatuses, e.g., separators and heat exchangers. Additionally, the pressure experienced within shallow subterranean storage tanks for already-processed hydrocarbons, which are not connected to high pressure and large volumetric hydrocarbon reservoirs, are relatively insignificant when compared to, as described above, the required burst and collapse pressures associated with well construction and operation.

Wright, et al., Thompson, Choi, Ford, Williams and Lai, et al., each relate to various forms of downhole separation, processing and stimulation. However, a need exists for systems and methods that provide usable downhole volumetric spaces that are greater in volume and allow for higher pressures. In addition to providing such functionality, embodiments useable within the scope of the present disclosure can enable integration of apparatuses and methods of the present inventor, e.g., chamber junctions, bore selectors and manifold crossovers, also allow selective access and configuration of downhole processing and separation equipment for the purposes of, e.g., maintenance, repair and fluid production and/or injection communication with subterranean deposits, water floods or other subsurface fluid horizons through axially concentric or autonomous conduits and wellhead connections.

Sizer and Brown disclose systems which are conventionally usable for a limited range of substantially water or substantially hydrocarbon wells, due to the lack of a large diameter, high pressure containment system for completion equipment that can be usable for producing hydrocarbons and/or water from the strata through the well bore. A need exists for systems that can incorporate use of large diameter, high pressure containment fluid processing spaces, which can also provide significant improvement over such existing practices as those described in Hosie, since such spaces may be used for heavyweight drilling fluid boring operations to prevent the flow of hydrocarbons or water from the strata into the wellbore.

The teachings of Sizer, Brown, Hosie, Wilson et al., Browne et al., Fredd, Edwards et al., Simpson et al., and Zackman et al. are all limited by the lack of disclosure and the inability to use conventionally arranged large diameter conduits to bear high pressures and, hence, are restricted to wells of conventional size. In contrast, embodiments usable within the scope of the present disclosure can provide more space within a well conduit system, wherein apparatus and methods of the present inventor, such as those described in WO2011/119198A1, GB2479432, WO2011/119197A1 and GB2479043A, can be combinable with the present embodiments to provide concentric conduit configurations and, thus, provide significant improvement over smaller and less efficient autonomous, parallel arrangements, used within conventionally sized wells. A need also exists for systems that can house concentric and/or autonomous conduits that can be used to improve flowing capacity within the passageway through subterranean strata, using simultaneously flowing, fluid, mixture streams of various velocities.

Argumugam, et al., Jackson, et al., Dinning, Schraub, Roth, et al., and Pratt generally relate to kick-over-tools for side-pocket mandrels that are used in relatively small hole sizes for placement of various flow apparatuses, but are not designed for side-tracking of wells with a drill string. A need exists for a system having diameters usable to provide the necessary enlargement to facilitate the practical application of a whipstock, side-pocket mandrel for multi-lateral boring of wells, to provide the ability to access a lateral with a kick-over tool, while providing pressure integrity and resistance to collapse equivalent to the primary bore of a conventional well design.

A need also exists for systems and methods usable for placing conduits and/or manifold strings during drilling, and that can be applied to completion operations through a large diameter, high pressure conduit system to more cost effectively provide a plurality of wells through a single main bore. Embodiments of the present invention can be used with the teachings of the present inventor described in GB2471760B and GB2475626A for rotatably placing and cementing larger bore conduit and manifold strings usable with a fluid mixture, or heavyweight drilling fluid slurry, wherein the installed conduits, crossovers and manifold strings may be temporarily hung from a wellhead to provide a flow passageway, using an olive arrangement, during well formation, or they can be adapted for use after well formation, with substantially hydrocarbon or substantially water fluids A further need exists for systems and methods that can be usable to meet the First Edition Oct. 2009, API Guidance Document HF1 entitled "Hydraulic Fracturing Operations—Well Construction and Integrity Guidelines," also published on the same website at the time of this filing.

As such, a need exists for systems and methods that are usable within injectable and producible strata to exploit conventional and unconventional subterranean deposits, e.g., a strata layer for depositing waste water or preforming water floods, harvesting salt deposits for consumption and/or caverns, using geothermal deposits for steam, and producing hydrocarbon deposits for medicines, plastics and energy. A further need exists for systems and methods usable with a large diameter, higher pressure, subterranean conduit system for containing and fluidly communicating between and within conduits, at greater pressures than are presently and conventionally possible, such as through use of continuous elastically compressible and expandable pipe body circumferences, having radial loading surfaces abutting one conduit to another, wherein the effective diameter of one conduit is greater than that of the other, prior to the abutment of adjoining radial loading surfaces and conduit walls so as to share hoop stress resistances between the conduits with said abutment, to form a greater effective wall thickness usable for bearing higher pressures.

Embodiments usable within the scope of the present disclosure can be combined and/or used with apparatuses of the present inventor, as described in UK Patent 2471385, entitled "Apparatus And Methods For Forming And Using Subterranean Salt Cavern," which is incorporated in its entirety by reference and teaches improvements in fluidly accessing a salt deposit, wherein relatively large bores are conventionally practiced, albeit without the significant pressure bearing improvements of the present embodiments.

A need exists for a step change in the productivity of well designs for accessing solution mining, geothermal and, particularly, hydrocarbon deposits within the industry of hydrocarbons, and energy and greenhouse gases, as described by Daniel Yergin in *The Prize: The Epic Quest for Oil, Money, and Power*, as published in New York by Simon & Schuster in 1991 and *The Quest: Energy, Security, and the Remaking of the Modern World*, as published by Penguin Press in 2011, for establishing the focus of the general state-of-the-oil-and-gas-industry on large low cost production, standardization, and the importance of innovation.

The importance of innovations in energy and greenhouse gas reductions may also be found on various websites, e.g. http://www.eni.com/en_IT/innovation-technology/technological-answers/maximize-recovery/maximize-recovery-.shtml, provided by ENI, a major oil and gas producer, describing that the present world average recovery factor from oil fields is 30-35% (versus 20% in 1980), wherein this parameter may range from a 10% average of extra heavy crude oils to a 50% average of the most advanced fields in the North Sea. ENI further states that increasing the "recovery factor" by only 1%, even without the discovery of new fields, could increase world reserves by 35-55 billion barrels or about one or two years of world oil production. Hence, the recovery of reserves beyond those conventionally available may be considered an unconventional hydrocarbon source, despite being produced from the same field as conventional hydrocarbons.

Additionally, ENI believes that improvements in well recovery factors have a positive environmental effect, e.g., the reduction of greenhouse gases, because increases in the recovery rate allow for added hydrocarbon production without having to employ additional land, exploit additional resources (water/energy), or produce polluting by-products (acid gases).

ENI further states that "[I]t becomes fundamental to exploit the most advanced drilling and development techniques, as well as recovery processes, whether exploiting those of Improved Oil Recovery (injecting water or gas to maintain the original pressure level inside the reservoir), or Enhanced Oil Recovery (injecting steam, polymer solutions, natural gas or carbon dioxide), and also to adopt 'intelligent systems' (smart fields) for the real-time optimization of production activities."

Accordingly, a need exists for smarter well design and intelligent well systems to increase recovery and to protect the environment through re-use of infrastructure and/or inclusion of computer controlled production systems (108 of FIG. 17) to manage reservoir pressure and maximize production. A need also exists for maintaining reservoir pressure and for better managing of unwanted subterranean fluid production from, e.g., a water flood.

As autonomous flow, autonomous annuli and well integrity are key design focuses in conventional applications during production and injection of all subterranean wells, particularly in regulator regimes that require such autonomous characteristics, a need exists for: i) isolation of the innermost conduit, or primary barrier, protecting the surface and subsurface environment, and ii) isolation of the produced or injected fluids, within the well, with the intermediate annular space between barriers fluidly monitored. A further need exists for the use of proven production and injection isolation methods and apparatuses within more intelligent well designs.

Well construction may vary according to geologic, environmental and operational settings, but the basic practices in constructing a conventional well are similar, wherein the vast majority involve the placement of concentric conduits within a single well bore, e.g., having a conductor or intermediate casing with a concentric outside diameter of 76.2 cm (30 inches) and/or a diameter of 50.8 cm (20 inches) and/or a diameter of 34 cm (13⅜") surrounding a production casing having a diameter of 24.45 cm (9⅝ inches). Potentially a production liner (e.g., having a diameter ranging from 11.4 cm (4.5 inches) to 17.8 cm (7 inches) can be used, containing injection and/or production tubing sized between 6 cm (2⅜ inches) to 14 cm (5.5 inches). In, e.g., conventional hydrocarbon extraction with a permeable sandstone or carbonate reservoir having significant quantities of recoverable fluids, this conventional design is both practical and cost effective. However, use of conventional designs on unconventional production and/or injection wells may not provide the most effective design from an environmental, cost and/or recoverable reserves perspective when, e.g., geologic conditions of strata stability, pressures, temperatures, strata fluid isolation and the depth of wells stretch conventional designs beyond their original objectives for developing, as characterized by Yergin, easily extracted large deposits.

Accordingly, the state-of-the-energy-industry, as described by Yergin, has been and presently continues to be pre-occupied with finding, developing and recovering 30-35% of very large hydrocarbon deposits at the lowest costs, which generally allows the use of relatively simple and common proven technologies with single concentric well bores. However, the attitude of Eni and others may be changing in favour of using new technologies to increase recovery rates, wherein such increases may also significantly benefit nations with historic hydrocarbon deposits.

If the recovery rate range provided by ENI, between 10% for unconventional heavy oils to 50% for advanced recovery of conventional oil and gas, with an average of 30-35%, is indicative of a normal distribution and the present state-of-the art, then approximately 70% of worldwide reserves will not be recovered and the impact of enhanced recovery is indeed significant even for small changes, as ENI highlights.

As the number and physical size of well bores, accessing permeable pore spaces, are the primary links to enhancing recovery, improving either the number or size of bores will significantly affect production, wherein more well bores within a producible deposit and, e.g., permeability improvements from proppant fracture technology or water injection to supplement pressure depletion, may comprise a step change in recovery of subterranean fluid deposits.

A need exists for systems and methods usable to increase the size of wells to incorporate more than one well within an isolation conduit to reduce the number of penetrations through ground water and cap rock formations, thus protecting the above ground environment from the fluids and pressures of the below ground environment.

An need also exists for an efficient well design usable to increase the recovery rate of both conventional and unconventional deposits of hydrocarbons, through the increased proximity of well bores, to producible strata that may, e.g., require fracturing of the strata with proppants to increase said strata's production permeability and/or the practice of injecting produced water back into the strata to supplement the pressure depletion of production.

Pressure maintenance is important because the integrity of the subterranean strata may degrade with pressure depletion and the loss of pressure support may result in, e.g., subsidence within the strata and potentially at surface if the overburden does not bridge across depleted subterranean strata. While water injection or flooding of the subterranean strata directly below a deposit may provide pressure support for production and potentially prevent subsidence, shale, clay and other formation types may react with the injected water to also cause strata instability around the production and/or injection zone. Unfortunately, instability within the strata may prevent future drilling through subterranean strata affected by this instability, and the ability to place well bores for future production may be lost.

A need exists for a more efficient well design capable of managing differing injection and production pressures associated with exploiting all of the vertically stacked producible and injectable strata horizons within an proximal area of, e.g., a salt production deposit, solution mining salt deposit, geothermal steam deposit, and/or substantially hydrocarbon deposits from initial completion of a well to reduce the risk of strata subsidence and instability preventing future drilling.

The present state-of-the-art for low cost recovery well designs, apparatuses and methods is such that standardization not only applies to concentric single bore well designs, apparatuses and methods practiced, but also to upstream hydrocarbon exploration, extraction, and well site processing. Standardization also applies to disciplines within the art, if not the practitioners, themselves, who develop specialized skills in segregated silos of drilling, completion and production, wherein mastering the art does not necessarily involve mastering sets of skills across the combined arts of drilling, completion and production, but rather mastering the methods and apparatus within each silo, using a standard set of methods with standard sized apparatus. Such silos, and the compartmentalized thought process within each, may prevent larger efficiency gains that require stepping across conventional boundaries of practice and art, or out-of-the-box. As such, a need exists for systems and methods usable to overcome boundaries to changing the conventional bore hole and conduit sizes upon which the entire industry has been built.

Historic market forces and fluctuations, between the boom and bust pricing of hydrocarbons, have forced companies to focus on the current day, and not on the future, wherein low cost production has retarded the employment and training of practitioners to the point where artisans, who are capable of bridging between the aforementioned silos, are presently few and far between. As such, each specialized silo delivers a standardized product that is accepted, generally without question. For example, practitioners within the silo of completions rarely question the product delivered by the silo of drilling. Hence, innovation across the disciplines is practically non-existent.

The present state-of-the-art and the need to standardize apparatus, methods and the disciplines of those skilled in the art relating to conventional large scale deposits, without consideration of the future unconventional deposits which must now be developed, may simply be the residue of historic supply and demand conditions, as described by Yergin. Large scale developments have driven a need for the same proven low cost methods of standardization used on Henry Ford's assembly line or in Fredrick Winslow Taylor's methods for optimising the efficiency of the human machine, described in The Principles of Scientific Management. Such standardization, unfortunately, may hinder the present state-of-the-art from meeting the needs for innovations proposed by, e.g., Eni. For various reasons, including the merging of competitors within the industry to reduce transaction and overhead costs, which have resulted in an oligopolistic industry structure where industry standardization is prioritized over innovation, what may be obvious within a discipline may not be particularly obvious across, e.g., the disciplines of drilling and completion.

A need exists for a step change in the efficiency of utilizing subterranean mineral and geothermal deposits that requires breaching the conventional sizing of well conduits during well construction and the operation of said conduits in practice.

A need also exists for a creating a new standard for well design that may be used across the majority of conventional and unconventional subterranean deposits, and which uses to the largest extent possible, existing proven and standardized drilling rigs, equipment and methods, which are familiar to practitioners skilled in art, wherein said practitioners are not restricted to historic conduit sizes and/or a single concentric well bore per wellhead.

Standardization of apparatuses within industry is so prevalent that even when equipment no longer provides a primary function, e.g., when the rotary table of a drilling rig is made obsolete by the installation of a top drive, its size is maintained below a 49.5 inch standard diameter. While historic versions of a kelly and kelly bushing rotary table are still used today, for various reasons, standardization of such relatively obsolete equipment is suboptimal when, e.g., larger diameter conduits and wellheads could be installed more easily using a rig's derrick, if the diameter of an obsolete rotary table is increased.

A need exists for locating the minimum necessary changes to conventional well design that will yield the greatest improvement, while maintaining the present standardization and resulting low cost solutions.

Standardization in the oil and gas industry has been, to the largest extent, driven by the higher per unit value of oil from easily producible sandstone and/or carbonate reservoirs with high porosity and/or permeability, whereas a significant portion of future hydrocarbon production may come primarily from hydrocarbon gas trapped within relatively impermeable shale, which, as described by Yergin, is the most important discovery to occur in this century.

A need exists for improved access and recovery of conventional and unconventional hydrocarbon deposits, e.g., those in very deep water wells, very high pressure wells, viscous tar sand hydrocarbons, relatively impermeable sandstones and/or shale gas deposits.

For example, the effective production of a shale gas deposit requires high pressure injection and fracturing with low friction "slick" water chemical mixtures, wherein fracturing fluids may carry toxic and/or explosive chemicals, e.g., low friction proppant fracturing fluids and/or propane fracturing fluids comprising natural incendiary hydrocarbons.

A need exists for better managing of both pressures and fluids, including fluid injected into a subterranean well and/or produced from a subterranean well, which not only includes pressure and fluid integrity, but also basic handling and/or processing of fluids at the well site within a safe environment.

Furthermore, as recovery rates between 7% and 20% may be expected for shale gas deposits depending upon the manner of fracking, a further need exists for more efficiently performing simultaneous subterranean hydraulic fracturing operations to improve recovery and minimize leak-off of pressure or undesired pressure drops during hydraulic fracturing addressed by the use of simultaneous fracs.

Conventional well construction emphasizes the existence of at least two barriers between subterranean pressurized fluids and the surrounding environment, wherein subterranean zonal isolation may comprise blowout preventers, and a drilling slurry or mud, during construction with casing installation and cementation of the casing, within the subterranean strata, and cap rock containing producible or injectable strata horizons after well construction.

A need exists for greater pressure integrity between injected/produced fluids and the environment, both during and after well construction. A related need exists for better cement placement to provide improved well integrity.

Construction of a well using conventional design generally comprises sequentially drilling and placing successive casings, wherein mitigations often involve installation of additional casing strings during drilling. Additionally, well designs generally include contingency options to increase the reasonable probability of successfully extending a well bore to the targeted deposit while mitigating or eliminating the risk of unplanned releases of injected or produced fluids, or the failure to complete a well due to unplanned events.

A need exists for wells with greater flexibility and large diameter well size options to provide options for contingency casings and liners with respect to encountering unexpected subterranean adversity during well construction, production and/or injection.

Drilling of a well generally comprises using a rotated drilling string to bore a passageway for placement of casings using a drilling fluid, generally comprising a mixture of water, clays, fluid loss control additives, density control additives, and viscosifiers, which is circulated to remove the formation cuttings, maintain pressure control of the well and stabilize the bore hole wall.

A need exists for more effective use of well construction fluids, e.g., drilling mud that may require increases in weight as drilling progresses deeper, and wherein better well control of deeper and higher pressure formations due to the loss of the hydrostatic pressure well barrier of the drilling mud is needed.

The installation of a conductor pipe or casing may include driving it into place with a large hammer, like structural pilings, or a bore may be drilled for its installation, wherein the conductor may have a wellhead at its upper end, and whereby the conductor or casing provides a stable bore for a subsequent boring and casings.

After placement of the initial conductor, constructing a subterranean well generally comprises several cycles of drilling or boring into the subterranean strata, placing steel pipes or conduits (e.g., casing), and cementing the lower end of said casing in place to provide well bore stability and isolation of the surface environment and intermediate formations from subterranean pressures. Each cycle of boring, casing and cementing places a steel protecting lining in sequentially smaller sizes to fit within the inside diameter of the previously installed casing.

A need exists for systems and methods usable to start the construction of a well with higher pressure casings of larger diameters so as to prevent the premature downsizing of a well bore and/or to allow, e.g., two well parallel wellbores usable for side-tracking a plurality of well bores from a dual well bore arrangement.

After the casing has been placed, at least the lower end thereof must be cemented in place. This critical part of well construction provides zonal isolation between different formations, including isolation of groundwater horizons, and provides structural support of the well, wherein said cement is fundamental in maintaining integrity throughout the life of the well and forms a part of corrosion protection.

A need exists for improved cementing of larger annuli to provide well integrity and isolation from subterranean strata for various well conduits.

After the conductor pipe is installed and cemented, the surface hole is drilled and the surface casing is run into the hole and cemented in place. One of the main purposes of the conductor or surface casing may be to protect (through isolation) groundwater aquifers. Given its importance, the conductor and surface casing may be regulated by governmental agencies and engineering requirements to a predetermined depth based upon the deepest groundwater resources and pressure control requirements of subsequent drilling operations.

A need exists for increases in recovery of fluids within subterranean deposits and use of fewer main well bore penetrations through ground water horizons, which cannot be accomplished using conventional single concentric bore well designs, since increased rates of recovery, generally, require additional wells or penetrations through groundwater formations and cap rock containing toxic fluids, thus increasing the risks of leakages to said ground water formations.

As described by Yergin, the technical advancements in drilling and completing horizontal wells are one of the most significant developments in the last 30 years, wherein a horizontal bore through a deposit may improve production performance and allow operators to develop subterranean deposits and resources with significantly fewer wells than may be required with vertical wells.

A need exists for systems and methods usable to form a plurality of horizontal well bores from a single penetration through ground water formations to further increase the recovery rates of fluids from subterranean deposits with fewer wells.

Production tubing is often sized to facilitate improved liquid or gas handling, wherein huff-and-puff operations for intermediately sized tubing may be economic. Unfortunately, while the salt cavern gas storage industry uses simultaneous liquid flow streams for solution mining and one-time dual flow streams for dewatering gas caverns, the upstream hydrocarbon upstream industry does not use dual flow streams, albeit in limited forms of gas lift and jet pump arrangements.

Accordingly, the introduction of a large bore gas production flow stream with a smaller diameter dewatering stream, sized for removing residual water production or acting as a velocity string, could significantly increase both production rates and recoverable gas reserves by minimizing gas flow frictions and dewatering the well bore using small diameter tubing assisted by capillary forces.

A need exists for large bore production and injection operations usable to reduce friction and improve the efficiency of fluid extraction. A further need exists for effectively switching production to a velocity string to remove produced water, prior to ultimately reverting to huff-and-puff operations.

A need also exists for well site processing of produced and injected fluids, e.g., fracturing fluids first injected then extracted during well construction or produced hydrocarbon liquids, gases and water.

Various aspects of the present invention address at least some of these needs.

SUMMARY

The embodiments of the present invention relate, generally, to well conduit systems (1) and methods usable to form and to maintain one or more passageways through the subterranean strata below a wellhead assembly (10). Specifically, conduits of the well conduit system (1) can have a diameter larger than what is conventionally practiced for forming a containment system that is able to contain higher pressures than conventionally installed conduits of the same size.

Embodiments of said well conduit system comprise a first (2) and at least one second (3) conduits with continuous elastically compressible inner and elastically expandable outer pipe bodies (4). A plurality of intermediate radial loading surfaces (5, 6, 41, 42, 49, 123) can extend across an annulus and radially between at least two of the circumferentially elastic conduit walls to form an abutment with an adjacent circumferential conduit wall, to define the at least one concentric annular space (7) therebetween. The abutment of the radial loading surfaces against an adjacent conduit wall adjoins one pipe body to another pipe body, so as to share hoop stress resistances (8) through said abutment.

In an embodiment, one of said pipe bodies abuts to another by compressing the circumferentially elastic larger diameter of the inner pipe body and expanding the circumferentially elastic smaller diameter of the outer pipe body, using a hoop force to insert the larger effective diameter inner pipe body within the smaller diameter outer pipe body. Releasing said hoop force, after insertion, abuts said pipe bodies so as to share hoop stress resistances (8) between the first and the at least one second conduits, to, in use, form a greater effective wall thickness (9) that can be usable to bear higher pressures than that which conventional conduits of the same diameters could bear, if conventionally installed.

In use, embodiments of the present invention can control fluid communication through said one or more passageways between injectable or producible strata and at least one wellhead assembly (10), secured to the upper end of said first and at least one second conduits, forming said one or more passageways through the subterranean strata.

Embodiments of the conduit system (1) can provide additional space to, e.g., provide additional conduit strings and/or use proven off-the-shelf isolation methods and apparatuses within the higher pressure containment system formed, wherein the pressure ratings of larger bore conduits may approach those of smaller bore conduits by sharing hoop stress resistances between a first and at least one or more second large diameter conduits.

Various embodiments may use radial loading surfaces comprising part of at least one elastically compressible inner or elastically expandable outer pipe body (4) circumference wall, for example the embodiments depicted in FIGS. 7, 13, 18-20, 34-37, 50-61. Various other embodiments may use independent bearings intermediate to compressible inner and expandable outer pipe body circumference walls, e.g. those shown in FIGS. 9-12, 21-28, 30-31 and 33.

Other embodiments may use radial loading surfaces comprising a partially plastic deformable portion, e.g., those described in FIGS. 12, 12A, 13 and 18-20, and/or an elastically expandable portion to provide abutment and to share hoop stress resistances (8) between first and at least one or more second conduits. Any form of deformable material is usable (e.g. metal, elastomers, swellable materials), to support the abutment of radial loading surfaces during or after installation.

As a plurality of second conduits (3) may be inserted within the first conduit (2), wherein hoop stresses, associated with hoop force insertion, naturally increase with the adjoined conduits sharing loads through abutted loading surfaces (5, 6), thus causing increasing difficulty in the elastic expansion and/or compression of effective diameters and pipe body circumferences for placement of subsequent second conduits (3). Hence, partially and/or plastically deformable loading surfaces may be used to retain a portion of the hoop stress elasticity sharing of the pipe body, wherein the remaining portion of the elastic hoop stress sharing may result in efficiencies below 100%, but which can still significantly improve the bearing capacity of the system (1) with each successive second conduit (3) inserted. The addition of plastically deformable materials (e.g. malleable metals, elastomers and/or swellable materials) limiting the deformation of metal loading surfaces, may significantly aid placement of additional conduits (3) and the overall efficiency of the effective wall thickness (9) and, thus, the load bearing capacity of the well conduit system (1).

Embodiments of the large diameter, high pressure conduit system, through their size and pressure rating, may incorporate virtually any technology developed for smaller diameter, high pressure axially concentric or axially autonomous conduits, e.g., dual bore trees engaged to a dual bore wellhead to provide dual well bores. A plurality of said high pressure wells may be constructed for simultaneous production and/or injection within the higher pressure bearing walls of a single main bore comprising a large diameter high pressure conduit system.

Embodiments of the present invention minimize the need to deviate from conventional standardization, wherein, e.g., the introduction of large diameter, high-pres sure conduit systems may not require the removal of the rotary table for drilling operations, albeit the rotary table could be temporarily removed for placement of conduits and large apparatuses, and then replaced for drilling. Significant efficiencies may be realized if, e.g., the conventional restriction of passing conduits and equipment, larger than a standard size rotary table, through the rig floor substructure is removed, but it is not a requirement, since large diameter conduits may be conventionally keelhauled beneath the drill floor substructure for subterranean placement.

If, e.g., the master bushings of a 49½" rotary table are removed, a conventional rig may have sufficient room to place a 91.4 cm (36") to 106.7 cm (42") outside diameter conduit or apparatus, depending on rig design, using its derrick, drawworks and blocks. However, if the substructure of the rig is modified, the placement of much larger conduits and apparatuses, e.g. 182.9 (72"), 167.6 (66"), 152.4 (60"), 137.2 (54") and 121.9 (48") effective outside diameters, may become more efficient using the drawworks to lift and lower blocks, suspending conduits using its derrick, wherein the standard 49½" rotary may be easily replaced within an associated adapted rotary table after passage of large conduits.

Other efficiency improvements may involve the use of existing large bore bit arrangements having the necessary pump capacity to provide sufficient velocities for drill cuttings removal during boring and placement of large diameter, high pressure conduit systems, or managed pressure drilling inventions of the present inventor may be used to carry and cement large bore conduits with internal drill strings, as described in FIG. 6. Embodiments of the present invention can be used effectively, without drastic changes to the standardized apparatuses dominating the industry, such as those designed for smaller single concentric bore conduit well designs.

Embodied large diameter, high-pressure conduit systems can be used to provide additional conduit strings to, e.g., construct wells in very deep water, where fracture gradients are very low and/or very deep wells where larger bores may retain hole diameters for the industry preferred reservoir hole size of 21.6 cm (8½) inch boreholes. Various embodiments may be used to provide a plurality of lower end 8½ inch well bores into a reservoir or subterranean deposit through a single high pressure conduit, which may also be usable to, e.g., provide a subterranean vertical separator to process produced and/or injected fluids.

Other embodiments may adjoin first (2) and at least one second (3) conduits using hoop forces comprising gravity, mechanical (38), pneumatic (39) and/or hydraulic (40) forces; e.g., the embodiments depicted in FIGS. 27-32. Hoop forces may comprise, e.g., physically hammering or pushing one pipe body into another with mechanical, pneumatic and/or hydraulic forces, e.g., the embodiments illustrated in FIGS. 21-26, 33, 50-54, 60-61, 84-106 and 113-123, and/or by using hydraulic forces, such as the embodiments shown in FIGS. 34-36, 50-54, 60-61, 84-106 and 113-123.

Various embodiments can comprise a wellhead assembly (10), e.g. the embodiments shown in FIGS. 5-7, 14-15, 17-20, 23, 26, 33-34 and 50-54, with at least one fluid communication conduit hanger spool (14) subassembly, engaged with securable (15) and sealable (16) components to first (17) and at least one second (18) conduit head subassemblies associated with, and secured to, the upper end of first (2) and at least one second (3) conduits. The one or more spool (14) subassemblies can be engaged at the upper end of the first and at least one second conduits or between the first and at least one second conduit head subassemblies to form the wellhead assembly.

Other embodiments may comprise substantially concentric (35), axially autonomous (34) and/or transitions between concentric and axially autonomous (47) conduits, e.g., the embodiments illustrated in FIGS. 14-15, 17, 45-48, 55-61, 69-72, 82-83, 76-118 and 120-132, extending axially downward between at least one wellhead assembly and the lower end of one or more wells. Various conduit transitions, between concentric and axially autonomous (47) passageways, may minimize fluid friction and erosion fluid flowing forces, with their diameters and gradual angular transition, e.g. the embodiments shown in FIGS. 106-108, or their angular transition may occur within a shorter axial distance if fluid flowing forces and/or erosion are less significant, such as the embodiments shown in FIGS. 109-112.

Axially concentric (35) and axially autonomous (34) embodiments of the present invention can be used for any simultaneous flow stream application, e.g. larger bore conduits may initially be used for production until water production causes a switch to higher velocity annular flow or axially autonomous flow velocities, thereby providing the ability to switch between maximum production and velocity production conduits, or, e.g., to allow collection within a tank (13), injection, and/or processing and re-use, of fracturing fluids used during well construction.

Embodiments (49) of the present invention can use a plurality of concurrently weight set mechanical and/or hydraulically axially urged engagable and axially parallel associated autonomous conduit (34) snap connectors, with elastically compressible and expandable circumferences (4A) associated with said pipe body (4) circumferences to, in use, connect a plurality composite joints of substantially concentric (35) and/or axially autonomous (34) disposition, as shown in the embodiments of FIGS. 50-54, 58-61, 76-105, 113-118 and 122-125.

Other embodiments may be comprised of autonomous or connecting inner passageways, annular passageways and/or lateral (194) passageways, e.g., the embodiments shown in FIGS. 34-36, 50-54, 60-75, 84-86 and 93-105, for controlling fluid communication.

Still other embodiments may comprise one or more manifold crossovers (20), e.g., the embodiments depicted in FIGS. 62-75, 84-86 and 93-105, chamber junctions (21) and/or side-pocket whipstock (48), e.g. the embodiments illustrated in FIGS. 14-15, 17, 17A, 38, 45-49, 55-61, 76-81, 87-118 and 120-132, positioned between at least one wellhead assembly (10) and the injectable and/or producible strata of one or more wells, wherein selectively placed valves (24) and/or diverting apparatuses (25) may control apparatus placement and fluid communication; e.g., the embodiments shown in FIGS. 6-7, 14, 17, 60-61, 65-68, 73-75, 93-105, 119, 119A-119E, 122-123 and 128-132. Selective placement of downhole apparatus within one or more passageways, extending downward from a wellhead or inner passageway, may use a bore selector (32) and/or kick-over tool (33K) which are usable to control apparatus and fluid communication through manifold crossovers, chamber junctions and/or side pocket whipstocks.

Various embodiments provide a side pocket (33) comprising a conduit body (48) with upper and lower ends and an axially autonomous (34) bore (199) side pocket formed between said ends on the inside diameter of said conduit, with said axially autonomous bore being usable for urging a strata passage and hanging a protective metal lining across said strata passageway, with said autonomous bore extending axially downward and laterally outward from a lower end whipstock (46) to exit the outside diameter of the conduit system at an axial inclination. The axis of said autonomous bore can be axially and laterally offset from the through passage (198) of the conduit system such that the upper end of said autonomous bore is below the upper end of the containing conduit for engagement with a kick-over tool usable to access said autonomous bore from said through passageway, as illustrated in the embodiments of FIGS. 113-118 and 120-132.

Other embodiments can use a bore selector tool (32) and/or kick-over tool (33K), e.g. the embodiments illustrated in FIGS. 122-124 and 128-132, to selectively access the exit bores of a chamber junction to place valves (24) and/or diverting apparatuses (25) within a plurality of wells.

Still other embodiments provide a kick-over tool (33K), comprising a tool for placing or retrieving well equipment via a through passage (198) of a conduit adjacent to a side-pocket whipstock lateral bore (199), wherein said kick-over tool may comprise an elongate body (197) with an arm (195) that can be movable with said body and/or axially rotatable from a pivot point (196) on said elongate body. A first running and retrieving position and a second position for using said arm to place or retrieve equipment, to and from the lateral bore of a side-pocket whipstock, can be achieved by placing and retrieving the kick-over tool in the first position and using the second position to engage the upper end of the elongate body proximally to the selected lateral bore, so as to divert said equipment to and from said lateral bore with said movable arm, as illustrated in the embodiments of FIGS. 113-118 and 120-132.

Various embodiments may comprise at least one boring assembly axial lower end (45) and/or axial and lateral whip-stock (46, 48) orifice within substantially concentric (35) or axially autonomous (34) conduits for boring strata and placing conduits within said strata and well conduit system, e.g., the embodiments shown in FIGS. 87-90, and 120-132.

Other embodiments may comprise a subterranean fluid processing tank (13), e.g., the embodiments illustrated in FIGS. 17, 60-61 and 93-105, which may be formed within and between the wellhead and the lower end of the first and at least one second conduits so as to surround and fluidly communicate with one or more well passageways of the well conduit system.

Various embodiments can comprise a subterranean separator with connecting substantially concentric or axially autonomous conduit walls and passageways for forming inlets (26), chimneys (27), downcomers (28), diverters (29), spreaders (30) and/or mist extractors (31), e.g., the embodiments illustrated in FIGS. 17 and 62-68, to separate water, liquid and gas hydrocarbons, to perform fluid processing.

Other embodiments may comprise a heat exchanger (12), with substantially concentric or axially autonomous conduit walls, for exchanging heat between fluid within conduits and fluid within a subterranean fluid processing tank to perform fluid processing Embodiments of the present invention can divide or commingle simultaneous fluid flow streams through autonomous or connecting well passageways, within first and at least one second conduits, at various depths to process or separate fluids for injection or production.

Other embodiments may comprise selective control of simultaneous flow streams, e.g., FIGS. 17, 38, 45-48, 60-132 and 135-140, using one or more valves (24), or diverting apparatuses (25), placed within autonomous or connecting passageways.

Embodiments of the large diameter, high pressure well conduit system can be used to better contain fluids and pressures because the subterranean strata may aid internal pressure bearing capacity and thermally insulate downhole processing to provide better flow assurance. Fluids may be produced to an above ground level to be cooled for the purposes of processing, then recompressed and placed with a subterranean separator or distillation large diameter pressure conduit to reheat and further process separated fluids prior to, e.g., transportation through a pipeline and disposal of unwanted fluids, e.g., contaminated water, within a subterranean injection horizon.

Inclusion of larger, thicker walled conduits with an increased effective wall thickness and pressure bearing integrity, using embodiments of the present invention, can provide greater resistance to corrosion and erosion to improve pressure and fluid well integrity.

Embodiments can include conduits and associated apparatuses, which can be engaged with connections using friction, welding, mandrels, dogs, receptacles, slots, slips, threads, bolts, clamps, hoop stress resistances and/or any other fasteners. For example, the embodiments of FIGS. 50-54, 60-61, 93-105, 119A-119E and 120-132, which illustrate various combinations of these connector types. Embodiments of the present invention may use any suitable conventional connector.

Other embodiments may use metal-to-metal, elastomeric and/or cement for the sealing of fluid communication passageways and/or engagement of conduits and associated apparatuses; e.g., the embodiments shown in FIGS. 5-7, 14-15, 18-28, 30-31, 33-37 and FIG. 50-54.

Other embodiments may use single or double olive compression fittings (41, 42) to secure and seal two components of a wellhead assembly together and/or to secure and seal two conduits together.

Embodiments may provide for separate well bore penetrations for multiple wells through a single wellhead, e.g. the embodiments of FIGS. 15, 17A, 17B and 50 to 54. A plurality of laterals may be drilled and completed from each of a plurality of wells through a single larger diameter high pressure main bore to, e.g., minimise the risk of leaks that may contaminate ground water formations and/or to minimise surface equipment in favour of, e.g., vegetation to minimize the carbon foot print and/or greenhouse gas emissions associated with constructing wells and/or infrastructure and producing multiple wells.

Other embodiments may comprise directionally boring and placing protective linings in one or more wells to provide fluid communication between injectable and producible strata and at least one wellhead assembly (10), such as the embodiments shown in FIGS. 5-7, 14-17, 38-39 and 45-49.

Larger diameter, high-pressure conduit systems can provide significantly more options for additional casing or linings by providing more subterranean space within higher pressure casings than is conventionally possible.

Embodiments can provide cased and cemented pressure integrity for lateral bores, typically referred to as level 6 multi-laterals, from a well of a large diameter, high-pres sure conduit system main bore or from the junction of a plurality of wells at the lower end of said system, wherein desired hole sizes may be used with bore selectors in chamber junctions or with kick-over tools within drilling side-track pocket exit adaptations for drilling, lining and subsequent access to, e.g., perforate, hydraulically fracture strata and place proppants, and/or clean the bore after fracturing operations.

Larger diameter well conduit systems may provide more conduit placement options and the option for constructing more wells with batch operations to provide the opportunity to apply knowledge gained from one well to the next more easily, wherein the next well operation or lower end design may be changed to achieve the original objectives given knowledge gained from the previous batch operation, and wherein the scope of one well may be increased to account for the loss of scope on another to, e.g., retain a preferred well bore size and/or allow longer horizontal bores.

Large diameter, high pressure well conduit systems may allow, e.g., the use of the same drilling bottom hole assembly (BHA) on more than one well, rather than laying down the BHA to run casing then picking up a smaller diameter BHA to drill the next section, wherein the cost of rigging up on one well, rigging down, and then rigging up again on a subsequent well is also avoided.

Large diameter, high pressure well conduit systems can be used to process and/or hold reserve drilling fluid, generally referred to as drilling mud, within the well that may be used on more than one well to similar depths, thus allowing fewer changes in mud density across a plurality of wells, and to provide a margin of safety with regard to severe mud losses to subterranean thief zones, since the loss in hydrostatic head is less for large diameter holes than small diameter holes at the same loss rates. The loss of bore hole cleaning velocity is not present in preferred embodiments because drilling fluid or mud may be stored within what is effectively a large cylindrical tank of the system which can include a riser for higher velocity fluid communication within the tank to remove boring debris with higher velocities within the riser, wherein other conduits within the tank may be used for cleaning the tank prior to completion of the well and/or as a separator and/or heat exchanger after completion of the well.

Embodiments may use gravity assisted fluid flow or cementation of large diameter high pressure conduit systems during or after boring of strata and placement of protective linings to provide better fluid flow or cement placement, which lowers the risks of losses to the weak subterranean formations that may prevent adequate cement placement.

Various embodiments can provide a plurality of wells vertically and/or laterally oriented and spaced to, e.g., provide improved recovery of subterranean deposits.

Other embodiments can provide a conduit system for hydraulically fracturing strata for one or more wells individually or simultaneously to, e.g., provide improved recovery of subterranean deposits.

Other embodiments may selectively control fluid communication with computer operation (102, 108) of valves, e.g., using electrical, pneumatic and/or hydraulic operators and/or surveillance equipment that can be usable for observation of pressures, temperatures and/or flow-rates within one or more passageways.

Various large diameter, high pressure, well conduit systems may provide a plurality of lateral bores from each of a plurality of wells, which, through their proximity and hydraulic fracturing capabilities, may naturally provide an increased rate of recovery and/or provide subterranean thermally efficient processing spaces, which can be computer managed (102, 108) to optimize reservoir pressure maintenance and production.

Large diameter, high pressure conduit systems may use subterranean data gathering and control devices for operating subterranean processing of a plurality of wells through a main bore separator, thus providing an opportunity for continuous production and injection, which is usable for both reservoir pressure management and production, wherein unwanted subterranean fluids, e.g., produced water, may be injected back into the strata immediately after being produced to, e.g., help maintain reservoir pressures.

Embodiments provide simple, low-cost improvements applicable to most subterranean well construction and production operations, which are far from obvious to the compartmentalized, distinct silos of drilling, completion and wellsite production processing practitioners, because the space provided by a larger diameter, higher pressure well conduit system can be used to place virtually any off-the-shelf apparatus within a subterranean contained environment.

Embodiments of the present invention can provide additional benefit through the use of conduits for cementing and circulation during construction, annulus monitoring during initial production, well bore cleaning for both construction and production processing operations, and, ultimately, switching from a large bore low friction production conduit to velocity string production conduits usable to lift produced fluids, e.g., water, which may retard production in later years through a larger bore.

Large bore high pressure well conduit systems can be constructed and operated in a more environmentally conscious manner than is currently the conventional, thus providing benefit during any transition from hydrocarbon to renewable energy sources.

BRIEF DESCRIPTION OF THE DRAWINGS

Preferred embodiments of the invention are described below by way of example only, with reference to the accompanying drawings, in which:

FIGS. 1 to 4 illustrate various rig well drilling operations usable with various embodiments and the high pressure large bore wellhead system of FIG. 5.

FIGS. 6 to 8, 14 and 15 depict well operations usable with the present invention to place and cement subterranean conduits with, e.g., the large diameter conduit hoop stress sharing engagements illustrated in FIGS. 9 to 13.

FIG. 14A depicts a prior art plumbing compression olive arrangement in reference to FIGS. 14 and 18-33, while

FIGS. 18 to 37 depict various large bore, high pressure, well conduit system arrangements of the present invention.

FIGS. 38 to 47 illustrate comparisons of conventional practice and various method embodiments of the present invention to unconventional shale gas deposits.

FIGS. 55 to 59 depict various high pressure large bore arrangements relative to access through a single main bore.

FIGS. 62 to 68 illustrate various subterranean separator inlet embodiments.

FIGS. 69 to 112 depict various adaptations of manifold crossover, chamber junction, diverter apparatus, and kick-over tool embodiments, which can be usable with large bore, high pressure, well conduit systems of the present invention.

Figure 9:
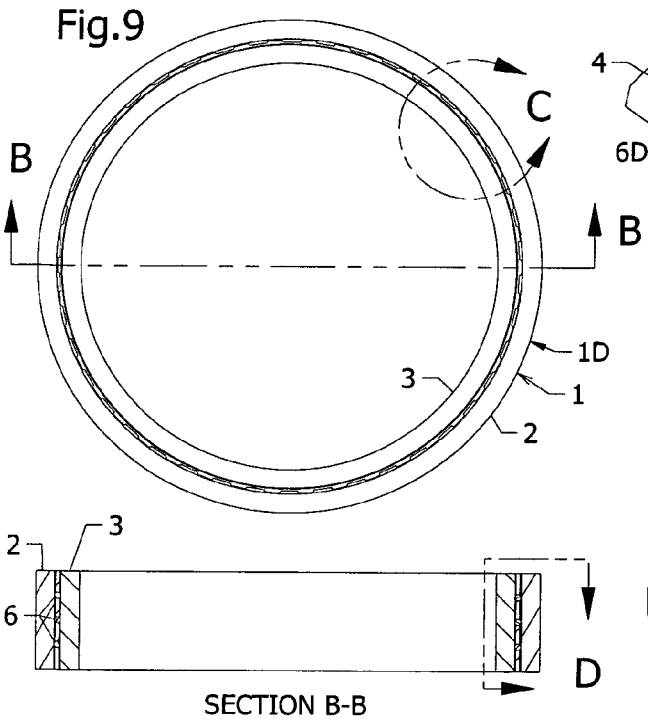

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Referring now to FIGS. 1, 2, 3 and 4, the Figures depict diagrammatic views of cross section slices through the environment and subterranean strata for a prior art above ground level (56) onshore drilling (51A) rig (51) above a line A1-A1, an onshore prior art coiled tubing drilling (51B) rig (51) above a line A2-A2, a wireline drilling (51D) rig (51) arrangement above line A3-A3, and a prior art offshore jack-up drilling (51C) rig (51) above a line A4-A4, respectively. With regard to FIGS. 1-4, any rig, including the rigs (51) depicted, can be used to operate and/or drill within a large diameter, high pressure conduit system (1); however, larger hoisting capacity rigs (51A and 51C) are, generally, preferred for installing said conduit system (1), particularly when such rigs are adapted for installing large diameter conduits. Various rigs, e.g., rigs that are specially designed for installation of large conductors by driving or boring, placing and/or cementing large diameter piles, can be usable for installing a large diameter, high pressure (LDHP) conduit system (1).

Various embodiments of the present invention may be used in place of the general embodiment representations (1AX, 1AY, 1AZ and 1BA) shown in FIGS. 1, 2, 3 and 4, respectively, wherein, e.g., an embodiment below line A1-A1 may drill one or more directional well bores for placement of conduits below a LDHP conduit system (1AX) using, e.g., adaptations of the whipstock and kick-over tool embodiments shown in FIGS. 113 to 132, or the concentric conduits embodiment of FIG. 5. Kick-over tools (33K of FIG. 2) of the present invention or bore selectors (32 of FIG. 2) of the present inventor may be used to, e.g., drill a lateral extending bore, as shown below line A2-A2, from a LDHP conduit system (1AY). Cable deployed apparatuses comprising, e.g., arrangements taught in GB2465478B, may be operated within a LDHP conduit system (1AZ) to, e.g., clean conduits (59) of a well bore, e.g. those of the separator depicted in FIGS. 17A, 60-61 and 93-98, or to drill lateral bores through whip-stocks, such as those shown in FIGS. 113-132. Within an offshore environment, boats (55 of FIG. 4) may supply rigs that can install a LDHP conduit system (1BA) which can be usable below, e.g., a subsea tree (53) located below sea level (54), and which is connected via a pipeline conduit to a platform (52) with various forms of one or more wells placed through a main bore within the strata (A4-A4), below mudline (57).

FIG. 5 depicts a diagrammatic cross section elevation view through a high pressure, large bore conduit system (1) embodiment (1A) and subterranean strata, in which the conduit system (1) can be usable for communicating with a desired strata formation (61) through, e.g., perforated (60) conduit (59A) within conduits (2, 3, 4, 7 and 59). For example, a first conduit (2) embodiment (2A), generally termed as a conductor conduit, may be placed below ground (56) or mudline (57) level. In addition, the conduit system (1) can include a plurality of conduit (3) embodiments (3A) that can include an associated plurality of inner radial loading surfaces (6). The inner radial loading surfaces (6) can comprise any elastically flexible material and/or shape, or a partially plastically deformable material and/or shape, with an elastically flexible portion (6A), for extending from concentric (35) pipe body (4) embodiments (4A1-4A4) and across intermediate annuli (7) embodiments (7A) to contact associated loading surface (5) embodiments (5A), by radially extending from one pipe body to abut to an adjoining pipe body, so as to cause a sharing of hoop stress resistances so as to form a greater effective wall thickness (9).

The wellhead (10) may, e.g., be comprised of a smaller wellhead (10A1) within a larger (10A2) wellhead for hanging associated concentric (35) conventional conduits (59) and conventional annuli (58), and the pipe body embodiments (4, 4A1-4A4) that extend axially downward and substantially below the ground (56) or mudline (57), with associated annuli (7, 58), that can be accessible through said wellhead (10). The well can be usable to produce or inject to a desired strata formation (61) through perforations (60), conduits (4, 59) and the wellheads (10).

Depending upon the downhole conditions and application, tubing packers, subsurface safety valves, liners, and liner top packers can be present, wherein any appropriate conventional completion apparatus may be included within a LDHP conduit system (1) because conventional apparatus is suitably sized for use therein.

The LDHP well conduit system (1A) can be, e.g., used to fluidly access significantly deeper formations (61), for ultra-high pressure and temperature applications, than is presently the convention or practice. This is due to a significantly greater number of conduit strings that can be used to sequentially isolate ever deeper subterranean formations. As such, an upper larger diameter wellhead (10A2) may have a significantly larger effective wall thickness (9) and associated higher pressure bearing capacity to support, e.g., conduits (59) and wellhead (10A1) arrangements, which are conventionally higher pressure due to their wall thickness and smaller diameters. For example, conduits without loading surfaces may comprise an inner most 7.3 cm (2⅞"), 17 kg/m (11.44 pound per foot (ppf)), 655 N/mm2 (95 thousand psi (ksi)) yield strength tubing conduit (59A) that is capable of bearing a 1,698 bar (24,630-pounds-per-square-inch (psi)) collapse and a 1,754 bar (25,440-psi) burst pressure, within a 12.7 cm (5"), 34.3 kg/m (23.2-ppf), 1034.2 N/mm2 (150 ksi) casing conduit (59B). This casing conduit (59B), can bear a 1,788.4 bar (25,940-psi) collapse and a 1,730.2 bar (25,100-psi) burst, within a 17.8 cm (7"), 60 kg/m (41-ppf), 1,034.2 N/mm2 (150 ksi) casing conduit (59C), which is capable of bearing a 1,572.4 bar (22,800-psi) collapse and a 1,525.5 bar (22,120-psi) burst, within a 24.45 cm (9⅝"), 105.7 kg/m (71.8-ppf), 1034.2 N/mm2 (150 ksi) casing conduit (59D), which is capable of bearing a 1352.8 bar (19,625-psi) collapse and a 1,410.3 bar (20,450-psi) burst, within a concentric hoop stress sharing radial loading surface. The concentric hoop stress sharing radial loading surface can be supported by a 29.85 cm (11¾ ") conduit (4A1), a 34 cm (13⅜") conduit (4A2), a 40.6 cm (16") conduit (4A3), a 50.8 cm (20") conduit (4A4), and a 61 cm (24") conduit (4A5), wherein an effective wall thickness (9) can comprise the innermost 27.4 cm (10.772") internal diameter for the 11¾", 89.5 kg/m (60-ppf) conduit (4A1) to the outermost conduit 24" outside diameter (OD) conduit (4A5), wherein a 55% efficiency of the nominal 6.614" wall thickness, or 3.6377" effective wall thickness for a 24" OD conduit of 551.6 N/mm2 (80,000 psi) yield material, may be capable of bearing a 20,575-psi collapse and a 21,219-psi burst, according to a API bulletin 5C3 calculation. Such an example can result in a 20,000-psi burst rating throughout the conduits, annuli and smaller wellhead (10A1), whereas only the innermost two (2) conduits are capable of such pressure bearing capacity within conventional practice.

Figure 12:
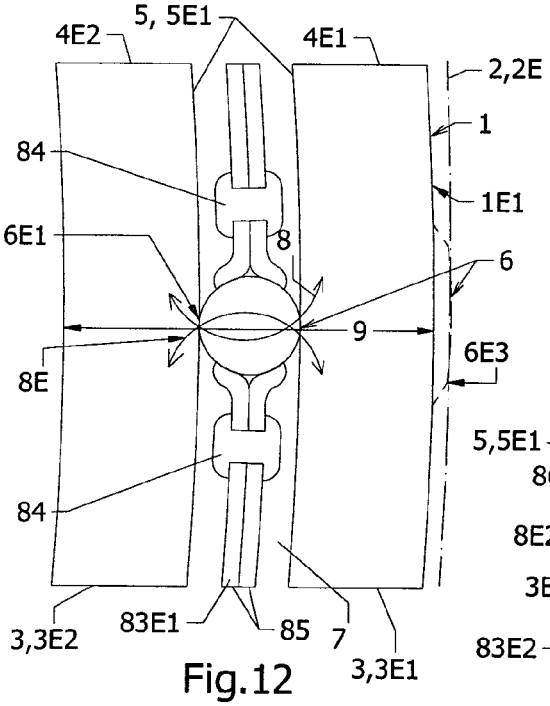
Figure 13:
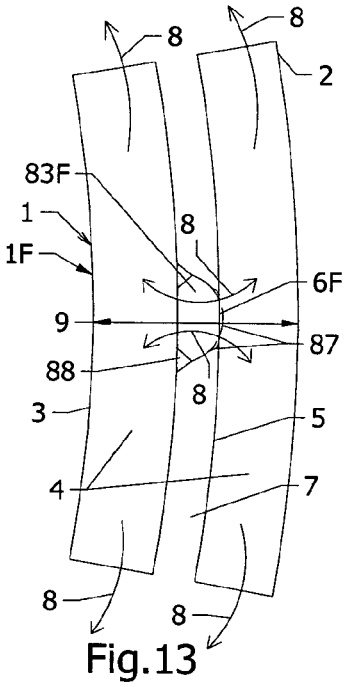

A large diameter high pressure conduit system (1) will, generally, elastically expand and compress the circumferences of larger diameter conduits, preferably those greater than 21.93 cm (8⅝") OD and 18.73 (7⅜") inside diameter (ID), to form a series of adjoined conduits that include radial extending loading surfaces, which can abut to an associated circumference of an inner or an outer pipe body to form an abutment hoop stress sharing reinforced conduit system that surrounds smaller diameter conduits, which are, generally, better able to bear pressures given the more rigid nature of their smaller diameter hoop stress bearing capabilities. Loading surfaces of the present invention may have any shape that abuts two adjacent conduits, e.g., those shown in FIGS. 7 to 13, 18-19, 21-28, 30-31, 33-37 and 50-61, so as to adjoin conduits after elastically expanding and compressing conduits during installation. Thereafter, when their pipe bodies attempt to elastically return to their original shape, the loading surfaces form abutments that allow stresses to pass through the abutment, as shown in FIGS. 11 to 13. A LDHP conduit system (1) can include housing one or more wells or associated conduits, and can include fluid communication conduits and/or well processing conduits with, e.g., computer controlled (108) compressors and/or pumps as described in FIG. 17.

Referring now to FIG. 6, the Figure shows an elevation diagrammatic view of a slice through a subsea casing boring placement embodiment and subterranean strata during, e.g., a floating drill ship or semisubmersible rig drilling. FIG. 6 shows placement of an embodiment (2B) of the outermost first conduit (2) of a large diameter high pressure conduit system (1) embodiment (1B), which includes drilling a strata bore (66) below a mudline (57) with a bottom hole assembly BHA (65). The BHA (65) comprises a boring bit (71) and hole openers (72), integrated with drill pipe (73) between upper (62) and lower (63) slurry passageway tools, as described in GB2475626A, for placing a first conduit (2) with a loading surface (5) embodiment (5B), consisting of the inside circumference of the pipe body (4), which is shown engaged to a subsea (54) guide base (64) that comprises part of the first conduit head subassembly (17) embodiment (17B). The first conduit (2) can be carried and placed with the BHA (65) and drill string (73), within the strata bore (66), by boring with the bit (71) and hole openers (72), wherein fluid can be circulated downward (67) and returned upward (68, 69) to remove drill cuttings or strata debris from the bore (66). Once the first conduit (2) and guide base (64) are placed at the desired depth, an actuation tool, e.g. a drill pipe dart, may be pumped through the drill string (73) to open a lateral conduit (194) cementing (194B) port (70) to perform a gravity cementing top-up cement job, and the BHA (65), drill string (73), upper (62) and lower (63) slurry passageway tools may be removed.

The first conduit (2) of the present invention may be installed by any means, e.g., rotary or casing drilling of the conduit (2) with any type of rig, hammering, or a driving of the conduit (2) into the mudline (57) or ground level (56) with any type of large hammer, or the vacuum sucking of the conduit (2) into the mudline with any type suction pile apparatus and method.

FIG. 7 illustrates a diagrammatic elevation slice through the subterranean strata and a LDHP conduit system (1) at subsea (54). The Figure further includes a mudline (57) or ground level (56) installation of a second conduit (3) embodiment (3C) within a first conduit (2) embodiment (2C), with cementing of the arrangement within the strata. A wellhead (10) first assembly embodiment (10C), with a first conduit head subassembly (17) embodiment (17C) and at least one second conduit head subassembly (18) embodiment (18C), and including associated lower end first and second conduits (2, 3), can be usable to form a large diameter high pressure conduit (1) embodiment (1C). FIG. 8 shows a diagrammatic plan view of the loading surface (6) embodiments (6C), with circulation and lateral conduit (194) cementing (194C) tool flow paths (70). Referring back to FIG. 7, after placement of the first conduit (2), the second conduit (3), having spherical loading surfaces (6C) extending through the intermediate annulus (7C), can be inserted within the first conduit (2) to abut against the circumferential loading surface (5C) of the pipe body ID and adjoin the two conduits (2, 3) pipe bodies (4) to share hoop stress resistance through their abutment. In this instance, a strata bore (66) was formed with a separate drill string, and the second conduit (3) was subsequently placed within the first conduit (2), with a slurry passageway tool (74) at its upper end and drillable casing shoe (76) at its lower end, using a valve arrangement of the present invention that comprises upward circulation (68), which can occur downward to circulate the conduit (3) into the bore (66) if the actuation tool (78) is not present and the spring (79) of the passageway tool uses the plate (80) to cover its vertical passageway (82).

The elastic compression of the larger effective diameter loading surfaces (6) of the inner conduit (3), within the elastically expanded smaller diameter loading surface (5) of the outer conduit (2), may occur with hoop forces between the pipe bodies that can be formed by the axially downward force of the string (3, 73, 74, 75, 76), which can be filled with a fluid heavier than the surrounding fluid to increase the weight for expanding the first conduit (2) and compressing the second conduit (3) to adjoin the conduits (2, 3) and abut the loading surfaces (5, 6), by allowing the spherical profile of the shaped loading surface (6C) to wedge into the circumferential loading surface (5C) until the wellhead (10C) lands on the upper end of the first conduit (2). Portions of the spherical abutment-loading surface (6C) may plastically deform during the loading, provided that the elastic hoop stresses of the conduit (3) pipe body (4) embodiment (4C) are retained for sharing through the remaining elastic portion of the abutment. FIG. 13 describes such an embodiment.

Cementing of the second conduit (3) within the first (2) may be accomplished with an actuating tool (78) pumped through the drill string (73) and engaged with the spring (79) loaded plate (80) to divert cement through the lateral passageway (70), to flow axially downward (81) within the annulus (7C) between the conduits (2, 3) and around the loading surfaces (5C, 6C), with pump force and gravity past, e.g., any fluid thief zone (77). The spring (79) can be compressed by the use of a shoulder or extension (75) for forming the loaded plate (80) for diverting the cement through the lateral passageways (70). Displaced fluid can return through the slurry passageway tool vertical passageways (82). Such gravity cementing is preferable to top-up conventional cement jobs because circulation may still bypass shallow weak formations with potential fluid theft zones (77), whereas normal conventional cement placement occurs through the centre of the string with displaced fluids and cement returned through the weaker annulus; however, any form of cementing, appropriate to the downhole conditions, may be used with the present invention.

Figure 10:
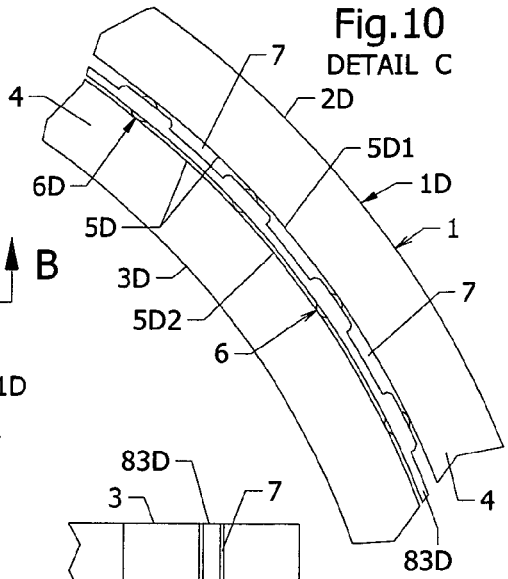
Figure 11:
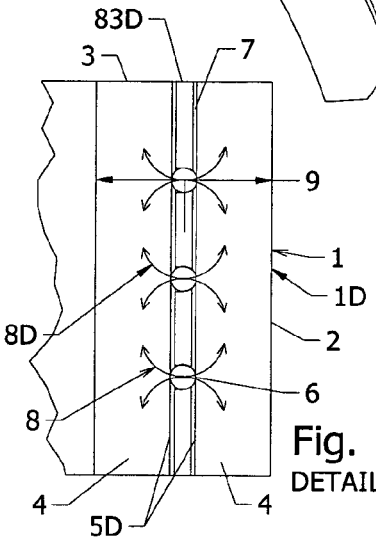

Referring now to FIGS. 9, 10 and 11, the Figures show a plan view with section line B-B and detail line C above an elevation cross section view along line B-B with detail line D, a magnified detail view within line C, and a magnified detail view within line D, respectively, of a large diameter high pressure conduit system (1) embodiment (1D). A second (3) inner conduit is shown concentrically placed within a first (2) outer conduit, wherein the second (3) inner conduit and first (2) outer conduit have continuous elastically compressible and expandable pipe bodies (4), respectfully, with circumference loading surface (5) embodiments (5D) and an intermediate spherical loading surface (6D) extending radially through the annulus (7) between the conduits to engage a plurality of the spherical radially disposed loading surfaces (6D) to the associated loading surface circumferences (5D). The abutment of one conduit to the other may comprise expanding the effective diameter of the radial loading surfaces (6D) of lesser diameter around the associated outer loading surface circumferences (5D, 5D2) prior to adjoining the conduits (2D, 3D) by weighted wedging, hydraulic piston driving, hammering, rotating, and/or any other means of forming a hoop force sufficient to place one conduit within the other conduit loading surface (5D1) by elastically expanding the outer pipe body (4) conduit (2D) and/or by compressing the intermediate loading surface (6D) and/or inner conduit (3D) to, in use, install one conduit within the other and share hoop stress resistances (8, 8D). This adjoining of the conduits forms a greater effective wall thickness (9), which can be usable to bear higher pressures than said conduits (2, 3) could independently bear without sharing hoop stresses. Within this embodiment (1D), the radial extending surfaces are illustrated as ball bearings held by an intermediate concentric centralizing structure (83D), which is shown engaged around the outside diameter of the at least one second conduit (3) before it is disposed within the first conduit (2), or another different surrounding second conduit.

Figure 12A:
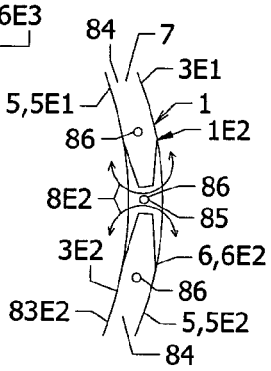

FIGS. 12 and 12A show sliced plan view and diagrammatic plan cross section view, of the loading surface portion, of a large diameter high pressure conduit system (1) embodiments (1E1) and (1E2), respectively. The Figures illustrate an example of an additional second conduit (3E2) installed within a second conduit (3E1), which has already been installed within a first conduit (2E), or alternatively second conduits (3E1 and 3E2) with an intermediate centralizing structure (83E1 or 83E2) installed together as a unit within a first conduit (2E) having loading surface (6E3). The intermediate concentric centralizing structure or strapping (83E1) may comprise machine pressed circumferential concentric conduit plates (85) deformed over corresponding orifices and loading surfaces (6E1), prior to riveting (84) the conduit plates together, as shown in the arrangement of FIG. 12. Alternatively, a centralizing structure (83E2), comprising a metal and/or inflatable/swellable material (84 and 85, respectively, or vice versa) arrangement, with optional orifices (86), can be used, as shown in FIG. 12A, The intermediate concentric centralizing structure can be placed between a second (3E1) conduit and at least another second (3E2) conduit to abut the circumferential loading surface (5) embodiments (5E1, 5E2) of the pipe bodies (4E1, 4E2) against the intermediate spherical (6E1) or inflated/expanded metal (6E2) loading surfaces (6) to, in use, share hoop stresses (8, 8E, 8E1 or 8E2) after placement through a greater effective wall thickness (9).

The illustrated centralizing structure (83E1) may be replaced with an inflated/expanded metal arrangement (83E2), or any other variation of loading surface arrangement, to engage circumference loading surfaces (5, 5E1, 5E2) before or during installation, e.g., loading surface (6E1) may be a combination of ball bearings, tubing and/or cable axially aligned or helically coiled around the installed conduit (3E2) and held by a series of centralizing structures or strappings (83E) to affix the loading surface during expansion and contraction of the pipe bodies (4, 4E1, 4E2) using, e.g., weight, hammering or a hydraulic piston installation within the larger second conduit (3E1) or the first conduit (2E), through a loading surface (6E3) if, e.g., the second conduits (3E1, 3E2) are installed together as a unit.

Since the sequential installation of loading surfaces and sharing of hoop stresses increases the containing conduits resistance to expansion and/or compression, various radial loading surfaces may be applied to conventional conduits, e.g., the two second conduits (3E1, 3E2) may be installed as a unit with an intermediate loading surface arrangement, such as that shown in (83E1) of FIG. 12 or that shown in (83E2) of FIG. 12A. Orifice arrangements (86) can be filled with, or can contain encapsulated fluid, to initiate an expansion of, e.g., swellable elastomeric material, or the orifices (86) can be left open to provide space for a metal to compress. For example, the metal (85) may be arranged with the elastomer (84) bearing, or vice versa, such that at least a portion of the hoop stresses (8E2) may be shared.

The shape of the loading surfaces (6), e.g. the interface (6E2), may be any shape to provide the desired level of effective wall thickness (9) efficiency, wherein said efficiency may be less than 100% to provide the ability to progressively increase the overall pressure bearing capability by successively adjoin conduit body (4) walls and loading surfaces (5, 6), for sharing a portion of the effective wall thickness (9).

To provide improved adjoining of conduits and abutment of loading surfaces during the various means of installation, e.g. when one conduit is violently hammered into another, a centralizing structure, e.g. (83D of FIGS. 9-11, 83E1 and 83E2 of FIGS. 12 and 12A, 83F of FIGS. 13 and 83J of FIG. 19) may be covered with, e.g., a elastomeric substance and/or reactive swellable substance that both seals the annulus (7) between conduits (2, 3) and supports the loading surfaces (6). Alternatively, the annulus between conduits (2, 3) and loading surfaces (5, 6) may be, e.g., cemented after installation when, e.g., plastic deformation is used (87 of FIG. 13).

FIG. 13 depicts a sliced plan cross section view of a portion of a large diameter high pressure (LDHP) conduit system (1) embodiment (1F), which illustrates the sharing of hoop stresses (8) through an effective wall thickness (9) larger than would be possible without such hoop stress sharing through the abutment of a loading surface (6F), which can be welded (88) to the second conduit (3) that is abutted against a circumferential loading surface (5) to adjoin the pipe bodies (4) of the first (2) and at least one second (3) conduits. A limited amount of plastic deformation (87) of a loading surface (5, 6F) may be desirable to better share the hoop stresses, improve the effective wall thickness efficiency, and provide for the abutment and adjoining of one large diameter conduit to another, so to increase the overall pressure bearing capacity. The large diameter provides space within the system (1) for placement of axially concentric and/or autonomous conduits to one or more wells through the improved single main bore of the LDHP conduit system (1), wherein any material may fill the annular space (7) between the conduits (2, 3) to facilitate placement, abutment, adjoining, sealing and/or pressure bearing capacity, e.g., plastically deformable and/or a water or oil swellable material activated after placement of the second (3) within the first (2) conduit.

Figure 14:
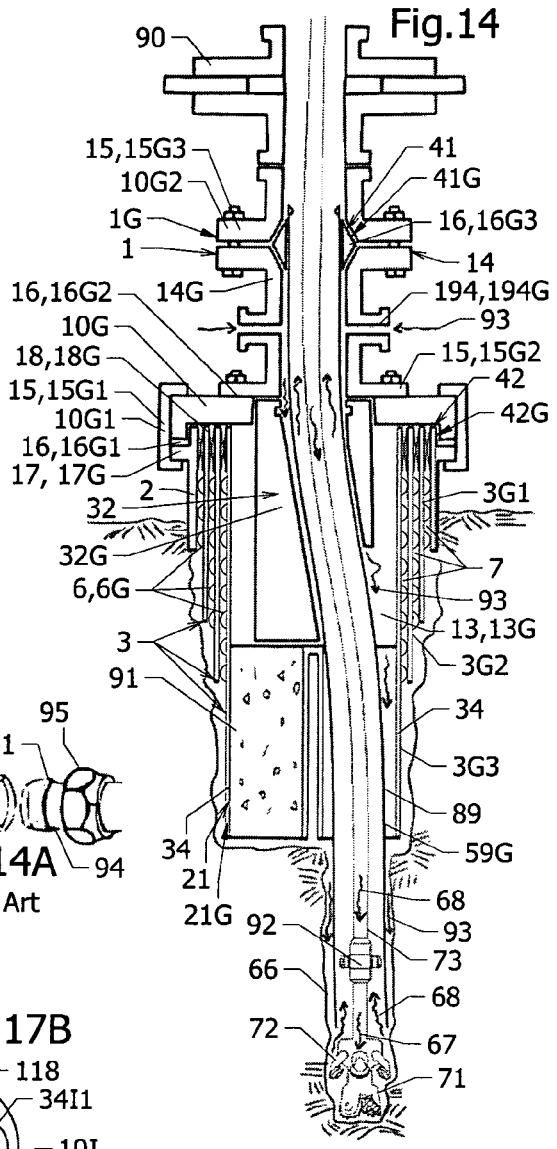

Referring now to FIG. 14, the Figure shows an elevation view diagrammatic slice through subterranean strata and a large bore high pressure conduit system (1) embodiment (1G), which comprises a chamber junction (21) embodiment (21G), single olive (41) embodiment (41G) and double (42) olive embodiment (42G) arrangement. The Figure depicts the operation of boring with a drill string (73) lower end bit (71) and a hole-opener (72), which is centralized (92) within a casing (89) or well lining (59G) and guided through a chamber junction (21G), to function as an axially autonomous conduit (34) that extends axially downward through a second conduit (3G3) and bore selector (32, 32G). The conduit (34) is suspended, with the use of an olive (41G), within a wellhead spool (14G) to provide a drilling fluid communication conduit, through a tank (13) embodiment (13G), for holding and circulating drilling fluid, similar to a trip tank, formed by the chamber junction (21G) LDHP conduit system (1G).

Boring may proceed more conventionally through the casing (89) until the well lining (59G) can be hung from the lower end of the chamber junction. Alternatively, like the embodiment of FIG. 15, minor skidding of the rig over the exit bores (34) of the chamber junction (21G) may occur during boring, through separately placed axially autonomous conduits hung from a wellhead top (e.g. 10T of FIG. 54) and fixed to the spool lower wellhead (10G). As depicted, drilling or boring of a strata bore (66) may comprise keeping drilling fluid within the tank (13G), which is isolated at its lower end by drillable cement (91) in the adjacent autonomous conduit (34). Once the casing (89) or well lining (59H) is released from the single olive (41G) and the casing (89) is placed and cemented, it will seal the tank (13G) for drilling the cement (91) and adjacent strata bore. The depicted deployment of casing (89), which may form autonomous conduit (34) bores within the LDHP conduit system chamber junction (21), may be accessed from a central position to save the installation time of moving or skidding a rig by rotating the bore selector (32G) to communicate with various wells conduits (34). The tank (13G) may be used for improved well control of the primary fluid barrier by holding a volume of fluid, which falls more slowly than is the convention because leak rate consumes drilling fluid from a larger volume to provide a longer period before closing the second barrier blowout preventers (90), if required. Circulation (93) can occur downward through a lateral conduit (194) port (194G), in the wellhead spool (14G), between the casing (89) and strata bore (66), wherein the fluid volume returned (68) is the normal pumped volume (67) plus circulation (93) less any fluid losses, wherein the probability of fluid loses and the casing becoming stuck may be reduced through better maintenance of the hydrostatic head with the tank (13G) functioning like a rig trip tank.

Figure 14A:
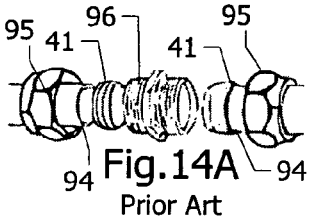
Fig.14A Prior Art

Referring now to FIGS. 14 and 14A, the elevation view of the LDHP conduit system (1G) and an isometric view of a conventional compression pipe fitting arrangement with a single olive (41) arrangement. The tank's (13G) high pressure bearing capacity is formed by the abutment of loading surfaces (6, 6G) to adjacent conduits (3G2, 3G1, 2), and the clamp (15G1) and flanged (15G2, 15G3) securing (15) of a large diameter high pressure wellhead (10G), wherein the wellhead may comprise a larger diameter wellhead (10G1) with first (17, 17G) and a plurality of second (18, 18G) conduit head subassemblies engaged to conduits (2, 3G1-3G3) which are intermediately sealed (16) with a single olive (41G), double olives (42G), and gaskets (16G1, 16G2, 16G3), usable for both securing and sealing the upper end conduits of the tank engaged to an upper end larger (10G1) and smaller (10G2) wellheads. Prior art use of a single olive (41) to secure and seal permanent conduits within a wellhead is equivalent to the common plumbing compression pipe fitting, wherein the olive (41) is placed over the conduit (94) and compressed between a spool (96) and moving engagement (95), generally a screwed nut is used to secure and effect a seal. The present invention makes a significant improvement over prior art with the use of a single olive (41G) to temporarily suspend casing (89) within a strata bore (66) during boring, such that the casing may be lowered after boring in stages during boring to provide, e.g., better circulation through weaker formations when using larger bits (71) and hole openers (72) to better facilitate improved placement of subterranean passageways through the LDHP conduit system (1). The present invention may also provide significant improvements with a double (42) olive (41) casing hanger, wellhead securing and sealing arrangement as further described in later Figures.

FIG. 15, depicts an elevation view diagrammatic slice through a large diameter high pressure conduit system (1) embodiment (1H) with a chamber junction (21) embodiment (21G) and double (42) olive (41) embodiment (42H). The Figure illustrates how a chamber junction may be drilled without a bore selector and with minor skidding of the rig over the exit bores (34) of the chamber junction (21G), through separate axially autonomous conduits between the chamber junction and the wellhead top (e.g. 10T of FIG. 54), which is secured at the upper end of the double olive (42H), and which secures and seals the conduits (2, 3) adjoined with radial loading surface (6) abutments to the circumferences of the pipe bodies. FIG. 15 shows casings (89) with casing annuli (58H), wherein the casings (89) may be suspended from casing hangers of a wellhead that can be engaged to the top of the double (42) olive (41) arrangement and potentially to the exit bore (34) conduits, as shown on the right hand side, or the casing may be carried (89) with the drill string in a managed pressure conduit drilling arrangement of the present inventor, as shown on the left hand side of FIG. 15.

Figure 16:
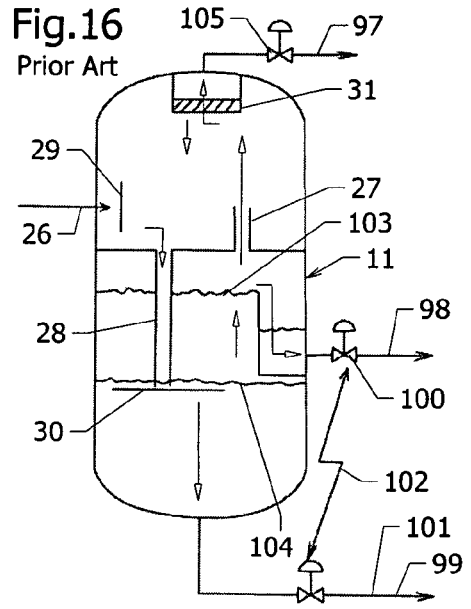
Fig.16 Prior Art
FIG. 16 shows a prior art vertical separator.

FIG. 16 shows a diagrammatic elevation view of a cross section through a prior art vertical separator (11), wherein the present invention can include the use of such a separator. The Figures show the separator disposed downhole, with an inlet (26) engaging a diverter (29) to roughly separate entrained gases and liquids, which may fall with gravity through a downcomer (28) to engage a spreader (30). The separation process allows gas to be separated and to migrate through a hydrostatic liquid level (103), through a chimney (27) and mist extractor (31), to a gaseous fluid flow (97). The liquid, e.g. hydrocarbons, of a lighter density, may separate with gravity to a level (103) for extracting a substantially hydrocarbon liquid fluid flow (98), such that heavier density water below a water level (104) can migrate to the lower level water fluid outlet (99). A pressure-actuated valve (105) regulates the liquid fluid level (103), while the coordinated operation (102) of the hydrocarbon liquid level valve (100) and water level valve (101) regulates the interface (104) between liquids.

Figure 17A:
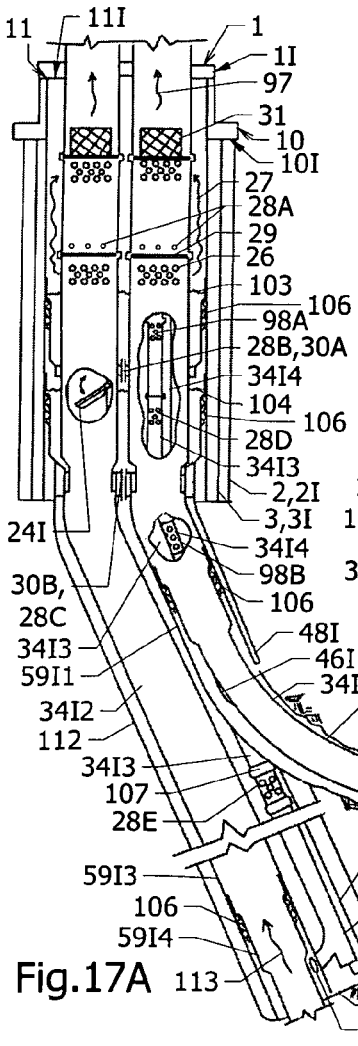
FIG. 17A shows a processing arrangement example.
Figure 17B:
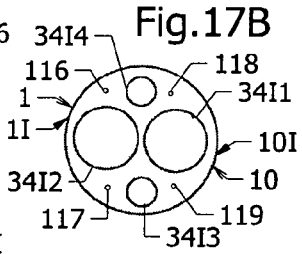
FIG. 17 illustrates a large bore high pressure well conduit system flow diagram depicting the interaction of fluid processing, compression or pumping, and the use of computer control (108), while FIG. 17B provides a dual well design.
Figure 17:
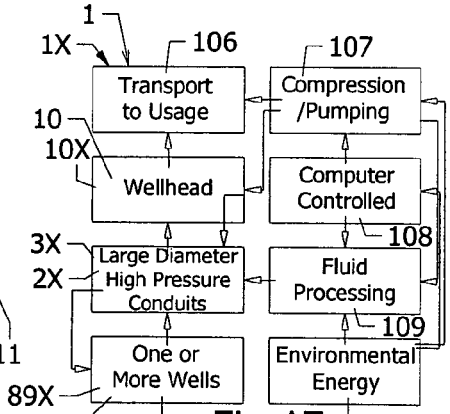

FIG. 17 is a diagrammatic flow chart of a large diameter high pressure well conduit system embodiment (1X), depicting a LDHP conduit system (1) that can comprise first (2X) and at least one second (3X) conduit bodies (4) adjoined with loading surface (5, 6) abutments to share hoop stresses (8) for forming a greater effective wall thickness (9) with an efficiency greater than the conduits (2, 3) would possess in isolation, without said sharing of hoop stresses. The Figures includes a wellhead (10) embodiment (10X) that can be secured and sealed to the upper end from one or more wells and associated conduits (34X, 89X, 59X), usable for injecting fluids to the strata and/or producing fluids from the strata for transportation (106). Transported fluids may be pumped and/or compressed (107) for said transportation (106) and/or processed (109), which may be computer controlled (108), and wherein the pumping, compression, fluid processing and computer control may be conventionally and/or environmentally powered (110). Accordingly, the larger diameter and higher pressure bearing capability of the present invention, as compared to conventional well designs, provides significant improvements for increasing the efficiency of downhole processing (109) comprising, e.g., subterranean tanks (13), separators (11) and heat exchangers (12) for production, injection and processing optimization of fluid communication to and from one or more passageways through the strata, and from one or more wells within the main bore of the LDHP conduit system (1). These improvements can include providing accessibility and control via, e.g., valves and sensors engaged with a computer monitoring and control system using downhole cables and/or hydraulic lines.

Figure 100:
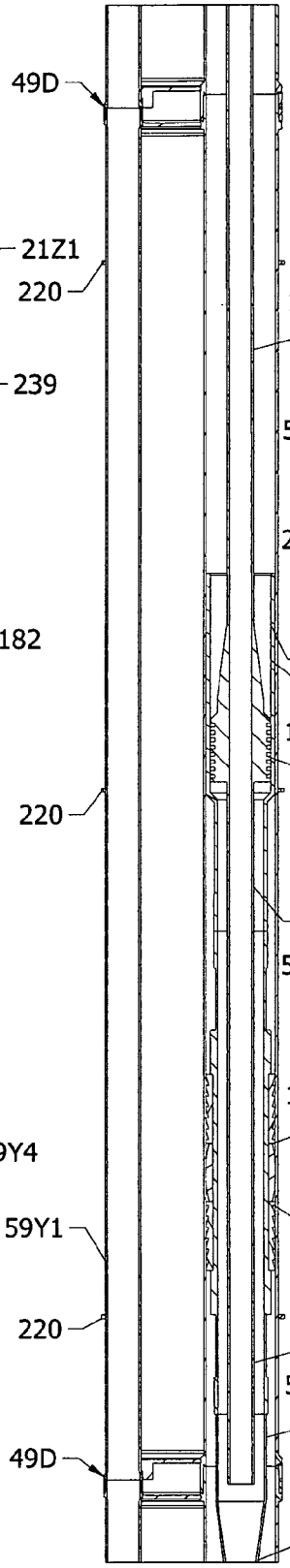
Figure 101:
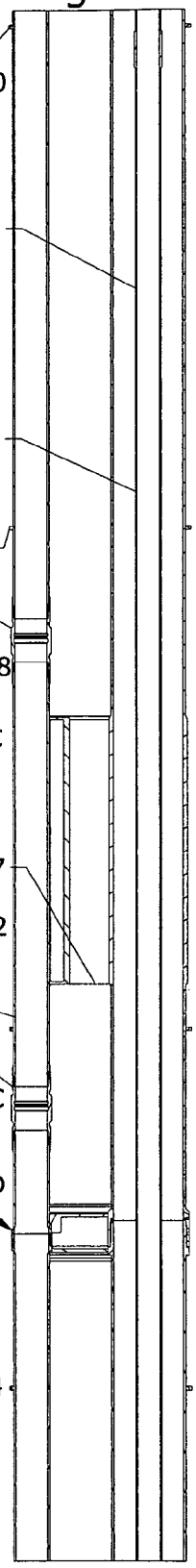
Figure 102:
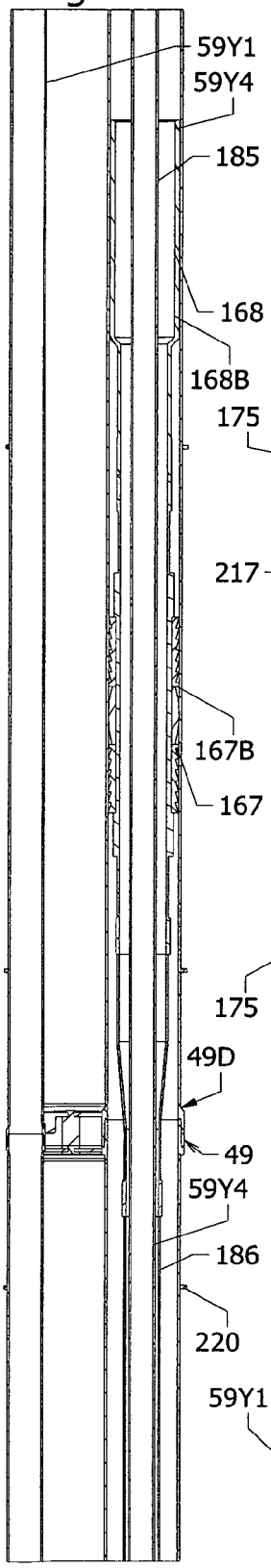
Figure 103:
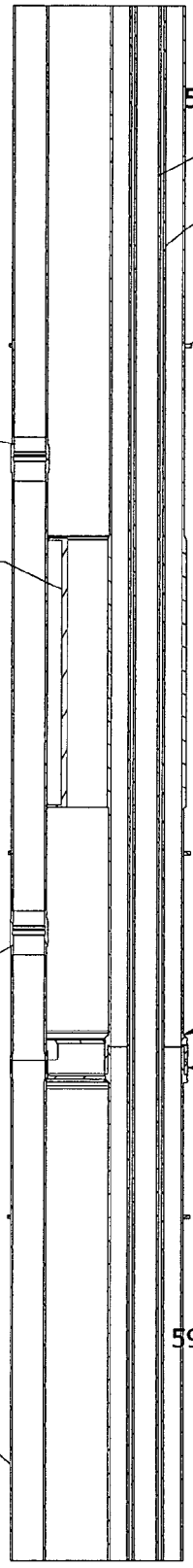

FIG. 17B shows a diagrammatic plan view of the wellhead (10) embodiment (10I) and bores of an embodiment (1I) of a LDHP conduit system (1) associated with FIG. 17A. The Figure illustrates the arrangement of wellhead (10I) interfaces that may comprise, e.g., main well bores (34I1, 34I2) with an upper end dual bore valve tree, wherein the conduit system comprises a single main conduit tank forming a separator (11I of FIG. 17A) and/or heat exchanger, with supporting conduits (34I3, 34I4) usable for operating the separator (11I of FIG. 17A). Control lines (102 of FIG. 16) for valves (e.g., 24I of FIG. 17A and 100, 101 of FIG. 16) may be passed through (116) the wellhead. Additionally, downhole pressure, temperature and/or fluid level sensors, and/or sensor cables may pass through (117)

the wellhead, while downhole flow meters and/or meter cables can pass through (118) the wellhead. Any suitable devices, e.g. chemical injection lines, may pass through (119) the wellhead.

Referring now to FIG. 17A, a diagrammatic elevation cross section through a large diameter high pressure (LDHP) conduit system (1) embodiment (1I), is shown, with cut-out and break lines representing removed portions. The Figure illustrates a high pressure separator (11) embodiment (11I) below a wellhead (10) embodiment (10I), which can be suitable for processing fluids from, e.g., a substantially gas shale gas deposit. The Figure shows that gas flows (113) into the separator inlet (26) from a horizontal section (111) of the axially autonomous (34) well bores (34I1, 34I2), which are shown with a break lines representing the removal of a lower portion of the wells, wherein the well 34I1 exits from a whipstock (46I) arrangement (e.g. 46 of FIGS. 120-121) in the wall (112) of the separator (11I), and gas, from the shale gas deposit (110), flows through strata fractures (109) propped open with proppants, e.g. sand, placed through perforations (108) in the well (34I1) lining or metal casing (59I2) and hung from the liner hanger (106) in the lining (59I4) and the other well lining (59I1) above the whipstock (46I). Wells may be formed by the successively boring and hanging of liners (59I2, 59I4), by engaging liner hangers (106) to a larger well linings (59I1, 59I3). More than one lateral, from a well (34I1 or 34I2), may be provided with a side-pocket whipstock (48I), which can comprise, e.g., the arrangements of FIGS. 113-132.

Production may be controlled with the subsurface safety valve (24I) shown within the left cut-out, wherein production (113) travels, e.g., through the well bore (34I1) until it encounters the diverter (29), which may comprise, e.g., a cable deployable plug (25A of FIG. 119A), whereby production can be diverted to the separator (11I) inlets (26). Fluids are communicated upward in the chimney (37) to re-enter the well conduits (34I1, 34I2), through a cable placeable mist extractor (31), which further knocks out liquids to the downcomer (28A) before the gaseous production is extracted (97). The cable deployable diverter (29) and mist extractor (31) may be removed to access the lower end of the wells (34I1, 34I2). Gravity separation of the liquid can occur as it exits the inlet (26) and downcomer (28A) to form a liquid level (103) above primary (28B, 30A) and secondary (28C, 30B) downcomers and spreaders, respectively. If the separator (11I) stops at the lower end of the conduits (2, 3), as shown, the downcomer (28C) and spreader (30B) are omitted. As shown through the diagrammatic cut-outs, the hydrocarbon (98A) and water (28D) outlets or intakes may be disposed at differing depths using separate conduits or combined at a single depth in a conduit (34I3) to affect the fluid levels (103, 104). Separated water may be taken from conduits (34I3) using pump suction, which is discharged to (34I4) annulus through an orifice (114) for disposal within the strata until the water level (104) drops and a sensor detects hydrocarbons, wherein the pump is switched from water disposal to production until gas reaches an outlet (98A, 28D) and suction is lost. Thereafter, the pump is stopped and the separation process continues until a different sensor, within the separator, determines the pump should be restarted.

Alternatively, in a similar higher pressure arrangement, separating, e.g., natural gas liquids (NGLs), pressure within the separator (11I) may be used to communicate NGLs between the gas liquid level (103) and the water level (104) through an outlet (98A) at the upper end of an axially autonomous (34) conduit (34I3), while water is forced axially down the lower end of conduit (34I3) through a downcomer (28D), when a plug (e.g. 25A of FIG. 119A) is placed, via cable operations, in a nipple between the hydrocarbon liquid separator outlet (98A) and water disposal inlet (28D). Water entering the conduit (34I3) from an outlet (28D) may be disposed of using injection into the strata through the conduit (34I3) orifice (114) and annulus below the lower liner hanger (106) of a well (34I2), or the conduit (34I3) may be placed within its own strata bore to a desired location for water disposal or, e.g., a water flood for reservoir pressure maintenance.

As illustrated, conduits (2I, 3I) of the LDHP conduit system (1I) separator (11I) may extend axially downward from the wellhead (10I), vertically, or the conduits (2,3) may extend axially downward and laterally along line (112), at inclinations and dog-leg severities generally limited by the stiffness of placing and abutting large diameter conduits, albeit said loading surfaces may be adjusted to accommodate flexure at predetermined depths while retaining a proportion of the efficiency for a more rigid arrangement. If the separator (11I) and conduit system (1I) conduit (2, 3) extend along well inclination (112), the downcomer (28C) and spreader (30B) allow a deeper hydrocarbon and water interfaces that may use hydrostatic pressures for separator operation.

As demonstrated, the supporting axially autonomous (34) conduits (34I3, 34I4) may be configured in a various ways to interface with well bore conduits (34I1, 34I2) and/or producible and/or injectable fluids. The build-up of solids within the separator (11I) may be removed by placing fluid communicating straddles, e.g., the straddle (25E) of FIG. 119E may be placed in the nipple (107) across communication ports (28A-28E, 98A-98B) to seal them, while allowing fluid through the centre of the straddle to fluidly circulate between the lower ends (115) of the supporting conduits (34I3, 34I4) to clean solids from the system. Cable operable fluid motorized tools of the present inventor may use, e.g., brushes, bits and other tools deployed from the rig (51D of FIG. 3) for maintenance and cleaning. For example, during well construction or abandonment the lower orifice (114) can be used for cementing axially down the annulus below the lower liner hanger (106), after which a rotary cable tool may be used to clean any residual cement within the conduits.

Furthermore, ball, dart or other drop mechanism may operate sliding side doors, spring returns and/or otherwise actuated lateral ports or valves may be operated by dropping a ball down one conduit (e.g. 34I3) and taking fluid returns through the other (e.g. 34I4), wherein the actuating mechanism may be recovered by reversing flow through the associated conduits. Accordingly, any subterranean device (e.g., transponders, receivers, acoustic devices, sensors, fibre optic cables, control lines, flow meters, valves (24), sliding side doors, circulating valves, diverting apparatuses (25), nipples (107), plugs, cementing plugs, wiper plugs, dropped actuation devices, such as balls/darts/cylinders, remote controlled devices, pressure/temperature activated devices, valves, chokes, orifices, jet/velocity pumps, chemical injection apparatuses, sensors, straddles, bomb hangers and gauges), or any other suitable device may be operated within the separator through wellhead (10I) interfaces.

FIG. 18 depicts a plan view with line E-E above a cross section elevation view along line E-E, with detail lines F and G associated with FIGS. 19 and 20, respectively, with dashed lines showing hidden surfaces, showing a LDHP conduit system (1) embodiment (1J) and double (42) olive (41) embodiment (42J). A second conduit (3) embodiment (3J) is abutted and adjoined to the first conduit (2) embodiment (2J), with a loading surface (6) axial helical embodiment (6J) abutted to an associated loading surface (5) embodiment (5J), with an upper end wellhead (10) embodiment (10J). The wellhead is shown comprising the upper ends of the adjoined conduits secured and sealed with a double olive arrangement. The axial helical nature of the loading surfaces may be used to facilitate a turning or screwing abutment during placement during hoop force insertion comprising, e.g., hammering, weight and/or hydraulic means. While conventional well designs engage a thick metal wellhead to the upper end of well conduits, the depicted wellhead (10J) builds the strength of the wellhead with successive layers of second conduits (3) within a first conduit (2), wherein the intermediate double olive arrangement is also a loading surface arrangement.

Referring now to FIGS. 19 and 20, the Figures illustrate magnified detail views within lines F and G of FIG. 18, with dashed lines showing hidden surfaces, illustrating the axial helical disposed loading surface (6J) on the body (4) of the second conduit (3J), that can radially extend across the annulus (7) between conduits (2, 3) and can be abutted to the circumferential loading surface (5) of the first conduit (2J) to form a larger effective wall thickness (9J2). An upper end wellhead (10J) is formed by first (17) and second (18) conduit head subassembly embodiments (17J, 18J), wherein a double (42) olive (41) embodiment (42J) comprising two single olives (41J1, 41J2) can secure and seal the pipe bodies and wellhead flanges (120, 121), using a wedge (122) embodiment (122J). The arrangement forms a greater wellhead effective wall thickness (9J1, 9J2) than wellhead conduits that have not been adjoined and abutted with loading surfaces to share hoop stresses. The shape and slenderness of the loading surfaces (6J) allows, e.g., elastic movement of the helical extension (6J) plastic deformation or bending of its end, wherein the annulus (7) may be filled with, e.g., cement or fluid reactive swellable elastomers which swell after placement, to secure the radial loading surfaces from further deformation or bending. Partially securing the abutment of the loading surfaces (5, 6) with a relatively flexible material provides a percentage of the effective wall thickness (9J2) and easier installation of successive second conduits (3) within a LDHP conduit system (1), which becomes more difficult to expand with each adjoined second conduit (3).

FIGS. 21 and 24 are plan views with section lines H-H and J-J above associated elevation cross section views along H-H and J-J, having detail lines I and K associated with FIGS. 22 and 25, respectively. The Figures illustrate double (42) olive (41) embodiments (42J) comprising both securing (15) and sealing (16) embodiments (15J) and (16J), wherein the sealing, securing arrangement is in a pre-engagement of the securing (15J1) seal (16J1) position and post-engagement of the securing (15J2) seal (16J2) position.

Referring now to FIGS. 22 and 25, the Figures depict magnified detail views within lines I and K of FIGS. 21 and 24, respectively, showing the double (42) olive (41) wedge (122) embodiment (122J) in an pre-installed position (122J1) and post-installed position (122J2). As shown, the upper portion of the wedge (122JU) can be urged from the installation, securing and sealing positions (122J1, 15J1, 16J1) into the installed, secured and sealed positions (122J2, 15J2, 16 J2), respectively, by radially urging the inner single olive (41J2) inward from the pre-installation, unsecured and unsealed position (41J2A) to the installed, secured and sealed (41J2B) positions, wherein the inner surfaces of the olives (41J1, 41J2) are also secured and sealed against the surfaces of the wedge (123). FIG. 22 also shows an outer single olive (41J1, 41J1A) with the inner single olive (41J2) for forming the olive arrangement (42J), while FIG. 25 also includes an outer single olive (41J1, 41J1B) with the inner single olive (41J2) for forming the olive arrangement (42J).

FIGS. 23 and 26 are magnified elevation views within detail line G of FIG. 18 which show the double (42) olive (41) embodiment (42J) within the wellhead (10J) in a pre-engagement, unsecured (15J1) and unsealed (16J1) position and a post-engagement, secured (15J2) and sealed (16J2) position, respectively, to form the LDHP conduit system (1) embodiment (1J) shown in FIG. 18. The wellhead flange (121) support (10J5) engages the double olive arrangement (42J) between the inner (121) support (41J5) and outer (120) support (41J5) of the wellhead (10, 10J) flanges of the associated first (17J) and at least one second (18J) conduit head subassemblies. The wedge (122J), having larger inner and outer diameters is urged axially downward to urge the upper wedge portion (122JU) towards the lower wedge portion (122JL, lower wedge portion (122JL) also shown in FIGS. 22 and 25) to urge out the loading surfaces of the inner (41J2) and outer (41J1) olives (41) for expanding the outer conduit and compressing the inner conduit to abut the loading surface circumferences (5) of the wellhead flanges (120, 121); and thus, wedge loading surfaces (123) with a hoop force to adjoin the second conduit (3J) to the first conduit (2J) and form the wellhead (10J).

The dashed lines of FIG. 26 represent an alternative wellhead (10) embodiment (10J1) and double (42) olive (41) embodiment (42J1), wherein the wedge may be urged axially upward or downward to provide a hoop force with, e.g., a receptacle (124, as also shown in FIGS. 22 and 25) for the wedge embodiment (122J) or with a J-slot (125) and/or receptacle (124), as shown in embodiment (122JJ) if, e.g., the wellhead flanges (120, 121) extend upward to form wellhead embodiment (10J1) flush with the upper end of the wedge (122LU), wherein the J-slot may be used to grip and urge the wedge from its secured position if the wellhead is being disassembled.

FIGS. 27 and 30 are plan views with section lines L-L and N-N above associated elevation cross section views along L-L and N-N, having detail lines M and 0 associated with FIGS. 28 and 31, wherein FIGS. 28 and 31 are magnified detail views within lines M and 0, respectively, depicting a double (42) olive (41) embodiment (42L). The double (42) olive (41) embodiment (42L), depicted in FIGS. 28 and 31 includes securing (15), sealing (16) embodiments (15L) and (16L), as shown in FIGS. 27 and 30, which can use inner (41L2) and outer (41L1) olive (41) loading surfaces, usable, e.g., between the wellhead (10J) circumferential loading surfaces (5) of FIGS. 18 to 20 and the wellhead (10K) of FIG. 33 or (10L) of FIGS. 34 to 37, wherein the second conduit (3L, shown in FIG. 34) loading surfaces (6) are below the wellhead. The FIGS. 27, 28, 30 and 31 include a sealing, securing arrangement that is illustrated in a pre-engagement wedge (122L, 122L1) unsecured (15L1) and unsealed (16L1) position and a post-engagement wedge (122L, 122L2) secured (15L2) and sealed (16L2) position.

The inner (41L2) and outer (41L1) olives (42) shown in unsecured and unsealed positions (41L2A, 41L1A, respectively) are urged into secured and sealed positions (41L2B, 41L1B, respectively) to engage their radial extending circumferential loading surfaces to the circumferential loading surfaces of the wellhead and wedge sealing profiles (123), wherein the upper wedge portion (122LU) may be held while the lower wedge portion (122LL) is urged between the olives (41) of the double (42) olive (41) arrangement.

FIG. 28 shows an alternative J-slot (124LJ) arrangement in dashed lines for instances where a flush wedge arrangement is desired, and a J-slot mandrel is place within the J-slot to hold the upper portion (122LU) while urging the lower one (122LL), or vice versa, during removal of the double olive arrangement (42L).

Referring now to FIGS. 29 and 32, the Figures illustrate isometric views of an installation tool tong (126) embodiment (126A) usable for installing the securing (15) and sealing (16) loading surface embodiments (15L, 16L) of FIGS. 27 to 28 and FIGS. 30 to 31, wherein the tongs may be operated by any means, e.g. hydraulic cylinders, mechanical or electrical driven gears or screw drives and/or pneumatic pistons, such that the tongs are inserted into the wedge receptacles (124L, shown in FIGS. 28 and 31) and moved between positions (126A) and (126B), wherein either the lower (124L) or upper (124L) wedge portion is moved to form a hoop force for installation or removal.

Figure 33:
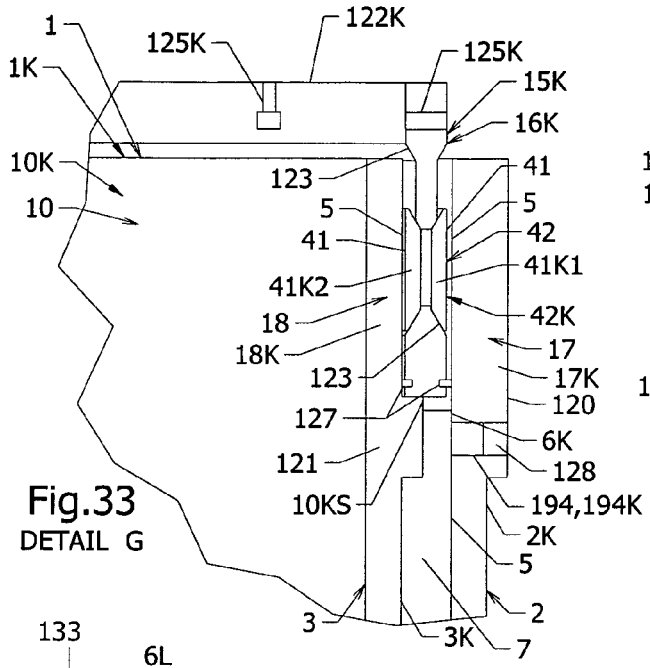

FIG. 33 illustrates a magnified elevation view within detail line G of FIG. 18, showing a wellhead (10) embodiment (10K) with a double (42) olive (41) embodiment (42K), and also comprising pre-engagement wedged (122), securing (15) and sealing (16) embodiments (122K, 15K, 16K, respectively) that are usable to form a LDHP conduit system (1) embodiment (1K). Seals (127) at the lower end of the wedge embodiment (122K) may be urged axially downward between the wellhead (10K) flanges (120, 121) of first (17) and at least one second (18) conduit head embodiment (17K, 18K), while hydraulic pressure is applied above the seals (127), wedge (122K) and support surface (10KS) to expand the circumference loading surface (5) of the outer flange (120) and to compress the circumferential (5) loading surface of the inner flange (121). Installation hoop forces for engaging the inner (41K2) and outer (41K1) olives (41), used to share the hoop stresses of the flanges (120, 121) of the double olive arrangement (42K), may be reduced by securing and sealing the olives before release of any hydraulic pressure trapped by seals (127).

The interface to the hydraulic lateral opening (194) embodiment (194K), for hydraulically driving installation hoop forces, may be similar to (194L) of FIGS. 34 to 37, wherein hydraulically driven fluid is used in the annulus (7) between the at least one second conduit (3) and the first conduit (2) to compress and expand the conduits and to drive a lower end piston with fluid communicated into the annulus (7). The profile (10KS) supports the seals (127) to allow application of pressure between the loading surfaces (6K) and the conduits (2K, 3K) so as to install the pipe bodies with associated expansion and compression to allow abutting of the loading surfaces (6K) to the circumferential (5) loading surface of the first conduit (2K) once the wedge (122K) is installed. Thereafter, the pressure may be relieved to provide abutment with a plug or cap (128) for sealing the hydraulic fluid communication lateral opening (194K) from contaminates. In FIG. 33, the wedge (122K) includes an embodiment of a J-slot (125K).

Figure 35:
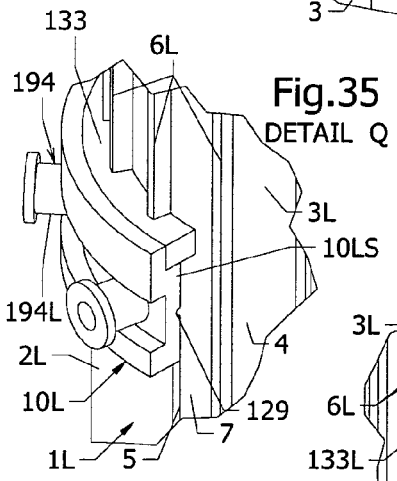
Figure 36:
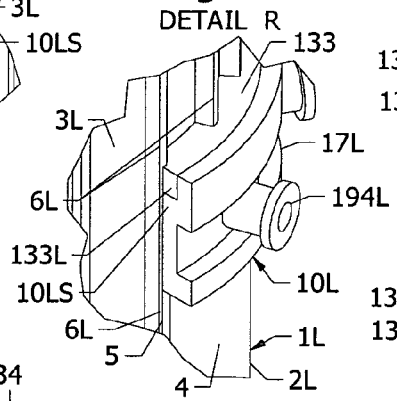
Figure 37:
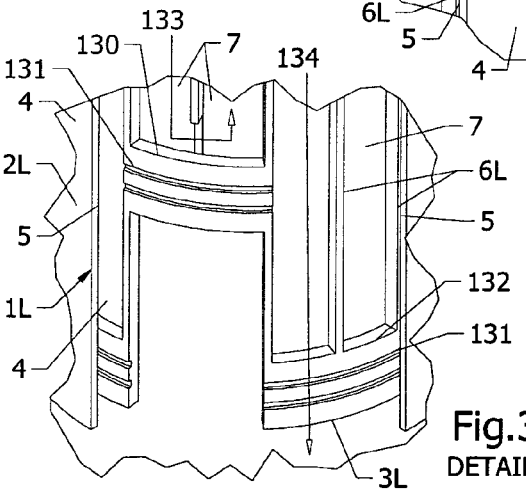
Figure 34:
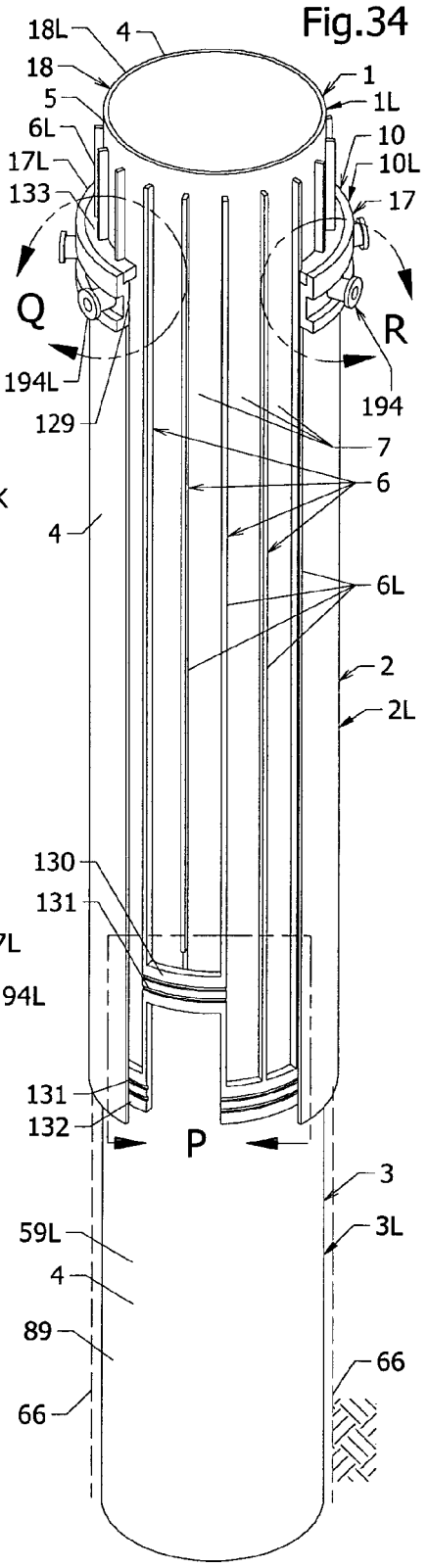
Figure 41:
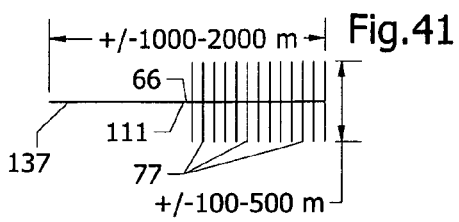
Figure 42:
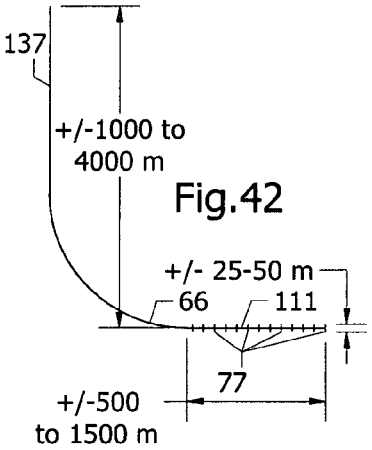
Figure 43:
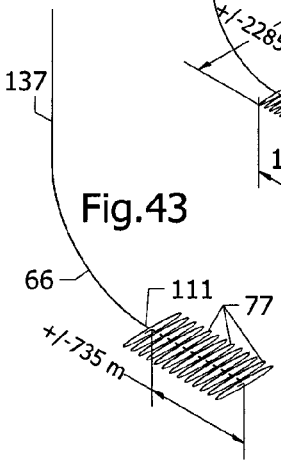
Figure 44:
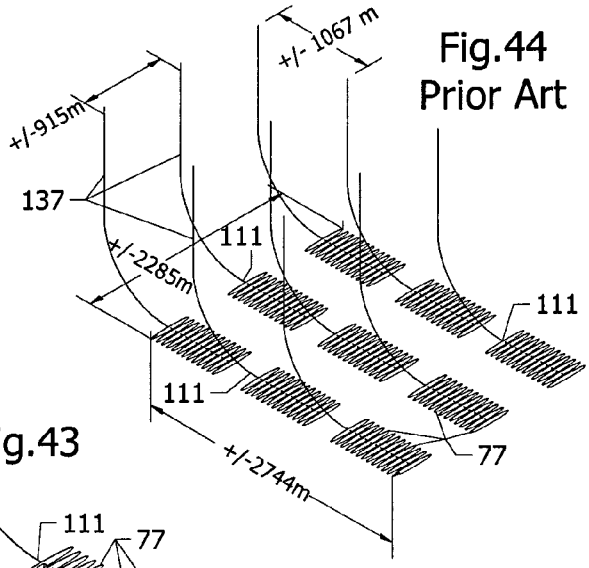
Fig.44 Prior Art

FIG. 34 depicts an isometric view with a quarter section of the outer first conduit assembly (2L) removed, with detail lines Q, R and P, and FIGS. 35, 36 and 37 depict magnified detail views within the lines of Q, R and P of FIG. 34, respectively, for a LDHP conduit system (1) embodiment (1L) and wellhead (10) embodiment (10L). The inner second conduit (3L) may be hydraulically driven into the first conduit (2L), wherein additional spools (14) may be added to the upper end of the wellhead (10L). A plurality of inner second conduits may be hydraulically placed into associated outer second conduits. A lower end well casing (89) and lining (59L) are engaged below the pistons (130, 132) to secure and protect, or to case-off, the strata well bore (66), so as to prevent unintentional strata fracture initiation or propagation and/or strata bore instability during subsequent well operations. At least the lower portion of the annulus between the strata bore (66) and casing (89) may be cemented using the lateral port (194L) and annuli (7) between loading surfaces (6L), once the lower piston (132) is urged below the lower end of the first conduit (2L) using the upper piston (130), annular spaces (7) and lateral openings (194L) against the upper seal (133).

To urge the at least one second conduit (3L) axially downward within the first conduit (2L) or another second conduit, hydraulic spools, similar to the first conduit head (17) embodiment (17L), can be engaged to the upper end of the wellhead (10L) for use in pumping hydraulic fluid through lateral conduit (194) embodiments (194L). The lateral conduit (194) embodiments (194L) may have selective pressure passageways (129) to various annular passageways (7) for communicating with circulating pistons (130) or fixed annular pistons (132), having associated seals (131) to trap pressure within the annuli (7) between the sealing loading surfaces (6L) and upper end installation seal (133), which may be removed from the first conduit head (17L) and replaced by a wellhead seal supported (e.g. 10KS of FIG. 32) by the loading surfaces (6L). The second conduit (3L) can be urged axially downward within the first conduit (2L), when fluid is pumped into the lateral conduit (194L) using the pistons (130, 132). When a second conduit (3) is urged within the first conduit (2), or a different second conduit, the hydraulic pressure hoop force expands and compresses the associated pipe bodies (4) with associated loading surfaces (5,6) to facilitate the urging of one conduit within the other, such that when the hydraulic pressure hoop force is removed, the radial extending loading surfaces (6L) can abut to the circumferential loading surfaces (5) to share hoop stresses and to form a larger effective wall thickness that can be used to suspend one conduit within the other during installation. A series of pistons (130, 132) may be placed at differing depths to allow the annuli of one piston (132) to exit the lower end of the first conduit (2L), or a different surrounding second conduit, to allow, e.g., cementing (134) of the conduit being urged within the strata bore (66) through the annular passageways, forced below the containing conduit pipe body (4) by using the shallower piston (130). The shallower piston's annulus can be fillable with cement by using circulation (133) of the annuli (7) through selective fluid ports (129) to communicate between radial loading surface isolated annuli.

Once placement of a second conduit's (3) radial extending loading surfaces (6L) are below the wellhead support (10LS), which may be slotted to accommodate such loading surfaces with the seal (133L) used for cementing, or it may be replaced with a special cementing seal which has injection and/or return circulation orifices and passageways through its body for cementing operations. Thereafter, the second conduit head (18) embodiment (18L), shown as just the pipe body (4), may be sealed against the first conduit spool (17L) or another spool added to its upper end by using various pack-off and/or double olive (42) arrangements to seal and/or secure the upper end of the second conduit (3) within the wellhead (10L).

Referring now to FIG. 38, an elevation cross section diagrammatic view of a slice through the strata is shown, which compares large diameter, high pressure conduit system (1) embodiments (1N, 1M) to existing (137, 138) well designs for an unconventional injection and production of well accessing, e.g., shale gas deposits. Shale may become impregnated with hydrocarbon gas from the same sources as any hydrocarbon found in a more conventional deposit (144, 145, 149), e.g. permeable sandstone, wherein the hydrocarbons may have migrated (146) through more permeable strata from a source kitchen to the conventional deposit, and wherein shale gas may have migrated (147) through a less permeable formation, e.g. fractured and/or leaking cap rock (148) comprising, e.g., relatively impermeable limestone, claystone, siltstones, and shale, into a more permeable and/or naturally fractured shale stone (142), which can be covered by a less permeable cap rock (143) or simply a more impermeable shale.

Commercial quantities of hydrocarbons within more conventional permeable formations may have been lost over millions of years through migration (146, 147) and leakages (148) until only unconventional shale gas deposits remain in locations where hydrocarbon development has never been commercially viable before and/or in close proximity to, e.g., cities (140) and farmlands (141), where the value of the above ground environment and ground water formations (152) may be very high and require significant protection from leakages that may occur around improperly cemented well bores. Environmental damaged areas may be caused by drilling rig (51A) operations across many sites during well construction and, subsequently, for work-overs and abandonment. As the recovery rates for shale gas deposits are conventionally very low, e.g. 7%-12%, the construction cost of economic shale gas wells is limited, despite close proximity to demand, and more economic solutions are required before widespread development of the deposits can occur to provide cleaner burning gas that replaces cheaper coal operated electrical power plants.

The present invention may be used to reduce the number of drilling site locations (1N, 1M) with a plurality of wells (136) from a single main well bore formed by a LDHP conduit system (1) and/or chamber junctions (21) which may use a plurality of multi-lateral whipstocks (135 of FIGS. 38, 46 and 48 of FIGS. 87-90 and 120-132), which also minimizes penetrations through the ground water system (152) compared to conventional wells (137, 138) having a single deviated or horizontal (111) well bore. Single laterals (135) from a multi-well (136) LDHP conduit system (1M) may be used to replace a conventional well (137) practiced to provide pressure integrity for hydraulic fracturing (150). In addition to minimizing the foot print of surface equipment (1M), a LDHP conduit system (1) is usable to provide, e.g., subterranean tanks, separators and heat exchangers to process production or to dispose of waste fluids comprising, e.g., mineral contaminated deep subterranean produced water or waste fluids produced during construction and production, comprising, e.g., slick water fracturing fluids. Production or injection through concentric or autonomous conduits of a LDHP conduit system (1N) into non-commercial subterranean formations (144) may be used to dispose of fluids and/or maintain subterranean pressures so as to urge migration (147) of fluids to producible formations (142).

Additionally, wells of the present invention may be maintained and/or abandoned with small foot print rigs (51D), generally termed rig-less operations, to further minimise impact to, e.g., farm land (141). Pressure integrity provided by chamber junctions and multi-lateral whipstock embodiments of the present invention may provide the same pressure integrity as a conventional well design for use in hydraulically fracturing (150) operations (139). Conventional multi-lateral technology does not provide the necessary access, integrity and re-entry features, generally due to a lack of space or pressure bearing capacity. Hence, a LDHP conduit system (1) allows batch operation reductions in well cost and improves recovery rates of, e.g., shale gas, using simultaneous hydraulic fracturing (150) across a plurality of wells through a single main bore with a single rig-up and rig-down of equipment.

FIG. 39 illustrates an isometric view of a fracturable deposit strata slice, with a quarter section removed from the lower end of a LDHP conduit system (1) embodiment (10), passing through the deposit diagrammatically. The Figure illustrates hydraulic fracturing (150) of the strata in, e.g., shale gas or tight sandstone formations. FIG. 40 illustrates a piece of shale (142), its layering (152) and fracture orientation (77) to access a cross section of said layering, wherein fracture orientation depends upon the deposit in question and natural fracturing engagement or proximity to the artificial hydraulic fractures (77). Pressure integrity is critical to the initiation and propagation of artificial fractures (77) using hydraulic force (150) because any fluid pressure leakage prior to the intended artificial fracture reduces the force (150) and, hence, the length of the induced fracture, thus limiting its effectiveness to place proppants and to extract fluids from a low permeability deposit. Because the pressure integrity of conventional multi-lateral technologies are generally insufficient or too complex, they are generally not used, and casing (89) lining (590) are cemented (151) within well strata bores (66). The LDHP conduit system (10) is usable to provide a plurality of wells and/or lateral bores (66) from a single main bore, which can be cemented in place and can use conventional liner technology to enable and ensure pressure integrity for fracturing.

Generally, once a well bore is sealed, lower end perforations (108A) are made in casings and artificial fractures (77A) are hydraulically initiated and propagated (150) with, e.g., slick water and light sand proppants or more viscous gelled solutions that include larger sand proppants, depending upon the deposit characteristics, until the desired fracture length is achieved or screen-out occurs. Screen-out is when plugging of the proppants occurs, which is characterized by dramatic increase in pressure, and hydraulic fracturing is stopped. Packers, or screen-out caused by under displacement, may be used to isolate the lower artificial fracture (77A), and the process can be repeated by, e.g., perforating (108B) and then artificially fracturing (77B), followed by perforating (108C) and then artificially fracturing (77C), until a series of fractures is formed in a near horizontal (111), highly deviated or vertical well bore accessing a deposit. If multi-laterals (135 of FIG. 38) and/or multiple well bores are vertically aligned, simultaneous hydraulic artificial fracturing may occur between vertically stacked laterals or well bores so that the fractures use the lower fluid friction, large diameter and high pressure capabilities of the conduit system (10 and e.g. 1N, 1M of FIG. 38) to perform multiple vertically stacked fractures using, e.g. multiple lower end fractures (77A), followed by closer multiple fractures (77B), and so on and so forth, through a single main bore, thus reducing the hydraulic fracturing rig-ups (139 of FIG. 38) and rig-downs necessary.

Referring now to FIGS. 41, 42, 43 and 44, the Figures illustrate plan, elevation and two isometric views, respectively, of the application of a conventional well design to an unconventional shale gas deposit with well spacing. The Figures show a well (137) bore (66) through subterranean strata with a vertical offset from well centre of approximately 1000-2000 meters and a substantially horizontal section (111), of approximately 500-1500 meters, at a depth between approximately 1000 and 4000 meters. A horizontal section of approximately 735 meters comprises a series of artificial hydraulic fractures (77) of approximately 100-500 meters lateral width and 25-50 meters vertical height, which extends from a cemented and perforated lining of the strata bore (66). Nine wells (137), spaced approximately 915 meters in one direction and 1067 meters in the transverse direction, may cover a deposit of approximately 2285 meters by 2744 meters and 25-50 meters deep. Conventionally, if vertical access to a deposit with greater than 25-50 meters of artificial fractures is required, further adjacent wells (137) must be added to land a horizontal (111) well bore (66) above or below those shown, e.g., 18 wells may be required for doubling the vertical access of prior art FIG. 44.

Figure 45:
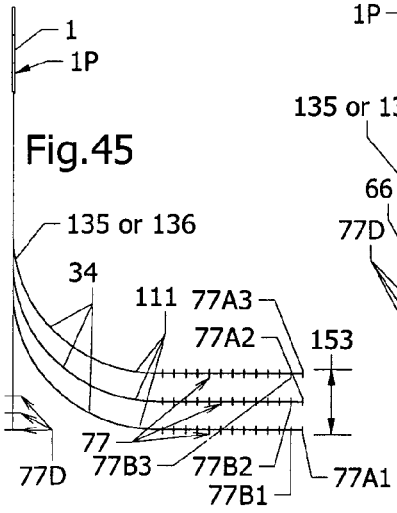
Figure 46:
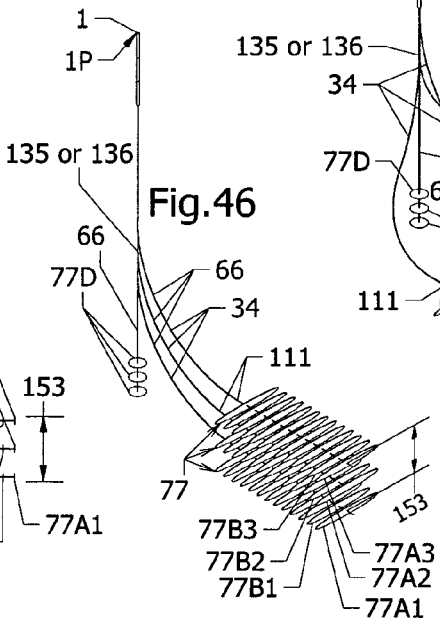

FIGS. 45 and 46 illustrate diagrammatic elevation and isometric views of a LDHP conduit system (1) embodiment (1P) usable to access a larger portion of a vertical (153) shale gas deposit to increase recovery through, e.g., simultaneous vertical (153) artificial hydraulic fracturing (77). Simultaneous fracturing (77A1, 77A2, 77A3) can occur through axially autonomous well bores (34) exiting the single main bore of the LDHP conduit system (1P), wherein dedicated pumps may be placed on each axially autonomous (34) conduit well bore to provide fracturing pressures and pressure integrity, after which another vertical (153) set (77B1, 77B2, 77B3) of simultaneous artificial fractures may be initiated and propagated to place proppants and stimulate production. Additionally, waste fluids from artificial fracturing (77) or natural fluid production may be injected back into the strata through another autonomous well bore or annulus to disposal fractures (77D) of a natural or artificial nature. Using lateral whipstock embodiments of the present invention, bores (66) of either a lateral (135) or multi-well (136) nature may be lined and cemented to provide equal pressure integrity to that of conventional single bore well designs (137), thus allowing for a plurality of wells or laterals from a single main bore and ground water formation penetration.

Figure 47:
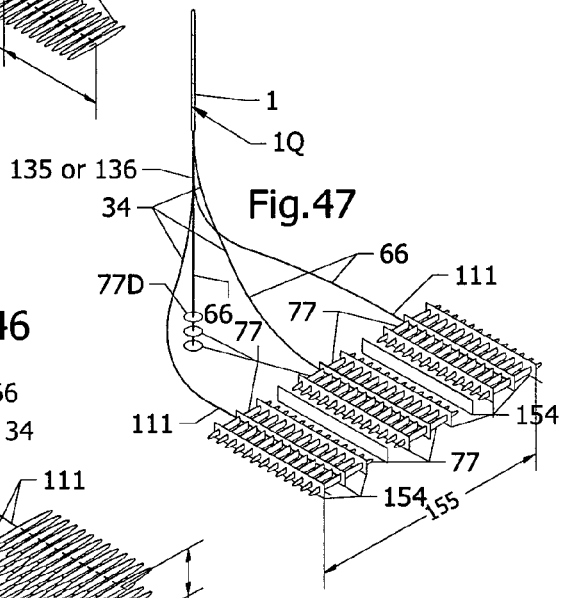
Figure 49:
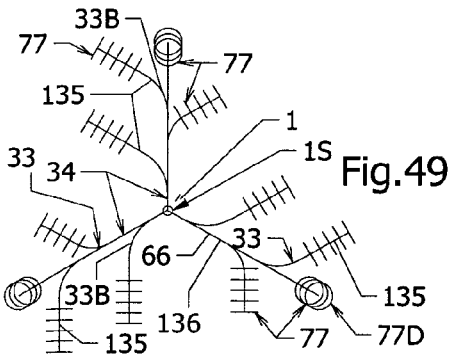
FIGS. 48 and 49 show various method embodiments of the present invention to other unconventional hydrocarbon deposits.
Figure 48:
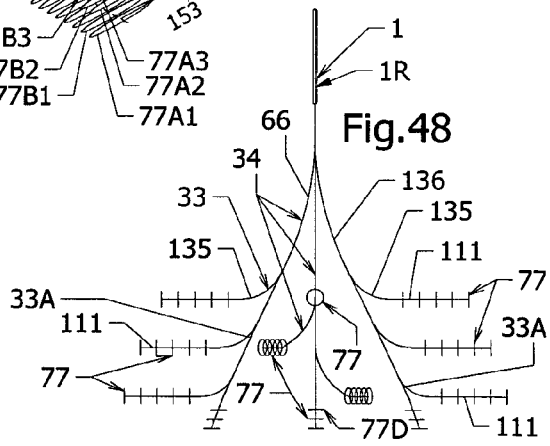

Referring now to FIGS. 47, 48 and 49, the Figures depict diagrammatic isometric, elevation and plan views of various well trajectory of LDHP conduit system (1) embodiments (1Q), (1R) and (1S), respectively, illustrating various lateral whipstock, autonomous conduit (34) and/or side-pocket whipstock (33, 33A, 33B) well bore (66) arrangements, which can be usable to develop shale gas deposits or other low permeability formations that require artificial hydraulic fracturing (77) and/or fractures (77D) for waste fluid disposal. Lateral and autonomous (34) well bores, from a single main bore conduit system (1Q, 1R, 1S), may extend vertically (153 of FIGS. 45-46) or laterally (155) to intersect strata formations and/or natural fractures (154) to form a fracture matrix through their intersection with artificial fractures (77), to better recover fluids from a subterranean deposit.

Figures 50, 51, 52, 53, 54:
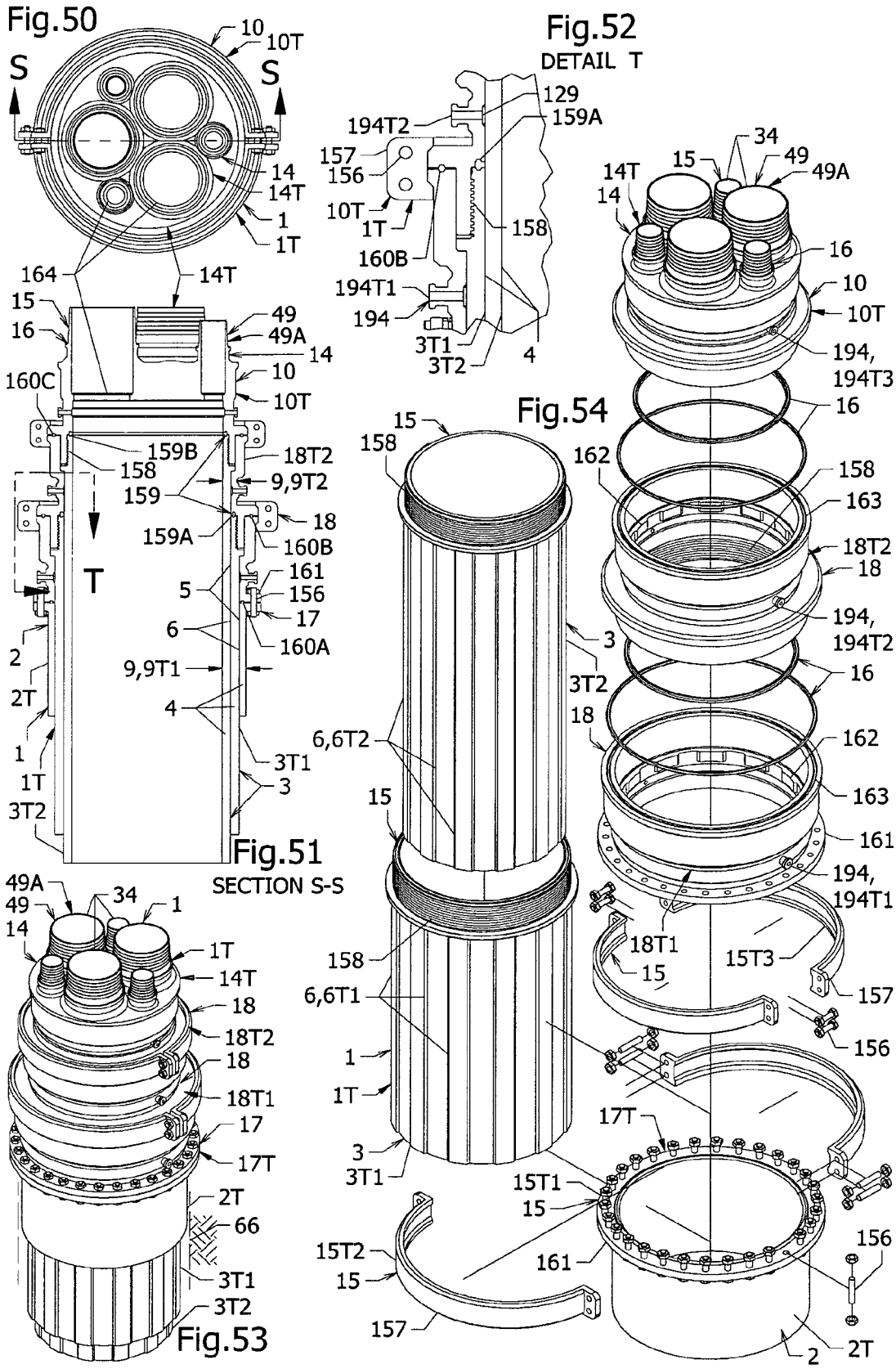
FIGS. 50 to 54 depict a high pressure wellhead embodiment of the present invention.

FIGS. 50, 51 and 52, illustrate a plan view with line S-S, an elevation cross section across line S-S with a detail line T, and a magnified detail view within line T, respectively, of a LDHP conduit system (1) embodiment (1T) and wellhead (10) embodiment (10T) with a snap-together connector (49) embodiment (49A) forming part of a conduit hanger spool (14) embodiment (14T). A second conduit (3) embodiment (3T2) is adjoined to another second conduit (3) embodiment (3T1) which is adjoined to a first conduit (2) embodiment (2T) with the abutment of loading surfaces (6) radially extending from a pipe body (4) against circumferential loading surfaces (5) of the adjacent pipe bodies (4) to form a larger effective wall thickness (9) sharing hoop stresses between conduits (2T, 3T1, 3T2). The effective wall thickness (9) across the conduits (9T1) or across a conduit head (9T2) subassembly (17, 18), or a hanger spool (14), is usable to control the pressure bearing capacity, wherein the effective thickness (9T2) may be increased by, e.g., increasing the minimum wall thickness of the conduit head spool (18T2).

The various conduit heads (17, 18) and spools (14) may be secured (15) and sealed (16) by any means suitable to secure components and contain pressures; which are shown as seal rings (159A, 159B, 160A, 160B, 160C) in receptacles (163), threads (158), bolted (156) flanges (161), bolted (156) clamps (157) and snap together mandrels (49, 49A) onto which, e.g., valves, valves trees and/or other apparatuses may be engaged using hoop stress engagement. Load shoulders (164) within the hanger spool (14T) may be used to hang, e.g., production and injection conduits, wherein any means of hanging conduits, such as conventional and prior art olive arrangements, may be used.

Placement of the LDHP conduit system (1T) may occur by forming a bore hole in strata (66 of FIG. 53) and placing the first conduit (2T) after which another strata bore may be formed below the lower end thereof for placement of a second conduit (3T1, 3T2) which may extend below the lower end of a previously placed conduit such that radially extending loading surfaces (6) extend to associated circumferential loading surfaces of the previously placed conduit, wherein loading surfaces may be a smooth, radially extending, helically radial extending (e.g. 6J of FIG. 18) or have other suitable shapes abutted together so as to form an annulus space between conduits fillable with, e.g., fluids, cement or swellable materials to share hoop stresses and increase the effective wall thickness (9).

A piston may be engaged to the lower end of the conduits (2, 3) with the lateral port (194) embodiment (194T) used to provide hydraulic pressure to the piston and pipe bodies (4) to affect the effective loading surface diameters using hydraulic expansion and compression of conduits during insertion, after which pressure may be released to abut and adjoin one conduit to another for sharing hoop stresses. The radial loading surfaces (6T1, 6T2 of FIGS. 53-54) may be passed between splines (162 of FIG. 54) in conduits heads (17, 18) which may seal (e.g. 133 of FIGS. 34-37) to provide a hydraulic actuation during placement, wherein the seals may or may not require removal when the casing head (18T1, 18T2) is threaded to the conduit (3T1, 3T2) to secure an inner seal (159A, 159B). The associated conduit is shown landed in the previous conduit head (17, 18) so as to engage an outer seal (160B, 160C), which may be secured with a bolted (156) clamp (157).

Alternatively, the weight of the conduit (3) string extending axially below the wellhead may be used to provide hoop force placement, abutment and adjoining of conduits. A drive head may also be secured to the conduit (3T1, 3T2) to forcibly hammer the conduit downward, thus forming hoop forces to place, abut and adjoin two conduits, after which the drive head may be removed and the casing head installed. Gravity cementing of the annulus through the lateral conduit (194, 194T1, 194T2, 194T3) may be undertaken or conventional cementing with return circulation through the annulus and lateral conduit passageway may occur.

FIGS. 53 and 54 are isometric and exploded views of the LDHP conduit system (1) embodiment (1T) of FIG. 50, illustrating a first conduit head (17) subassembly embodiment (17T) engaging a lower end first conduit (2T) to a second conduit head (18) embodiment (18T1) with an associated second conduit (3T1) engaged to another second conduit head (18) embodiment (18T2) about an associated additional second conduit (3T2), engaged therein. Conduits (2T, 3T1, 3T2) may be sequentially placed at ever increasing depths to form an effective wall thickness across any combination of conduits to, in use, meet the pressure bearing requirements of the conduit system at a required depth, after which one or more wells may be concentrically and/or axially autonomously (34) urged through the subterranean strata communicating with a single bore valve tree engaged to each wellhead connector (49A) or a valve tree with a plurality of bores engaged to all of the wellhead connectors (49A) to further control fluid communication.

As shown in the FIG. 50 plan view and the isometric views of FIGS. 53-54 showing the conduit hanger spool (14) embodiment (14T), a plurality of axially autonomously (34) or parallel wells may be bored through the large diameter high pressure single main bore formed by the conduit system (1T). One or more wells are placeable through the concentric bore of the conduit system (1T), e.g., a chamber junction and/or axially autonomous (34) well conduits passing through the illustrated conduit hanger (14T). A conduit hanger (14) may comprise any conduit hanger system supported by, e.g., first (17) and second (18) conduit head subassemblies, to access subterranean strata passageways. The space between the single main bore of the conduit system and the one or more well conduits therethrough may be used for fluid processing, e.g. the separation arrangement of FIG. 17A, or as a heat exchanger.

In remote subsea wells, such as those shown in FIGS. 4 and 6, which may be tied back to platforms (52 of FIG. 4) via a subsea pipeline, heat may be used for flow assurance of produced fluids, and high water cut hydrocarbon wells may require the thermal effect of produced water to provide flow assurance as production that progresses along a pipe line is cooled by, e.g., the ocean. In such instances, separation within the ocean environment could be detrimental due to the lost heat of removed water. In such cases, the natural subterranean insulation and heat retaining properties of the sub-mudline strata may be used with a LDHP conduit system (1) separator (11), wherein separated water may be released to the ocean provided it has low hydrocarbon concentrations and/or other toxic material, with heat transferred by a heat exchanger (12) within the LDHP conduit system (1) during separation providing flow assurance for pipeline transportation. Alternatively, a pump may be used for separated water disposal within the subterranean strata through a separate axially autonomous conduit passageway extending from the conduit system (1).

Any variation of conduit routing placeable within the main bore of the LDHP conduit system (1T) may communicate with the smaller diameter conduit orifices of a conduit hanger (14T) hung from load shoulders (164 of FIG. 50). Olive seal arrangements may extend to fluidly producible and/or injectable subterranean strata to form autonomous wells, separators and/or heat exchangers to carry out fluid processing, wherein any variation of suitable control, measurement and/or pumping apparatus engageable to the system may be used.

As demonstrated herein, a LDHP conduit system is analogous to a blank canvas or empty pressure bearing subterranean tank (13) within which any manner of well construction apparatus may be placed and within which any method may be used, wherein not only separators (11) and heat exchangers (13) are possible, but also inventions of the present inventor and various conventional flow control devices combinable with, e.g., wellhead devices, valve tree devices, casing shoe devices, straddle devices, plug devices, sliding side door devices, frac sleeves, dropped object activated devices, remotely controlled devices, gauges, control lines, cable, acoustic, fluid pulse controlled or data collection devices, pressure activated valve devices, gas lift valves, surface valves, insert valves, flow control devices, hangers, void access devices, control line pass-through devices, packers, seal stacks, motors, fluid pumps, subsurface valves, chokes, one-way valves, venturi devices such as velocity or jet pumps usable with various connectors, and/or sealing devices.

For example, manifold crossovers may be included with flow mixing devices, such as venturi or jet pumps, sliding side door or gas lift valves, which are further usable with chamber junction crossovers, chamber junction manifolds, well junctions and slurry passageway apparatus radial passageways to fluidly communicate between passageways. Additional apparatuses for engaging or communicating with a passageway through subterranean strata can be usable with various flow controlling devices to selectively control and/or separate simultaneously flowing fluid mixture streams of varying velocities within a LDHP conduit system (1).

Conventional applications involving apparatus such as sliding side doors, jet pumps, frac sleeves and gas lift valves are generally limited by the pressure bearing capacity of the containing conduit system and available downhole space. Such limitations prevent standardization of a member set of apparatus and methods usable perform simultaneous flow stream operations and develop readily available off-the-shelf applications coveted by well construction practitioners and operators.

Constructing a plurality of passageways to pressurized subterranean regions through a single main bore drives a practical need for placing a plurality of cable and subterranean valves within a large diameter high pressure containment system that are easily accessible without repeated large scale rig-up and rig-down, or mobilization and demobilization of rigs. The need for control lines and valves increases with subterranean separators and downhole placement of other processing equipment for measuring and monitoring, and wherein maintenance must include replacing valves and/or other flow control devices usable to control fluid communication and/or pressures within a well with a plurality of passageways.

As demonstrated in FIGS. 1 to 54, a large diameter high pressure conduit system (1) may be formed to house a plurality of axially concentric well bores and/or axially autonomous well bores through a wellhead (10) to form a high pressure containment space within which manifold string arrangements and manifold crossovers of the present inventor may be used with valves, flow control devices and/or other flow controlling and/or measurement devices and lines, which are usable in various configurations and arrangements with standardized apparatuses. One or more selectively controlled pressurized fluid mixture flow streams from one or more substantially hydrocarbon and/or substantially water wells through a single LDHP main bore may be constructed and operated as further demonstrated within the remaining Figures for any conduit size.

FIGS. 55, 56 and 57, show an elevation view with section lines U-U and V-V and break lines presenting removed portions shown along axis, a plan view along section line U-U with dashed lines showing hidden surfaces, and another plan view along line V-V, respectively, of a large diameter high pressure conduit system (1) embodiment (1U). An associated high pressure chamber junction (21) embodiment (21U) is illustrated with an exemplary LDHP conduit system (1), wherein a 183 cm (72") outside diameter first conduit (2) embodiment (2U) with the internal circumferential loading surface (5) abuts against load surface (6) embodiments (6U1) radially extending from a 168 cm (66") outside diameter second conduit (3) embodiment (3U1), with an internal diameter loading surface abutted against loading surface (6) embodiments (6U2) radially extending from a 152 cm (60") outside diameter of another second conduit (3) embodiment (3U2), with the internal diameter loading surface abutted against loading surface (6) embodiments (6U3) radially extending from a 137 cm (54") outside diameter of a second conduit (3) embodiment (3U3). The associated radial extending loading surfaces (6U1, 6U2, 6U3) abut to the inner diameter circumference loading surfaces to adjoin pipe bodies of the conduits (2U, 3U1, 3U2, 3U3) and form a greater effective wall thickness (9) embodiment (9U), greater than the sum of the 5.7 cm (2¼") pipe body (4) wall thickness, due to the sharing of hoop stress resistances between pipe bodies.

According to an API bulletin 5C3 calculation, the standard within the oil and gas industry, with 551.6 N/mm2 (80 ksi) material, a 183 cm (72") conduit with a 5.7 cm (2¼") wall thickness will bear 301.6 bar (4375-psi) burst and 105.3 bar (1526-psi) collapse, a 168 cm (66") conduit with a 5.7 cm (2¼") wall thickness will bear 329.1 bar (4772-psi) burst and 136.2 bar (1975-psi) collapse, a 152 cm (60") conduit with a 5.7 cm (2¼") wall thickness will bear 362 bar (5250-psi) burst and 173.8 bar (2520-psi) collapse, a 137 cm (54") conduit with a 5.7 cm (2¼") wall thickness will bear 402.2 bar (5833-psi) burst and 219.7 (3186-psi) collapse pressures for a conventional well design, wherein abutment for hoop stress sharing is absent. Hypothetically, since its weight per foot or meter could make controlled placement impossible, if the wall thickness could be combined (i.e. 5.7 cm×4=22.8 cm or 2.25"×4=9") to produce an equivalent ID conduit with a 171 cm (67.5") outside diameter and 22.8 cm (9") wall thickness, weighing 8,359 kg/m (5617 pounds per foot) and capable of bearing 1287 bar (18,666-psi) burst and 1274.8 bar (18488-psi) collapse pressures, said hypothetical conduit would have less pressure bearing capacity than an installable effective wall thickness (9U), wherein using a conservative calculation with a nominal wall thickness of 28.9 cm (183 cm OD-126 cm ID/2) or 11.25" (72" OD-49.5" ID/2) at an 86% efficiency or 24.6 cm (9.675") for a 183 cm (72") OD conduit, the conduit system (1) is capable of bearing 129.7 bar (18,812-psi) burst and 1283.2 bar (18,611-psi) collapse pressures, according to the API Bulletin 5C3 calculation.

Accordingly, embodiments of the present invention are capable of greatly exceeding a 137 cm (54") conventional single main bore well design, wherein it is the general practice to design two internally unsupported concentric conduits with fluid annuli. For example, the production annulus of a 137 cm (54") conduit with 5.7 cm (2.25") wall thickness 551.6 N/mm2 (80-ksi) material could adequately bear 402.2 bar (5833-psi) burst and 219.7 bar (3186-psi) collapse pressures; whereas, even at unrealistically low efficiencies, an effective wall thickness (9) formed through sharing of hoop stresses and abutment of loading surfaces during sequential adjoining of conduits will always be greater than a fluid filled annulus where abutment is absent. The nature of the loading surfaces (6) and annular spaces (7) may be adjusted with, e.g., malleable metals, supported with swellable elastomers or cement, to design the desired wall thickness, efficiency, size and number of adjoining conduits needed to meet the pressure bearing capacities without losing the conventional need for a fluid filled annulus that may be monitored, as shown in FIGS. 34 to 37. Additionally, the final internal diameter desired for axially concentric and/or axially autonomous conduits and/or subterranean processing and flow control or mixing apparatuses may be achieved and various methods to optimise fluid communication of producible and/or injectable fluids between a wellhead and the subterranean strata may be used.

As shown in FIGS. 55 to 57, 51 cm (20") and 41 cm (16") well casing (89) embodiments (59U1, 59U3) may extend downward from the 61 cm (24") exit bore of a chamber junction formed within the single main bore adjoined conduits (2U, 3U1, 3U2, 3U3). A 17.8 cm (7") casing embodiment (59U2) is also placeable through the bore of a 24.4 cm (9.625") casing extending from the chamber junction. A 41 cm (16") conduit (59U3) with integrated side-pocket whipstock (48U), similar to (e.g. 48E, 48F and 48G of FIGS. 126-132), with adjacent 17.8 cm (7") pass through and 8.9 cm (3½") fluid communication conduits forming part of the 41 cm (16") casing is placeable within the 51 cm (20") casing to, e.g., form the well configurations shown in FIGS. 38 and 45-49.

Referring now to FIGS. 58 and 59, the Figures show an elevation view with section line W-W and a plan along line W-W, respectively, with break lines along axially downward conduits indicating removed sections of a large diameter high pressure conduit system (1) embodiment (1V). Loading surfaces may be placed on a high pressure chamber junction (21) embodiment (21V) with a snap-together connector (49) embodiment (49B). The exemplary LDHP conduit system (1) sizing illustrates a 152.4 cm (60") outside diameter second conduit (3) embodiment (3V3) abutted against another 137 cm (54") outside diameter second conduit (3) embodiment (3V2) abutted against another 123 cm (48") outside diameter second conduit (3) embodiment (3V1), wherein each have 5.7 cm (2¼") wall thicknesses with radially extending load surfaces (6V1, 6V2, 6V3) within inside diameter load surfaces (5) forming adjoined pipe bodies (4) with greater effective wall thickness (9V).

The arrangement provides 47.6 cm (18.75") ID axially autonomous (34) conduits usable for axially concentric (35) conduit placement of, e.g., conventional well conduit sizing of 34 cm (13.375") outside diameter (OD) casing with a 31.4 cm (12.347") inside diameter (ID), 24.4 cm (9.625") OD casing with a 21.7 cm (8.535") ID, and 17.8 cm (7") OD casing with 15.25 cm (6.004") ID. Such casings may be conventionally hung with liner hangers (106 of FIG. 17A) within the 47.6 cm (18.75") (59V2, 59V4) ID extending from and placed with the 122 cm (48") pipe body OD chamber junction (21V) using, e.g., 50.8 cm (20") OD casings (89), together with supporting 24.4 cm (9.625") OD casings (89, 59V1, 59V3), wherein the casings may be cemented using circulation through the independent well bores, or a large bore may be drilled for the arrangement embodiment (49B) of hydraulically actuated snap together hoop stress connectors (49), which may be used to simultaneously run axially autonomous (34) conduits which may be cemented with the bore as a unit.

Sealable hydraulic ports (166) forming part of the connectors (49) and arrangement (49B) may be used to simultaneously operate snap together connections for simultaneous connection of the embodiment (49B). Such arrangements are not practiced nor would they be obvious to practitioners in an industry reliant on lower cost screw couple connectors, who rarely use snap together connections.

Embodiments of the present invention may snap together a plurality of connectors simultaneously as part of axially and circumferentially autonomous (34) conduits usable to form a plurality of wells in the embodiment (1V), whereby a subterranean processing system may also use seal stacks and polished bore receptacles within such snap together arrangements.

FIGS. 57 and 59 also show optional central single bore accesses (165) of 47.6 cm (18.75") and 54 cm (21.25") diameters to suit various sizes of risers and blowout preventers (BoPs, 90 of FIG. 14) usable with a chamber junction and bore selector, as depicted in FIGS. 60-61, 76-81 and 93-105. A hanger spool (14) with a corresponding orifice may be used, or, alternatively, a hanger spool (14) with a plurality of access orifices, e.g. (14T of FIGS. 50-54) may be laterally skidded between the bores. Manifold and chamber junction crossovers described in FIGS. 62 to 75 may also be used to transition from axially concentric (35) to axially autonomous (34) conduits for fluid and apparatus communication using central bore access (165) to the axially downward disposed bores (e.g. 59U1, 59U2, 59U3, 59V1, 59V2, 59V3, 59V4).

Figure 60:
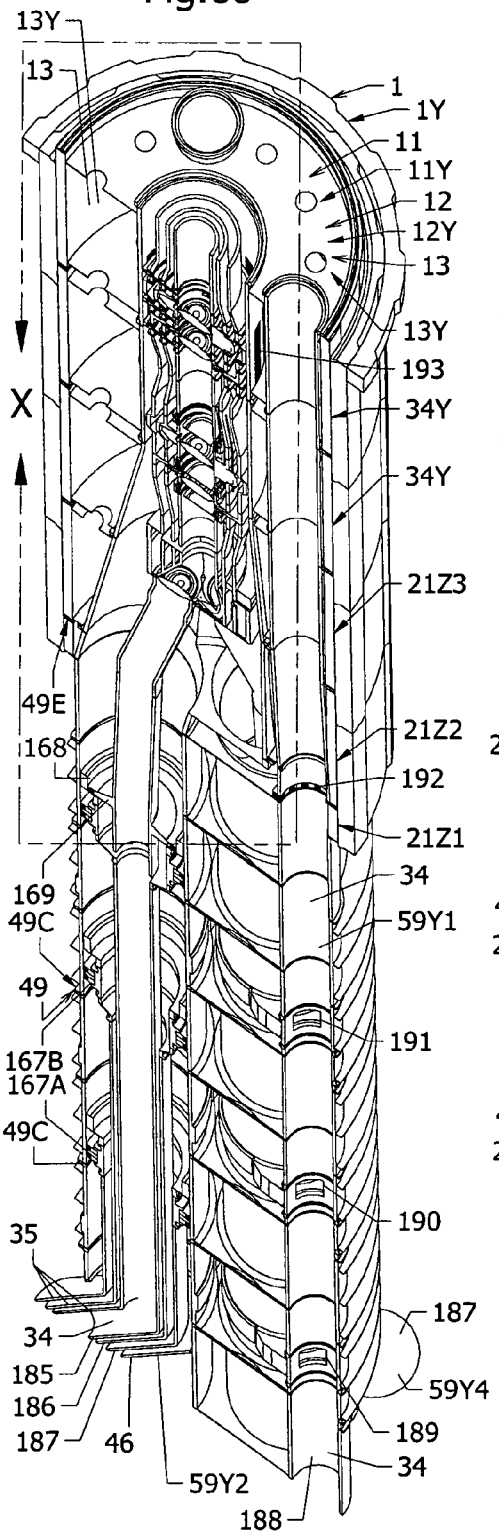
FIGS. 60 and 61 show a top down perspective view of a high pressure, large bore, well conduit system, with a vertical subterranean separator illustrating the assembled components of FIGS. 66 to 92 and assembled elevation views of FIGS. 93 to 105.
Figure 61:
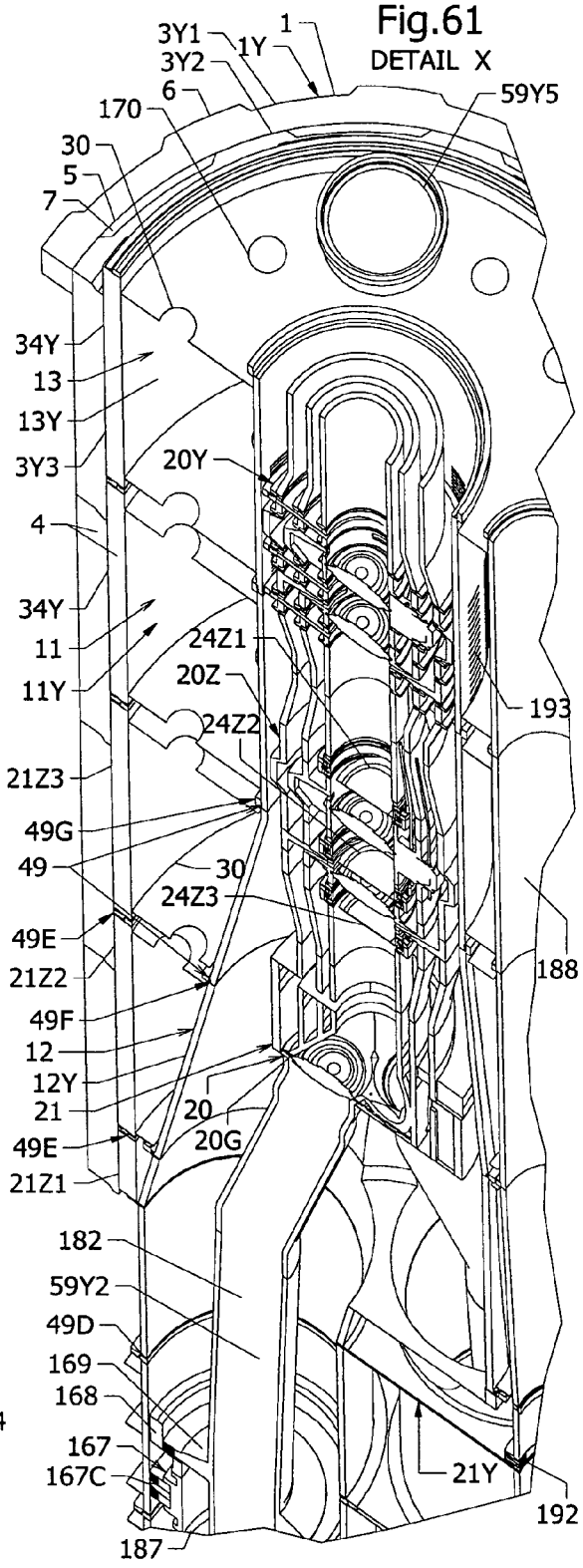
Figures 93, 94, 95, 96, 97:
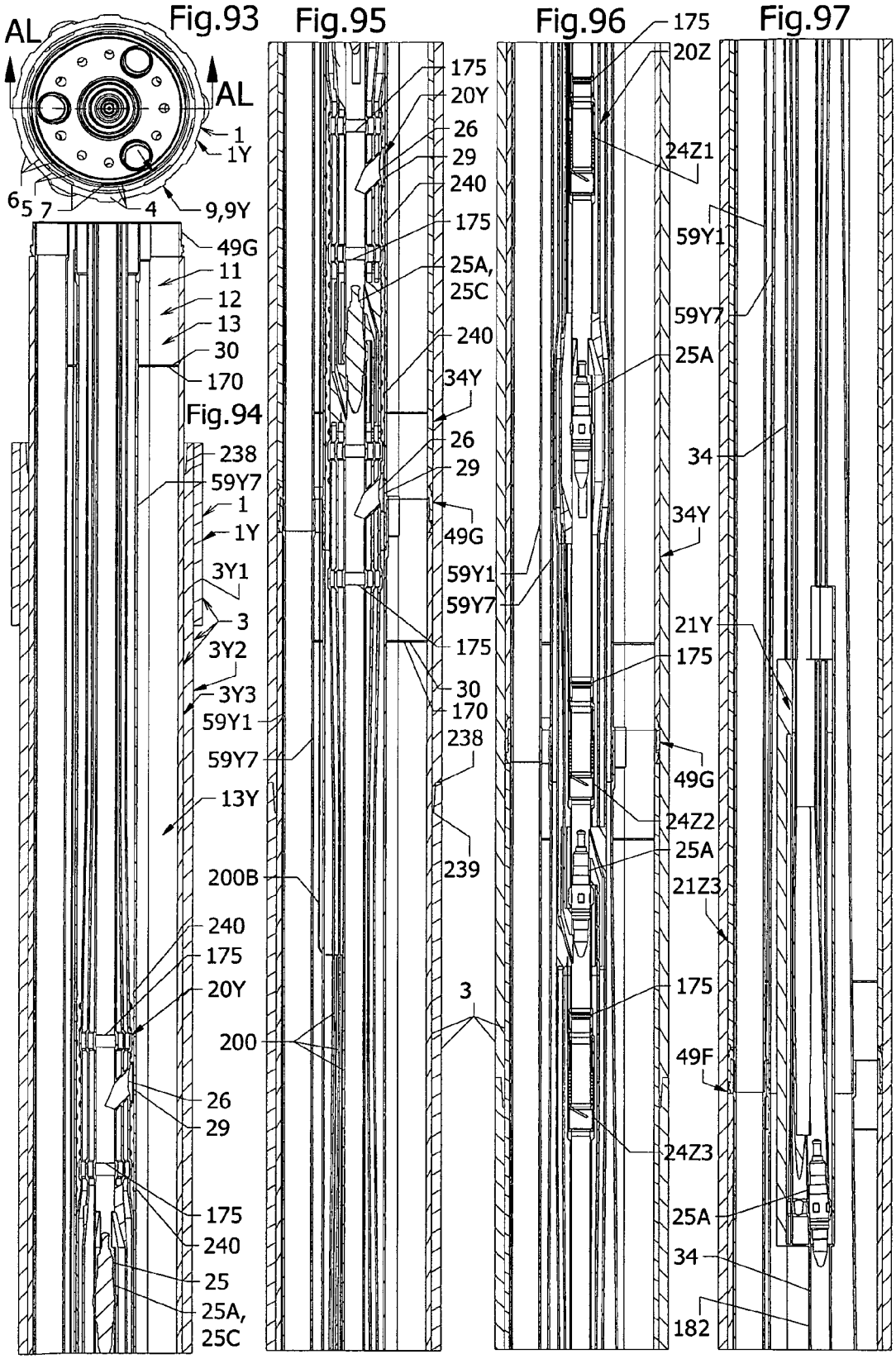
Figure 98:
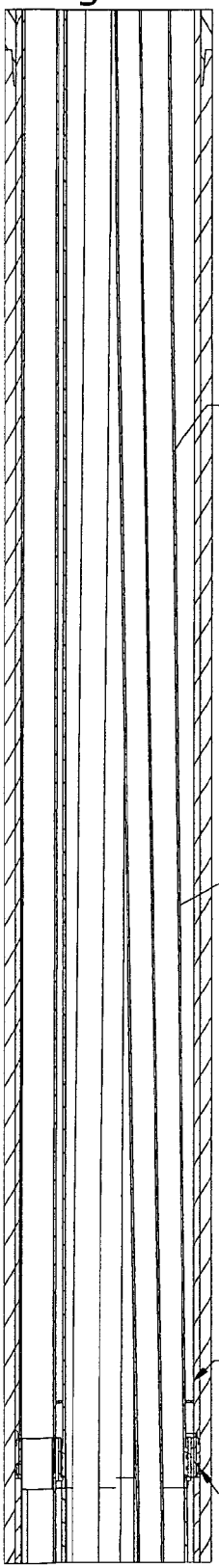
Figure 99:
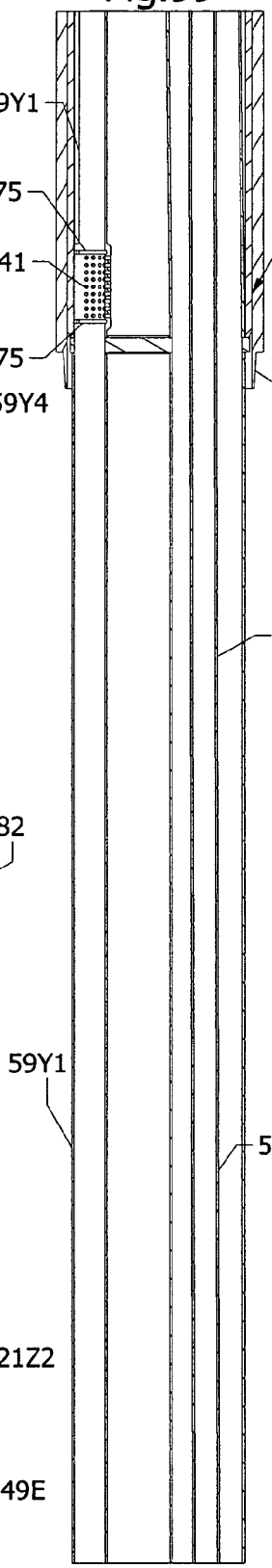

FIGS. 60 and 61 illustrate an orthographic tilted isometric view of the vertical section through line AL-AL view of FIG. 94 with detail line X and a magnified view within detail line X, respectively, wherein the vertical scale is skewed from the lateral scale to provide a single view of the long LDHP conduit system (1) embodiment (1Y) illustrated across FIGS. 94-105. The LDHP conduit system (1Y) may form a subterranean tank (13) embodiment (13Y) with internal components comprising a subterranean separator (11) embodiment (11Y) and heat exchanger (12) embodiment (12Y) formed with a manifold crossover (20) embodiment (20Y), chamber junction (21) embodiment (21Y) and loading surface high pressure chamber junction (21) embodiments (21Z1, 21Z2 and 21Z3) using snap-together connector (49) embodiment (49C, 49D, 49E, 49F, 49G) arrangements, which are associated with FIGS. 93 to 105 and component parts shown in FIGS. 66 to 92. Fluids from a plurality of wells may be processed within the single main bore, wherein access and process conduits may form a plurality of barriers to the environment and simultaneously flow various fluid streams.

The embodiments of FIGS. 60-105 may be used with the embodiments of FIGS. 1-4, 34-39 and 45-49, or the arrangement may be adapted for wellhead access through circumferentially (34) autonomous conduits placed substantially parallel through the inside diameter of a LDHP conduit system (1Y), similar to the embodiments of FIGS. 14-17, 17A and 17B, 50-54.

In FIGS. 60 and 61, various large diameter high pressure conduits (3, 3Y1) may be adjoined with LDHP conduit assemblies (3Y2) placed with a lower end chamber junction (21Z1, 21Z2 and 21Z3 of FIGS. 76-81) engaged together with snap connector embodiments (49E, 49F, 49G) to axially and circumferential autonomous conduit (34) bundles (34Y of FIGS. 82-83) connected with snap together embodiments (49G) to provide a centralized conduit access system for urging subterranean bores axially downward using drill strings, casing strings (187, 186, 185, 182) and various other apparatuses comprising, e.g., liner hangers (167, 167A, 167B, 167C) or concentric (35) polished bore receptacles (PBR, 168). The plurality of wells may be completed with, e.g., seal stacks (169) inserted into PBR's (168) connected to manifold crossovers (20Z, 20Y) or, alternatively, using production tubing hung from a spool (14T of FIGS. 50-54) when parallel autonomous bores (34) are used rather than central access manifold crossovers (20).

A series of axially and circumferentially autonomous conduit (34) bundles (34X) may be engaged with hoop stress connections comprising, e.g., snap together connections (49C), which may be engaged (49D) to a LDHP chamber junction (21Z1 and 3Y2) as shown in FIGS. 87-90.

Well casings (182, 185, 186, 187) may be conventionally hung within the conduit bundles (34X) with liner hangers (167, 167A, 167B, 167C) and still provide annulus access through orifices (189, 190, 191), which may be closed with straddle packers (e.g. 15E of FIG. 119E) provided by the passageway access of conduit (188), or the orifices may be left open to fluidly communicate with annuli under the liner hangers to circulate during cementing operations and/or monitor annuli pressures. Alternatively, casings may be hung concentrically one inside the other, e.g. (186) hung in casing (187), casing (185) hung in casing (186) and casing (182) hung in (185) from a conduit hanger spool (14) of the wellhead, whereby the concentric conduits (182, 185, 186, 187) may also have axially extending loading surfaces (6) abutting one to another to share hoop stresses and form a larger effective wall thickness, wherein one or more axially autonomous (34) concentric conduit groups (182, 185, 186, 187) may be used.

Various alternate configurations are possible and it must be stressed that axially and circumferentially autonomous (34) well bores of concentric (35) conduits may simply be disposed in an axially parallel configuration passing through a single main bore of the LDHP conduit system (1). For example, (34I1) and (34I2) of FIG. 17A and well bore (59Y1) conduit (188) of FIG. 60 may simply pass through a single main bore, dependent upon the well application and associated need. Where daily costs of onshore rig (51A of FIG. 1) may be less than that of offshore rigs (51C), the additional costs of moving a BOP (90 of FIG. 14) between axially autonomous (34) well orifices in a conduit hanger spool (e.g. 14T of FIGS. 50-54) may be more cost effective than the arrangement described in FIGS. 60-105, whereby single bore access operations through a subsea tree (53) with an offshore rig (51C) may be preferable.

Figures 113, 114, 115, 116, 117, 118, 119, 119A, 119B, 119C, 119D:
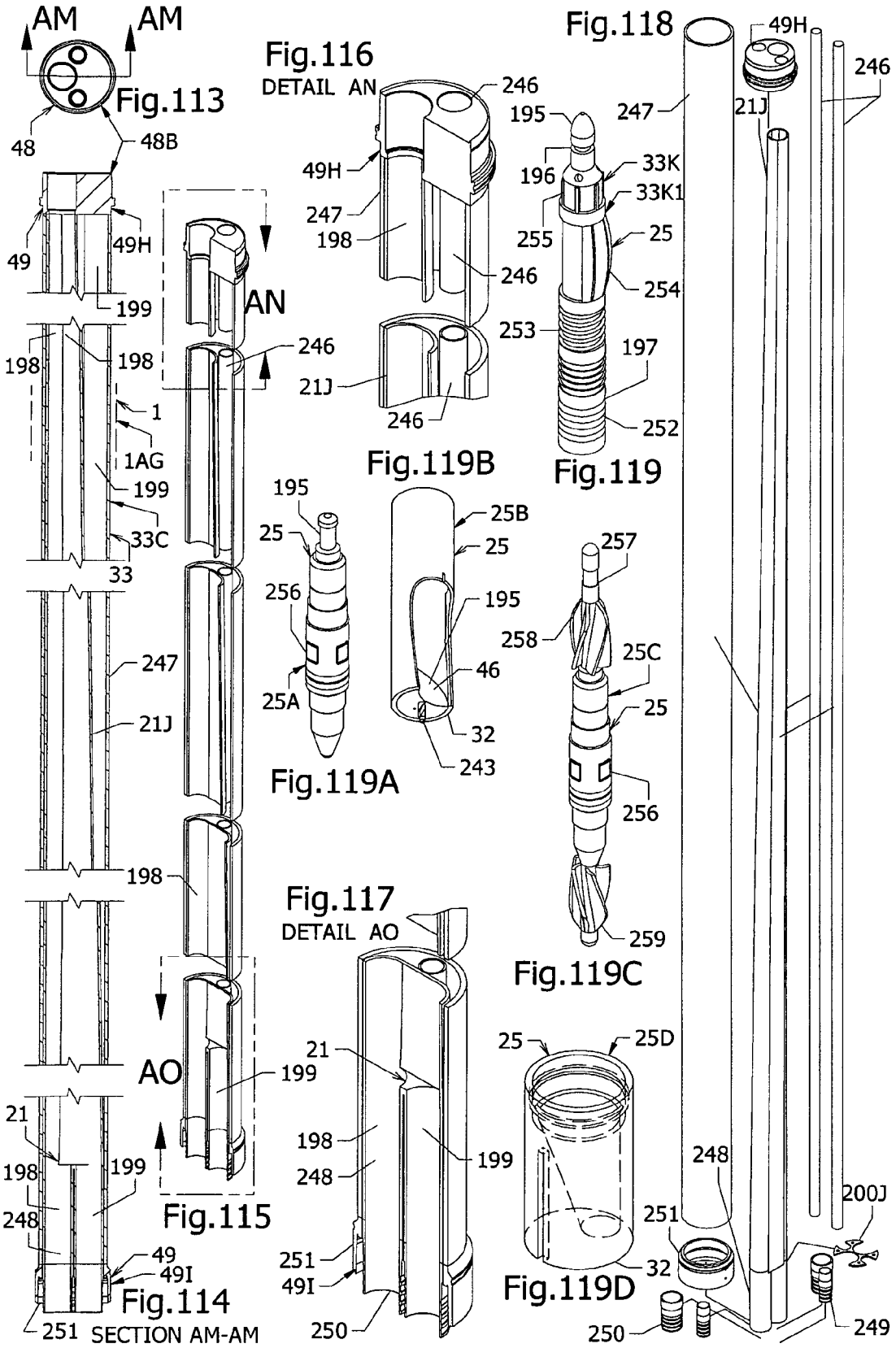
FIGS. 113 to 132 show well bore side pocket, side-tracking and kick-over tool embodiments, which can be usable with large bore, high pressure, well conduit systems of the present invention.

For the central well bore access system of FIGS. 60-105, a three valve (24I1, 24I2, 24I3) manifold crossover (20Z) arrangement may be engaged with a manifold crossover (20Y) and chamber junction crossover (21Y) usable for controlling individual separator inlets for each of the well bores (59Y2, 59Y4, 59Y6) using diverting devices (25) like plugs (e.g. 25A of FIG. 119A). Valve trees with a plurality of bores or a plurality of valve trees stacked vertically or arranged as horizontal trees may be used.

Sliding side doors, valve side pocket mandrels and/or any other method or apparatus may be applied to each well to exchange fluids between any particular well bore and the tank (13Y) through which a bore may pass. Any manner of control or data acquisition may be placed about or within conduits or the tank to allow manual or computer monitoring and control. Axially autonomous (34) wells passing through the single main bore may act as heat exchanger tubes to exchange or take heat from the fluids in the tank (13Y). Various annulus access mechanisms may be used to access the tank, wherein the tank's plurality of walls (2, 3) act as primary and secondary high pressure barriers. Well entry into the tank (13Y) may be provided with various methods, such as packers (167), polished bore receptacles (168) and seal stacks (169).

The tank (13Y) may also have baffles (170) or spreaders (30) used for aiding the separation of fluid densities, wherein the baffles or spreaders may also engage axially autonomous conduits (34), usable as heat exchanger (11Y) tubes, to secure such conduits and prevent vibration, better facilitate bundled installation of conduits and/or guide installation or removal of conduits used during well construction and maintenance. Fluid access to the tank (13Y) may be accomplished with any number of ported assemblies (192), sealable with e.g. straddles or valves, through an axial autonomous conduit (e.g. 188), or through a chamber junction with a bore selector or kick-over tool. Various accesses to the tank (13Y), for the purposes of mixing, separation, heat exchange or other fluid processing tasks during drilling, completion and/or production may be accomplished through ports (193) in a central access (e.g. adjacent to 20Y).

A central access system of chamber junctions and/or manifold crossovers and manifold strings, can be usable during drilling or completion and production, wherein a central access may be used for drilling, but removed prior to completion and production, or vice versa. Additionally, there may be combinations of vertical access and lateral access comprising, e.g., a side pocket drilling whipstock with a kick-over arrangement for boring one or more laterals from the main bore.

FIGS. 62, 63 and 64 show a plan view with section line Y-Y and dashed lines showing hidden surfaces, an elevation section view along line Y-Y and a projection of the elevation section Y-Y view, respectively, of a large diameter high pressure conduit system (1) embodiment (1AA) with an adapted three flow stream manifold crossover (20) separator inlet (26) with a diverter plate (29) embodiment (20W), illustrating how the flow (171, 173, 174) through conduits (59W1, 59W2, 59W3) may be diverted with a diverting device, e.g. (25A) of FIG. 119A, placed in a nipple (172) to divert internal flow (171) to the tank (13), while crossing over annulus flow (173) and allowing other annulus flow to pass through (174) the manifold crossover (20W), wherein a sleeve nipple (175) may be used to cover a crossover port and stop flow (173) from an annulus from crossing over. If control valves or other apparatus are located below the crossover (20W), they may be connected to a lower (176) passageway and an upper (177) passageway for communicating, e.g., hydraulic control line fluid, wherein three separate upper passageway (177) orifices are shown having associated lower passageway (176) orifices capable of independent the fluid flows.

Referring now to FIG. 65, a diagrammatic elevation view of a large diameter high pressure conduit system (1) embodiment (1AB) with a three flow stream adapted manifold crossover (20) separator inlet (26) and diverter plate (29) embodiment (20AA), is shown depicting similar flow streams to the arrangement (20Y) shown in FIGS. 66 to 68, wherein the outermost annular flow stream (174) may be diverted to the tank (13), heat exchanger (12) or separator (11) through an inlet (26) to engage a diverter (29), used to disperse fluid and resist, e.g. erosion, while inner flow streams (171 and 173) can crossover over at various points, using diverting devices (e.g. 25E of FIG. 119E) to a fluid processing tank (13) or separator (12) inlets (26), using diverting walls within the passageways of concentric (35) conduits (179, 180, 181).

FIGS. 66, 67 and 68, a plan view with section line Z-Z, an elevation cross section view along line Z-Z with break lines indicating removed sections and a projected view of the elevation section view along Z-Z, respectively, of a manifold crossover (20) embodiment (20Y) depicting separator inlet (26) and diverter plate (29) for diverting fluids through concentric (35) conduits (179, 180, 181) with flow control devices (e.g. 25A of FIG. 119A) which transition between smaller and larger diameters, as shown in the upper and lower break lines, wherein a larger diameter (178) is used about straddle nipples (175) and diverting devices (25) to control flow velocities and minimize erosion. An arrangement (e.g. 1AB of FIG. 65) of plugs and straddles may be placed to selectively control the flow of fluids through the manifold crossover into the tank, separator or heat exchanger, wherein installation or removal of various flow diverting devices may selectively cause crossover. Access and placement of devices may occur through the inner most bore using, e.g., cable deployment apparatuses. The flow control crossover (20Y) is further illustrated within the LDHP conduit system (1Y) across FIGS. 94 and 95.

Referring now to FIGS. 69, 70, 71 and 72, an isometric view, plan view with section line AA-AA, an elevation cross section view along line AA-AA with break lines showing removed portions and a projection of the elevation cross section along line AA-AA, respectively, of a simultaneous flow manifold crossover (20) chamber junction (21) embodiment (21Y) of the present inventor, are shown. The Figures illustrate how axially autonomous (34) conduits (182, 183, 184) may be transitioned to axially concentric conduits (179, 180, 181) by enlarging and sectioning (203) the annuli of the concentric conduits about the chamber of a chamber junction (21), wherein a lower passageway (204) may connect a conduit and a sectioned-off annulus which is extended to an axially upward annulus entry passageway (201, 202) for each of the respective axially autonomous and axially concentric conduits to direct flow from a unique conduit to a unique annulus. Access to the lower end conduits (182, 183, 184) can be maintained through the chamber junction (21Y) and the use of a bore selector, wherein the chamber junction fluid crossover manifold can be actuated by placing plugs (e.g. 25A of FIG. 119A) in each of the conduits (182, 183, 184) at the chamber junction bottom level to divert (25) fluid from the conduits to their associated annuli, without mixing of the fluids in any of the axially autonomous conduits, as shown in FIG. 97, when the plugs are in place.

Figures 69, 70, 71, 72, 73, 74, 75:
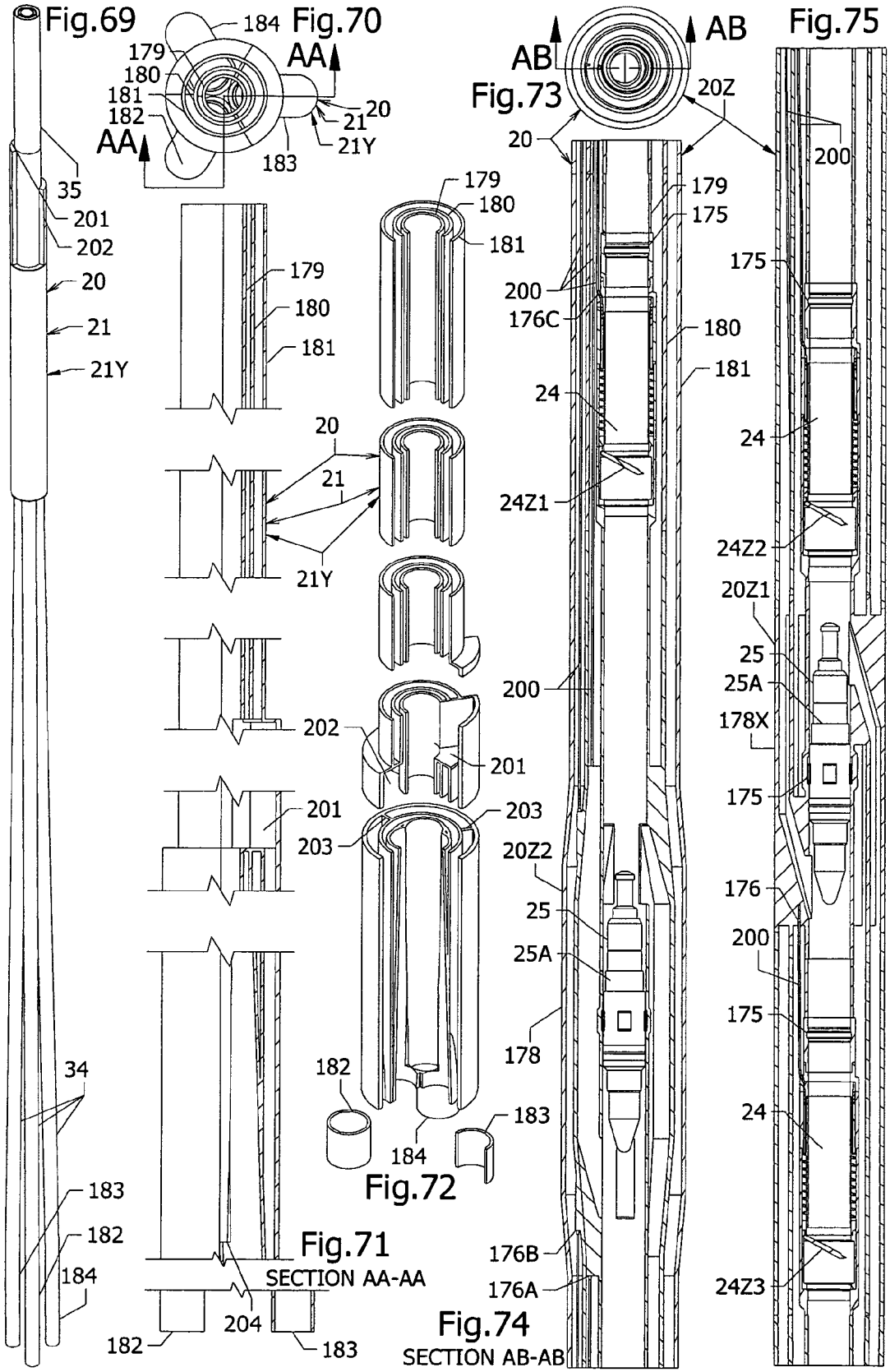

FIGS. 73, 74 and 75 show a plan view with section line AB-AB, the upper end of the elevation cross section view along line AB-AB and the lower end of elevation cross section view along line AB-AB, respectively, wherein the upper end of FIG. 75 is a continuation of the lower end of FIG. 74, showing a simultaneous flow manifold crossover (20) embodiment (20Z) of the present inventor, wherein three subsurface safety valves (24) may be arranged such that the flow within each of the passageways can be controlled by one of the safety valves with flow crossing over at each flow diverting apparatus (25, e.g. 25A o FIG. 119A), which may be removed to allows access through the central passageway to axially autonomous passageways (e.g. 182, 183, 184 of FIGS. 69-72) of a chamber junction crossover (e.g. 21Y of FIGS. 69-72). Passageways within and between the conduits (179, 180, 181) may be enlarged (178) to account for fluid velocities and potential erosion where necessary, or a constant diameter may be maintained (178X) if velocity and erosion is not problematic. The arrangement may be configured in a manner similar to that shown in FIG. 65, wherein subsurface safety valves (24) are placed to control outlets (26). Each of the flow streams may be controlled with individual safety valves (24Z1, 24Z2, 24Z3) and associated control lines (200), which are also shown in FIG. 96, wherein the control lines may also bundled (200B) into a multi-line umbilical, as shown in FIG. 95.

The lower safety valve (24Z3) is controlled by a hydraulic control line (200) fed through a three way manifold crossover (20Z1), which is similar to the crossover (20W) of FIGS. 62-62 without an outlet (26) and diverter (29). Control line passageways feed through (176) axially upward until they are adjacent to the hydraulic control line (200) of the intermediate valve (24Z2), which also extends upward until they enter two way manifold crossover (20Z2). Control line feeds through (176A, 176B) and continues axially upward to become parallel with the third safety valve (24Z1). Control line (200) from the upper control line connection (176C), after which all three control lines progress with the conduits to pass through the wellhead, allows remote control of each of the safety valves from surface. Hydraulic control lines (200), fibre optic cables, electrical cables, sensor lines and/or any other small conduit, computer operated cable, wire or similar apparatus may be passed through the various subterranean components to provide the necessary information and control for subterranean processing.

Cabling and/or controls may also be tied back through a conduit with a wet connector. Wet connectors similar to those of remote operated vehicles (ROVs) and underwater cameras are usable within pressurized environments, well bore conduits or a tank of the present invention, wherein wet-mateable connections may be made in a fluid environment. For example, wet connections may be placed within an axially autonomous conduit (e.g. 188 of FIG. 60-61) during or after well construction, wherein a connector and trailing wire may be pumped down the conduit to and plug into an associated wet connector. An apparatus with a trailing umbilical cable may be pumped down within various conduit of a LDHP conduit system to operate, e.g., cameras, cutting devices, or gauges which removes the need to pass hydraulic control cables through various apparatus (176, 176A, 176B) while allowing maintenance within subterranean pressure and temperature conditions.

Figures 76, 77, 78, 79, 80, 81, 82, 83:
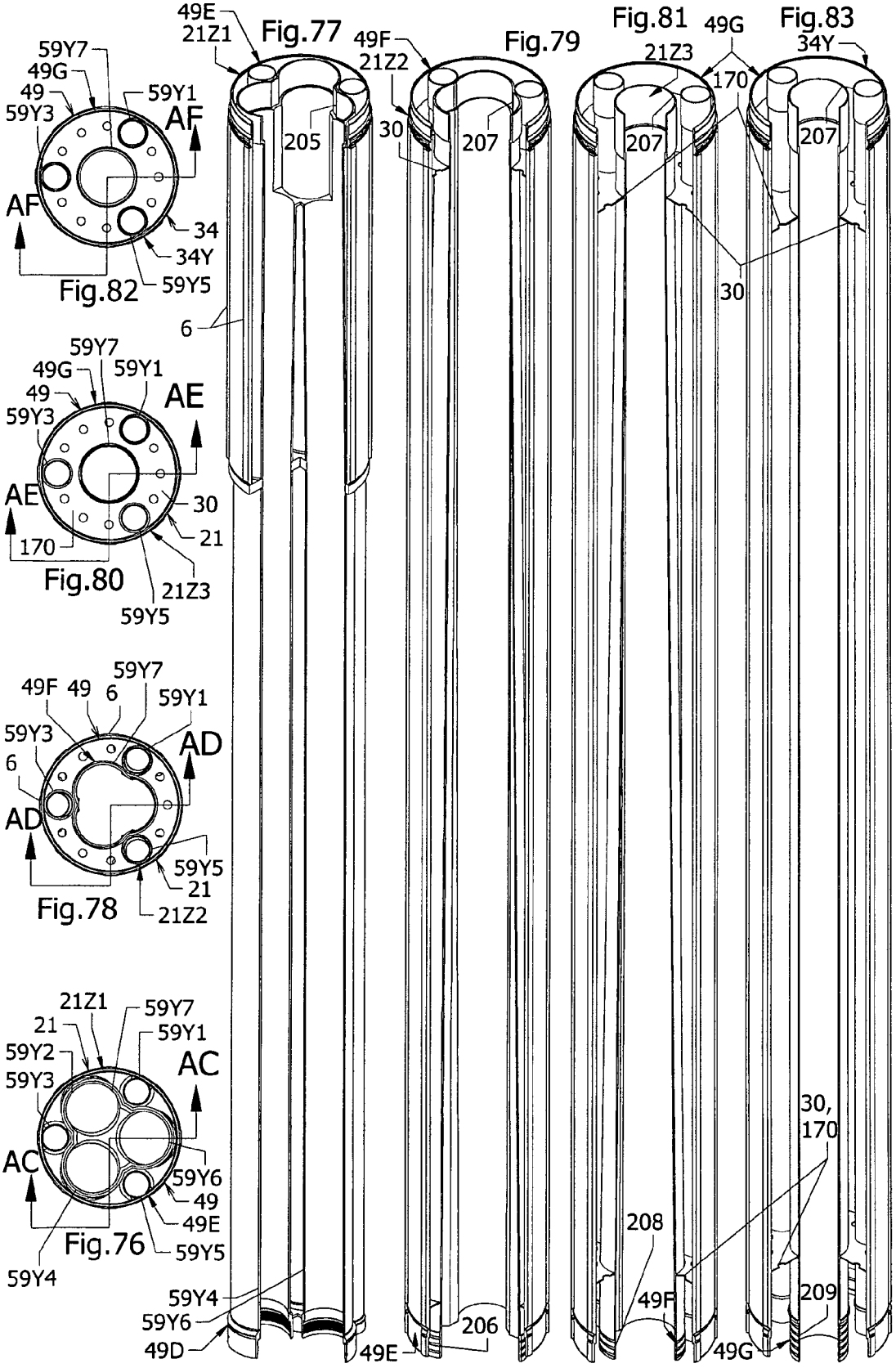
Figure 84:
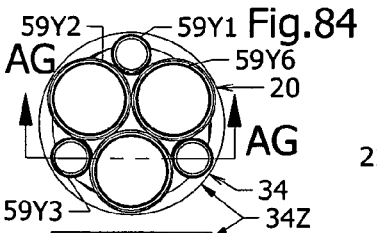
Figure 85:
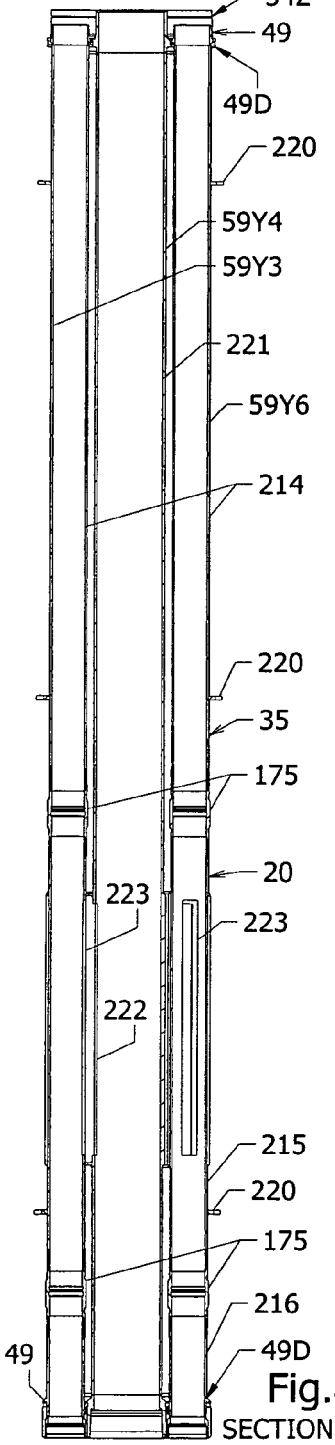
Figure 86:
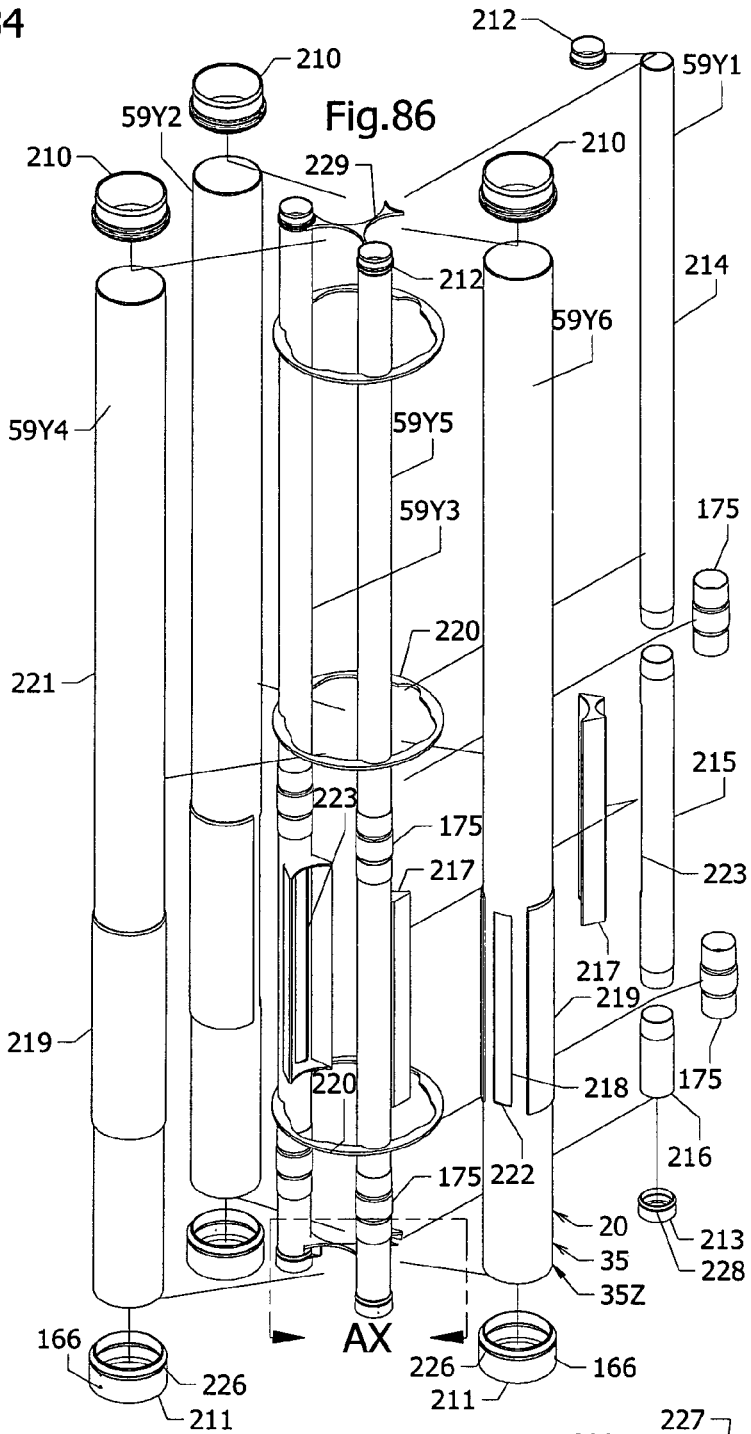
Figure 86A:
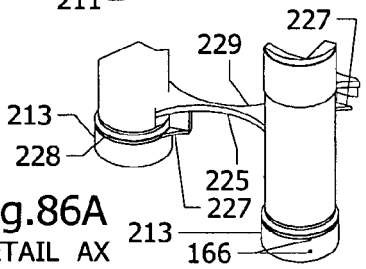

Referring now to FIGS. 76 and 77, a plan view with line AC-AC and an isometric cross section along line AC-AC of FIG. 76, show a LDHP conduit system chamber junction (21) embodiment (21Z1) with upper end snap-together connector (49) and PBR (205) embodiment (49E) engageable with the lower end of FIG. 78, showing how a single central chamber (59Y7) and three autonomous well bore conduits (59Y1, 59Y3, 59Y5) may be transitioned to a lower end snap-together connector (49) embodiment (49D) of six autonomous conduit well bores (59Y1-59Y6), which may be simultaneously coupled via hoop stress connectors.

FIGS. 78 and 79 show a plan view with line AD-AD and an isometric cross section along line AD-AD of FIG. 78, depicting a LDHP conduit system chamber junction upper end (21) embodiment (21Z2) with an upper end snap-together connector (49) and PBR (207) embodiment (49F), showing a lower end mating seal stack mandrel (206) and snap connector (49) embodiment (49E) usable for simultaneously connecting conduits to the upper end of FIG. 77.

Referring now to FIGS. 80 and 81, the Figures show a plan view with line AE-AE and an isometric cross section along line AE-AE of FIG. 80 illustrating a LDHP conduit system chamber junction upper end (21) embodiment (21Z3), with an upper end snap-together connector (49) and PBR (207) embodiment (49G), engageable to the lower end of FIG. 83, and a lower end mating seal stack mandrel (208) and snap connector (49) embodiment (49F) engagable to the upper end of FIG. 79.

FIGS. 82 and 83 show a plan view with line AF-AF and an isometric cross section along line AF-AF of FIG. 82, which depicts an embodiment (34Y) of a LDHP conduit system, with axially autonomous conduits (34) with upper end snap-together connectors (49) and PBR (207) embodiment (49G) engageable with the lower end of other axially autonomous conduit embodiments (34Y), wherein a lower end mating seal stack mandrel (209) and snap connector (49) may simultaneously connect the multiple conduit embodiment (49G) to the upper end of FIG. 81.

Referring now to FIGS. 84, 85, 86 and 86A, a plan view with line AG-AG, a cross section elevation view along line AG-AG, an exploded view with detail line AX and a magnified detail view within line AX, respectively, of a LDHP conduit system are shown. The LDHP system includes axially autonomous conduits (34) and manifold crossover (20) arrangement embodiment (34Z) with snap-together connector (49) embodiment (49D). The Figures illustrate large diameter conduits (221) between an upper end pin connector (210) and lower end box connector (211) forming well bore conduits (59Y2, 59Y4, 59Y6), and smaller diameter conduits (214, 216) on opposite ends of profiled nipple conduits (175). The depicted arrangement is usable for engaging diverting devices, e.g. valves, straddles and plugs, at opposite ends of a ported (223) conduit (215) engagable with a lateral passageway (218) conduit (217) which is further engagable to a passageway (222) in the larger diameter conduits (221), wherein the smaller diameter conduits forming well bore conduits (59Y1, 59Y3, 59Y5) have smaller diameter pin (212) connectors at the upper end thereof and box (213) connectors at the lower ends. Additional conduit wall thickness (219) may be placed around orifices (223) to match the pressure bearing capacity of the smaller diameter conduits at the crossover point.

For snap together connections (49), a simultaneous connection bracket embodiment (229) may be used for combining a larger diameter engaging mandrel (225) that engages the receptacles of a larger diameter box connector (211) and pin connector (210) receptacles (226), which includes a small diameter engaging mandrel (227) for engaging a smaller diameter box connector (213) and pin connector (212) receptacles (228), wherein the bracket (229) is usable to ensure that the inaccessible side of the snap together boxes (211, 213) are simultaneously coordinated with a clamping machine for simultaneously snapping together the connections. Snap together boxes (211, 213) can be expanded with hydraulic pressure onto associated pins (210, 212), which can be compressed with the same hydraulic pressure applied through ports (166) during the process of simultaneously supplying hydraulic pressure to and snapping the six well bore conduits (59Y1-59Y6) together with a claiming machine that engages and snaps the boxes and pins together. Hydraulic pressure is then released and the profiles and hoop stresses of the connectors (210-213) secure the associated conduits together. Any arrangement of hydraulic hoses and/or clamping mechanisms may be used to operate the plurality of snap together connections (49, 49D) of the present invention.

The arrangement (34Z) may also comprise a large diameter second conduit (3) with loading surfaces (6) for abutting and adjoining the assembly to a first conduit (2) or another second conduit, wherein the supporting brackets (220) may be engaged to the second conduit (3), and wherein the number of brackets may be increased to further form a supporting matrix structure within the second conduit to further increase the burst and/or collapse bearing efficiency of the effective wall thickness by adding the support of the brackets therein.

Figures 87, 88, 89, 90, 91, 92:
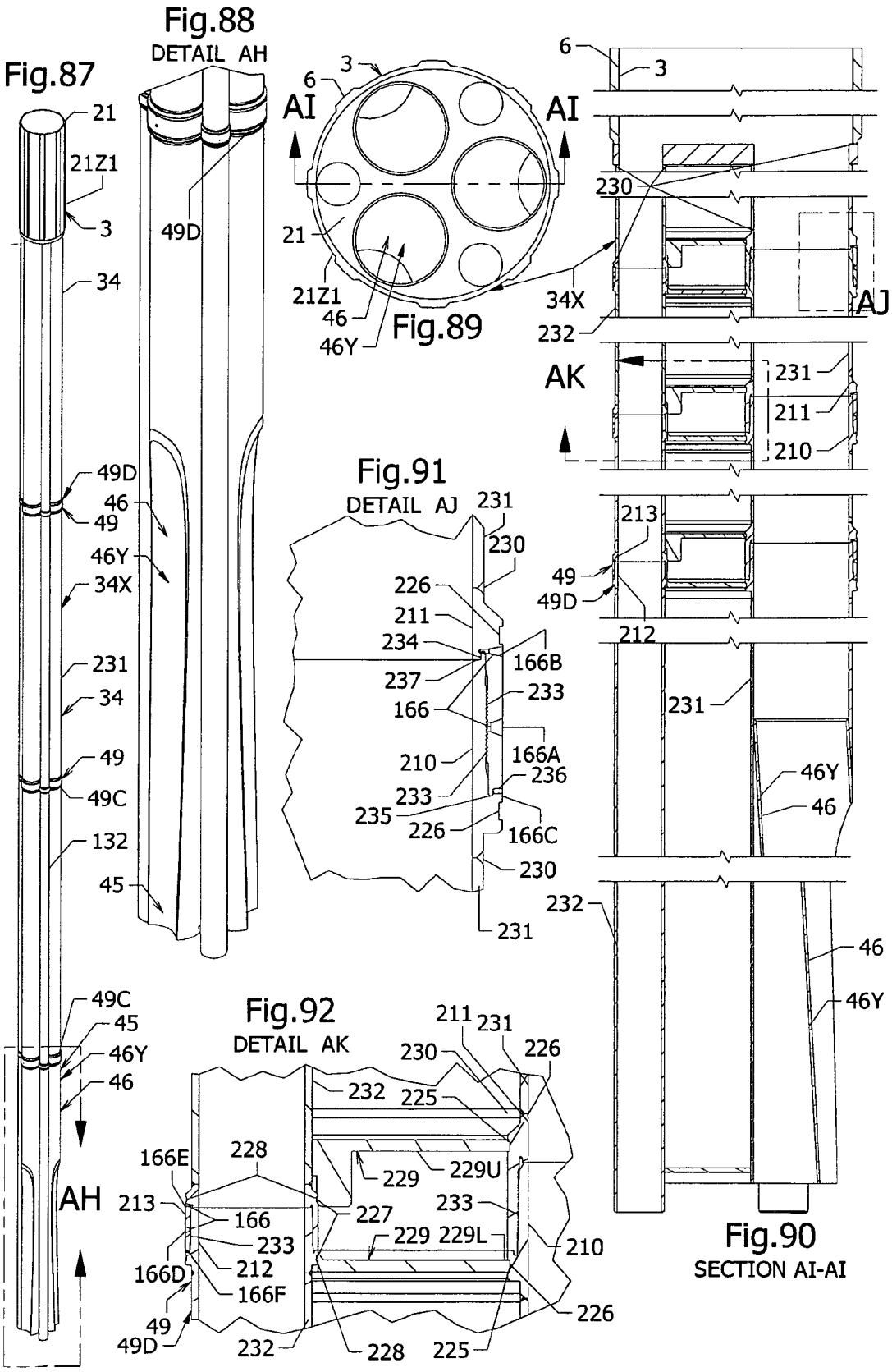

FIGS. 87 and 88 depict an isometric view with detail line AH and magnified detail view within line AH of FIG. 87, of an embodiment (34X) of an LDHP conduit system having axially autonomous conduits (34), with an axial lower end (45) and lateral whip-stock (46) orifice exit embodiment (46Y), using a snap-together connector (49) embodiment (49D). Larger diameter well conduits (231) and smaller diameter well conduit (232) are shown between the chamber junction and whipstock.

Referring now to FIGS. 89, 90, 91 and 92, the Figures show a plan view with line AI-AI, an elevation cross section view along line AI-AI with break lines representing removed portions and detail lines AJ and AK, a magnified detail view within line AJ and a magnified detail view within line AK, respectively, of a LDHP conduit system, having a lateral axially autonomous conduit (34) embodiment (34X) and a whipstock (46) embodiment (46Y) with a snap-together connector (49) embodiment (49D) associated with FIGS. 87 and 88, showing the box (210) and pin (211) larger diameter snap together hoop stress connectors adjacent to box (212) and pin (213) smaller diameter pin connectors with associated brackets (229) for simultaneous connection.

An upper (229U) bracket (229) with large diameter engagements (225, 226) and small diameter engagements (227, 228) associated with a smaller diameter lower (229L) bracket (229) may be used to secure the upper box connectors (210, 212) so that they may be snapped into the lower pin connectors (211, 213) using a clamping machine engaged to the outwardly exposed receptacles (226, 228) of the boxes (210, 212) and pins (211, 213). The clamp can snap the connection after applying hydraulic pressure to expand the boxes and compress the pins via hydraulic ports (226) between the pins and boxes via connected hydraulic hoses and hydraulic power pack. Pressure injected into the centre port (166A, 166D) is forced between the connector pins and boxes to exit ports (166B, 166C, 166E, 166F) adjacent to metal to metal upper (234) and lower (235) nose seals axially supported by associated upper (237) and lower (236) adjacent load shoulders. Once the connection is snapped together, the hydraulic pressure is released from the ports (166), and they may then be plugged to stop intrusion of undesired fluids and/or leakage of the hydraulic oil used for expansion, which can serve as an anti-corrosive fluid. The box and pin portions of the hoop stress connector can snap together to engage teeth (233), which when combined with hoop stresses, can prevent separation of the connection.

Where abutment of the first (2) and second (3) conduits uses the friction of an axial length of a loading surface abutment hoop stress sharing to resist movement during installation, an olive and dual olive arrangement uses the containing hoop stresses against a shorter axial frictional length of two smooth surfaces, and hoop stress connectors use engagement of teeth across a unique pattern, to ensure that the connectors are fully engaged. Prior art snap together connections described herein can be assembled quickly, but any suitable connection comprising, e.g., field welding, dog or mandrel and profile engagements, clamped flanged and/or flanged and bolted connections, or rotary screwed connectors spun within a clamped frame may be used provided that a plurality of axially autonomous connections can be made.

Like the LDHP conduit system (1), snap together connections using hoop stresses may have burst, collapse and axial loading capabilities greater than the conduits to which they are fixed; hence, it is important to ensure a good connection between the connectors and pipe body with suitable welding (230). Additionally, the effective wall thickness of prior art snap connectors may be downsized when included within first (2) and second (3) conduits of a LDHP conduit system (1) to better facilitate installation, since the connector does not need to bear hoop stresses independently and may gain strength from surrounding conduits, hence snap connectors may be used more for their axial bearing capacity, sealing and installation than burst and collapse rating.

When snap connectors are used on first (2) and/or second (3) conduit embodiments, they may also have loading surfaces matching the loading surfaces of the conduits on which they are welded (230) to ensure axial continuity of the loading surface abutments and effective wall thicknesses. If threaded connections are used for first (2) or at least second (3) conduits, any of the various means of placing loading surfaces over the connectors may be used over a connector upset or flush connection. The loading surface across such connections may be profiled or flush using clamping, pinning, bolting or field welding.

As demonstrated in FIGS. 76 to 92, the claimed simultaneous connection of a plurality of axially and circumferentially autonomous (34) well bores (59Y1, 59Y3, 59Y5) and axially autonomous (34) well bores (59Y2, 59Y4, 59Y6) may share circumferences during chamber junction transitions (21Z1), such that the conduits (182, 185, 186, 187), conduit hangers (167A, 167B, 167C) and PBR (168) of FIGS. 60 and 61, and manifold crossovers (20Y, 21Y, 20Z) of FIGS. 66-75 may be placed and engaged with a plurality of simultaneously coupled snap-together hoop stress connectors, interlocking brackets (229), clamps, hydraulic ports (166) and PBRs (205, 207) with associated mandrel seal stacks (206, 208, 209), wherein such an arrangement could not be obvious to practitioners accustomed to single concentric bore well designs.

Figure 104:
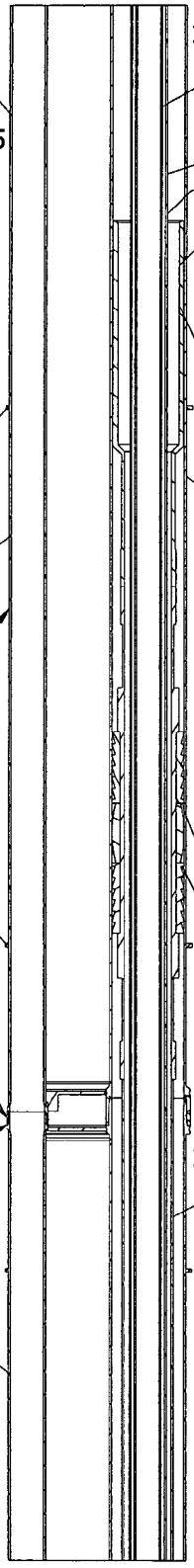
Figure 105:
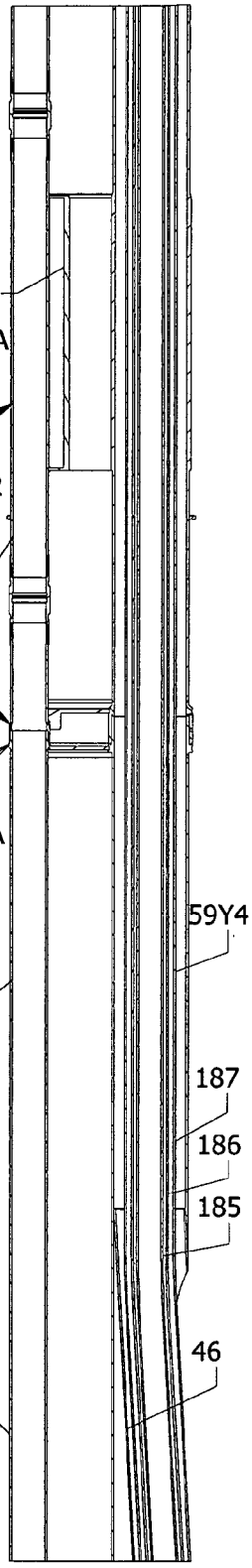

FIG. 93 is a plan view with line AL-AL, and FIGS. 94 to 105 are elevation cross sections along line AL-AL, wherein the upper end of FIG. 95 is a continuation of the lower end of FIG. 94, and the upper end of FIG. 96 is a continuation of the lower end of FIG. 95, and so on, to the upper end of FIG. 105 which is a continuation of the lower end of FIG. 104. FIGS. 93 and 94 to 105 illustrate the LDHP conduit system (1) embodiment (1Y) with a subterranean tank (13) embodiment (13Y) with an internal subterranean vertical separator (11) embodiment (11Y), heat exchanger (12) embodiment (12Y), manifold crossover (20) embodiment (20Y, 20Z), manifold crossover chamber junction (21) embodiment (21Z) and loading surface high pressure chamber junction (21) embodiment (21Z1, 21Z2, 21Z3) arrangement of the snap-together connector assembled (49) embodiment (49D, 49E, 49F, 49G) component parts of FIGS. 66 to 92, which can be associated with the orthographic tilted isometric views of FIGS. 60 and 61. FIGS. 93 to 105 illustrate adjoined second conduit (3) embodiments (3Y1, 3Y2, 3Y3) with loading surfaces (6) abutted to circumferential loading surfaces (5) having intermediate annuli (7) to form a greater effective wall thickness (9) embodiment (9Y) hoop stress sharing arrangement, usable as a subterranean separator (11), heat exchanger (12) and/or tank (13).

Subterranean bores are formed and the first and second (3, 3Y1, 3Y2, 3Y3) conduits are placed to form a LDHP chamber junction (21, 21Z1, 21Z2, 21Z3) using autonomous conduit bundles (34Y) that may be accessed via a bore selector (e.g. 25D of FIG. 119D) for placement of further conduits (187, 186, 185), wherein the lower end of each successive conduit may be placed deeper. A screwed box (238) and pin (239) rotary connector may be used for ease of connecting first and second (3, 3Y2) conduits or snap connectors or other suitable connections may be used if first and second conduits which may installed individually or together as described in FIGS. 12 and 12A. A cementing shoe may be added to the lower pin (239) end of second conduit (3Y2).

Below the whipstock (46) assembly (46Y) subterranean strata passageway bores may be formed and conduit (187) may be placed and secured therein to form well bore conduit (231) of a conduit bundle (34X) with a liner hanger (167) assembly (167A), wherein cementing may use lateral passageway (217) manifold crossover between a smaller conduit (232) of well bore (59Y1) and larger conduit (231) of well bore (59Y4), which may form part of conduit bundle (34Z) or may use the lower end of conduit (232) whipstock assembly (46Y) for conventionally cementing around the liner hanger (167). The process may then be repeated for conduits (185, 186) and liner hangers (167B, 167C), whereby each may be hung within the conduits of the autonomous conduit assemblies (34X, 34Y, 34Z) to form well bores (59Y2, 59Y4, 59Y6). When a cross over passageway (217) is not being used, it may be covered with a straddle (e.g. similar to. 25E of FIG. 119E) engaged in a nipple (175).

Well bores (59Y1, 59Y3, 59Y5) may be used to support fluid operations on well bores (59Y2, 59Y4, 59Y6) which may be transitioned to a central bore (59Y7), or alternatively may have autonomous well bores (59Y1, 59Y3, 59Y3), accesses usable with liner hangers (167), PBRs (168) and/or other downhole boring and casing or lining equipment. For example, drilling fluids, injection of fluids for waste disposal or water flood or production of fluids from the subterranean strata during or after well construction may be processed within the tank (13) or separator (12) accessible with, e.g., cables, tools, cameras or other apparatuses usable within a subterranean environment for well construction, production, intervention, safety, integrity, maintenance and/or abandonment.

After boring and casing or lining the well bores (59Y1-59Y6), the wells may be completed by placing fluid communication conduits for injection and/or production (182) with a lower end tail pipe and mandrel (169), engagable to a PBR (168, 168C), wherein the upper end of the conduit (182) may be connected to a hanger in a conduit hanger spool of a wellhead when a central access well bore (59Y7) is not used, or engaged to the lower end of a second chamber junction manifold crossover (21Y) to transition from axially autonomous conduits (34) to concentric conduits (35) and a central access well bore (59Y7), wherein plugs (25A) may be placed in an axial autonomous chamber junction exit conduits to divert fluid flow into elongate segregated annulus passageways feeding into concentric passageways.

A valve manifold crossover (20Z) may then be placed in the well bore (59Y7) and engaged to the chamber junction crossover (21Y) to control the concentric passageways with subterranean safety valves (24, 24A, 24B, 24C), wherein any of the flow streams may be stopped without affecting the remaining flow streams. Plugs (25A) can be used to crossover flow within the manifold (20Z), which may be removed to access plugs (25A) in the chamber junction crossover (21Y), which may be removed to access the autonomous well bore's (59Y2, 59Y4, 59Y6) lower ends. Control lines (200) for each of the valves may be passed through apparatuses using control line passageways (167) and annuli and/or a plurality of control lines may be bundled into an umbilical (200B), which can be used to extend the surface for monitoring and control of the safety valves and/or other subterranean equipment needing a control lines umbilical. Control lines and umbilical bundles of cables and conduits may also terminate in subterranean wet connections that are engaged by placing a cable connection, e.g. by pumping against a piston on its lower end, from surface to the wet connector.

A separator inlet manifold crossover (20Y) may be placed axially above and engaged to the safety valve control manifold crossover (20Z) in the central access well bore (59Y7), wherein flow diverting apparatuses (e.g. 25A of FIG. 119C or 25C of FIG. 119C) may be used to divert flow to a separator inlet (26) and diverter (29) usable for erosional protection of the ported (240) central well bore (59Y7) access to the tank (13), fluid separator (11) and/or heat exchanger (12) annulus. During well construction, the ports (240) may be covered with, e.g., a wear bushing, or left open if access to the tank is desired to store, e.g., drilling fluids.

The lower end of the tank (13) may be fluidly accessed with, e.g., a ported subassembly (241) having nipple profiles (175) engagable with a straddle (e.g. 25E of FIG. 119E) that may be removed for access and placed for closure of the fluid communicating ports. The lower end of the tank (13), separator (11) or heat exchanger (12) may be cleaned, e.g., by circulating across two ported assemblies (241) or by taking suction on the ported assembly (241) to remove heavier water and any solids which have settled to the bottom of the tank via gravity. Ported assemblies (241) may be added along the axis of well bores for various reasons, including, e.g., as an hydrocarbon outlet (98 of FIG. 16), wherein valves may be inserted during installation with a drilling rig (51A of FIG. 1, 51C of FIG. 4), or subsequently using a cable or wireline rig (51D of FIG. 3) to act as vertical fluid separator (11) level control valves (100, 101), wherein wet connections and/or permanently installed cables are usable with computer controlled processing (108 of FIG. 17).

As demonstrated by the exemplary central access well configuration in FIGS. 60-105, a plurality of wells may be placed from a central access within a single main bore, however it should be understood that this example is one of various ways to construct a subterranean well, and the application of a LDHP conduit system (1) using manifold crossovers and chamber junctions may be practiced other than as specifically described herein. A plurality of wells, manifold junctions and chamber junctions are not a required feature of the present invention, as described in FIG. 5. Substantially parallel circumferentially and axially autonomous well bores may be passed through the single main bore of a LDHP conduit system (1) to engage separate flow control devices, such as BOPs and valves trees, or separate bore apparatuses such as plurality of bore valve trees so as to fluidly communicate producible and injectable fluids to and from the subterranean strata. For example, a lower end chamber junction is not necessarily required for forming a plurality of wells through the single main bore of a LDHP conduit system (1), since the lower end may be cemented closed or left open to use the fracture gradient of the surrounding strata for pressure relief of the annulus about the plurality of wells.

Referring now to FIGS. 106 and 107, the Figures depict upper and lower isometric views, respectively, of an axially concentric (35) and axially autonomous (34) transitional conduit (47) embodiment (47A) of a LDHP conduit system (1) embodiment (1AC), which is shown as a dashed line, to illustrate that a smooth transition may be used to reduce the erosional friction simultaneous fluid flow stream velocities, wherein the transition (47) may not necessarily be a manifold crossover (20) or chamber junction (21) embodiment (21AB), since the crossover of flow may not be desirable or controllable and access to all lower end axially autonomous conduits may not be possible or desired. Additionally, while the lower end conduits are axially autonomous, it may not be necessary to make them circumferentially autonomous and hence may share an outer circumference.

FIG. 108 depicts a plan view with dashed lines showing hidden surfaces of a LDHP conduit system (1) embodiment (1AD). The Figure illustrates a concentric (35) and axially autonomous (34) transitional conduit (47) embodiment (47B) alternative to (47C) of FIGS. 109-110. The chamber junction (21) crossover embodiment (21AA), illustrates how a transition may also be a chamber junction (21, 21AA), wherein a bore selector (32) and diverter, e.g. (25B of FIG. 119B) or (25D of FIG. 119D), are usable with a lower end mandrel (243 of FIG. 119B) or side key for orientation within a bore selector extension receptacle (242) or a chamber of the chamber junction to fluidly and mechanically access autonomous bores (34). Exemplary outside diameter sizes are shown to demonstrate that the arrangement (47B flow transition, 21AA chamber junction) may be used within embodiments (1U) and (1V) of FIGS. 55-57 and 58-59.

Referring now to FIGS. 109 and 110, isometric and elevation views, respectively, depict a concentric (35) and axially autonomous (34) transitional conduit (47) embodiment (47C) similar to the sized transition (47B) of FIG. 108, with a LDHP conduit system (1) embodiment (1AE) shown as a dashed line. The depicted arrangement may be usable in instances where the erosional effects of flow velocities are less significant than the cost of construction, wherein a simple upper end right angle design is used to transition from axially autonomous (34) to axially concentric (35) conduits. A bore selector extension receptacle (242), similar to that of FIG. 108, is usable to orient a bore selector (32) or diverter (e.g. 25B of FIG. 119B) usable to divert fluids and apparatus to and from lower end autonomous conduits (34).

FIGS. 111 and 112 show elevation and plan views, respectively, illustrating a concentric (35) and axially autonomous (34) transitional conduit (47) embodiment (47D) of a side-pocket whipstock (48) embodiment (48A) for a LDHP conduit system (1) embodiment (1AF), which is shown as a dashed line. Two 40.6 cm (16") outside diameter conduits are offset by 10.2 cm (4") to provide a bore with vertical access similar to any conventional well, wherein the amalgamation of both bores is placeable within a 50.8 cm (20") ID to form a side-pocket arrangement (48A) for urging one or more lateral bores (244) from a through bore (245) with a kick-over tool from a conduit (246). The entire assembly may be placed in a bore and cemented in place, after which a vertical and one or more lateral bores may be drilled and lined.

Conventionally practiced standardization across all wells reflects the lower power ratings of historic boring apparatuses as well as the cost and ability to manufacture large bore thick casings, wherein for example the limitation of conventional 61 cm (24") 358.5 N/mm2 (52-ksi) casing with a wall thickness of 3.81 cm (1.5"), capable of bearing 392.1 bar (5688-psi) burst and 402.8 bar (5842-psi) collapse pressures, according to API Bulletin 5C3, prevented the use of side pocket whipstocks (48A). However, with the present higher power boring arrangements are usable to exploit unconventional hydrocarbons, i.e. those that are not easily accessed at a low unit cost, and standards on which the hydrocarbon industry was built may change.

Accordingly a LDHP conduit system (1), with a more conventional well size may use, e.g., a 61 cm (24") 358.5 N/mm2 (52-ksi) conduit with a 3.81 cm) wall thickness conduit abutted to a 76.2 cm (30") 358.5 N/mm2 (52-ksi) 3.81 cm (1.5") wall thickness conduit using loading surfaces that span the annulus between the conduits, and to support and share hoop stresses to provide at least an 80% efficiency wall thickness of 3.6"=[0.8×(30"−21")/2] or 9.1 cm, then said arrangement's single main bore may bear 752.9 bar (10,920-psi) burst and 757.2 bar (10,982-psi) collapse pressures according to a API Bulletin 5C3 calculation, wherein 690 bar (10,000 psi) well designs are a standard for the industry, and wherein boring large diameters, e.g. 91.4 cm (36") for the 76.2 cm (30") casing and 66 cm (26") for the 61 cm (24") casing to hundreds of meters or thousands of feet is achievable, if not common, for apparatuses presently being used within the industry.

Referring now to FIGS. 113, 114, 115, 116, 117 and 118, the Figures illustrate a plan view with line AM-AM, an elevation cross-section along line AM-AM of FIG. 113 with break lines showing sections removed, an isometric projection of FIG. 114 with detail lines AN and AO, a magnified detail view within line AN of FIG. 115, a magnified detail view within line AO of FIG. 115, and an exploded view associated with the components of FIGS. 113-117, respectively, which depict a chamber junction (21) side-pocket whipstock conduit (48) assembly embodiment (48B). The depicted embodiment (48B) includes concentric and axially autonomous snap-together connector (49) embodiments (49H, 491) within a LDHP conduit system (1) embodiment (1AG), which is shown as a dashed line, wherein the chamber junction (21) may be used as a side-pocket whipstock (33) embodiment (33C).

The conduit body (48) assembly has upper (49H) and lower (491) end box snap connector (251) assemblies comprising axially autonomous (34) conduits with a side pocket bore (199), formed between the ends on the inside diameter of a chamber junction conduit. The bore (199) can be usable for drilling a strata passage and placing a protective metal lining within the strata passageway to form an axially autonomous (34) bore (199), extending axially downward and laterally outward from a lower end whipstock (e.g. 46 of FIG. 121) by exiting the outside diameter the conduit assembly (48) at an axial inclination. The axis of the autonomous bore (199) is axially and laterally offset from the through passage (198) and can be accessed via a kick-over tool (e.g. 33K of FIG. 119).

Supporting conduits (246) can form part of the conduit assembly (48B), wherein the supporting conduits can be usable to, e.g., improve fluid circulation, cementing operations, provide a gas lift conduit and/or to monitor a liner annulus. A conduit housing (247) encloses the chamber junction (21J), adapted for kick-over diversion to the side pocket whipstock bore (199), wherein an upper snap connector embodiment is shown having has three PBR receptacles for engagement to a corresponding chamber junction or supporting conduits and associated mandrel seal stacks of a corresponding axially autonomous conduit assembly. The lower end four seal stack mandrels (249, 250) and adapted chamber junction (248, 21J) are engagable to the conduit housing (247) with a bracket (200J) and associated lower end, which is engagable to another axially autonomous conduit whipstock assembly (e.g. 48C of FIGS. 120-125).

FIGS. 119, 119A, 119B, 119C, 119D and 119E show a top down isometric view of a diverting apparatus (25) kick-over tool (33K) embodiment (33K1), a top down isometric view of a diverting apparatus (25) prior art plug (25A), a bottom up isometric view of a diverting apparatus (25) embodiment (25B) comprising a bore selector (32) of the present inventor, a top down isometric view of a diverting apparatus (25) simultaneous flow stream turbine (25C) of the present inventor, a top down isometric view of a diverting apparatus (25) embodiment (25D) comprising a bore selector (32) of the present inventor and a top down isometric view of an prior art diverting apparatus (25) profile snap-in sleeve or straddle (25E), respectively, which illustrate various diverting apparatuses usable with embodiments of the present invention.

The kick-over tool (33K) embodiment (33K1 of FIG. 119) may be used for placing or retrieving well equipment via a through passage (198 of FIG. 113) of a conduit (e.g. 248 of FIGS. 113-125) adjacent to said side pocket whipstock lateral bore (199), wherein the kick-over tool may have an elongate body (197) with an arm (195) movable with said body and/or axially rotatable from a pivot point (196), e.g. if a second kick-over arm (195 of FIG. 130-131) is attached to the first pivot arm. A kick over tool's running position may comprise, e.g., engagement to a running tool that is released after setting rotatable packer slips (252) using a drag block spring (254) to place the kick-over tool in its equipment deflection, placement and retrieval position. A movable spring (253) piston or other cushioning device may be used to facilitate a tool and/or drill string deflection off of the movable arm (195) and/or engagement/disengagement spring (253). A spline (255) may be used with an overshot retrieval tool to release the packer slips (252) and retrieve the kick-over tool, wherein any means of placement and retrieval of a tool that can be used to deflect fluids and/or tools into the side pocket bore (199) using any mechanism which acts as an arm to cause said deflection is usable, whereby, e.g., any casing packer which may be set and retrieved and be used as a deflecting apparatus without significant damage to tools or the well.

As described, any tool acting as an arm to place or retrieve equipment to and from the lateral bore (199) of said side pocket whipstock (48B) by placing and retrieving said kick-over tool in a first position for running and retrieval and a second position to engage and deflect said equipment approximately into said lateral bore, may be used to facilitate access, since the chamber junction (21J) may control the orientations of equipment entering the area of the side pocket whipstock. For example, the deflection tool (25B of FIG. 119B) may be mounted onto a packer slip arrangement (252 of FIG. 119) and oriented to cause its whipstock (46) to act as a pivot (196) and deflecting arm (195) when placed in the chamber junction.

The diverting apparatuses (25) shown as a plug (25A of FIG. 119A) and manifold crossover turbine (25C of FIG. 119C) have dog mandrels (256) engagable with nipple profiles (175) to block or divert primarily fluid flow, wherein the plug arrangement (25A) could be used as a kick-over tool when, e.g., a whipstock (46) adaptation acting as a pivot arm is placed upon the upper end arm (195 of FIG. 119A) of the plug (25A).

The manifold crossover turbine (25C) with upper end running mandrel (257) is usable to drive and/or assist one flow stream with the flowing energy of another, wherein when placed within a receptacle profile of a manifold crossover (e.g. 20W of FIG. 62, 20AA of FIGS. 65 and 20Y of FIGS. 66-68), at the point of crossover between annulus and inner bore, one flow stream's energy may drive one turbine (258), which through a common axis, drives the opposite turbine (259) to energize the fluid flow associated with that turbine, or vice versa. Such a turbine may be used with, e.g., production moving through a subterranean separator (11) where the expansion of a gas entrained fluid passes the turbine into the tank (13) it may be used to lift dense fluid production or drive water injection and/or disposal.

The straddle (25E of FIG. 119E), or any other similar device deployable and retrievable with a cable rig, e.g. 25D of FIG. 3, may be used to close open ports adjacent to engagable nipple profiles (175) in subterranean conduit, e.g. a separator inlet (26 of FIGS. 62-68), or crossover ports, wherein operation of the port may comprise installing and removing such sealable straddles which close side orifices but allow fluid and/or tool passage through an interior passageway and which may be snapped into and removed from downhole nipple profiles.

Figures 119E, 120, 121, 122, 123, 124, 125, 126, 127, 128, 129, 130, 131, 132:
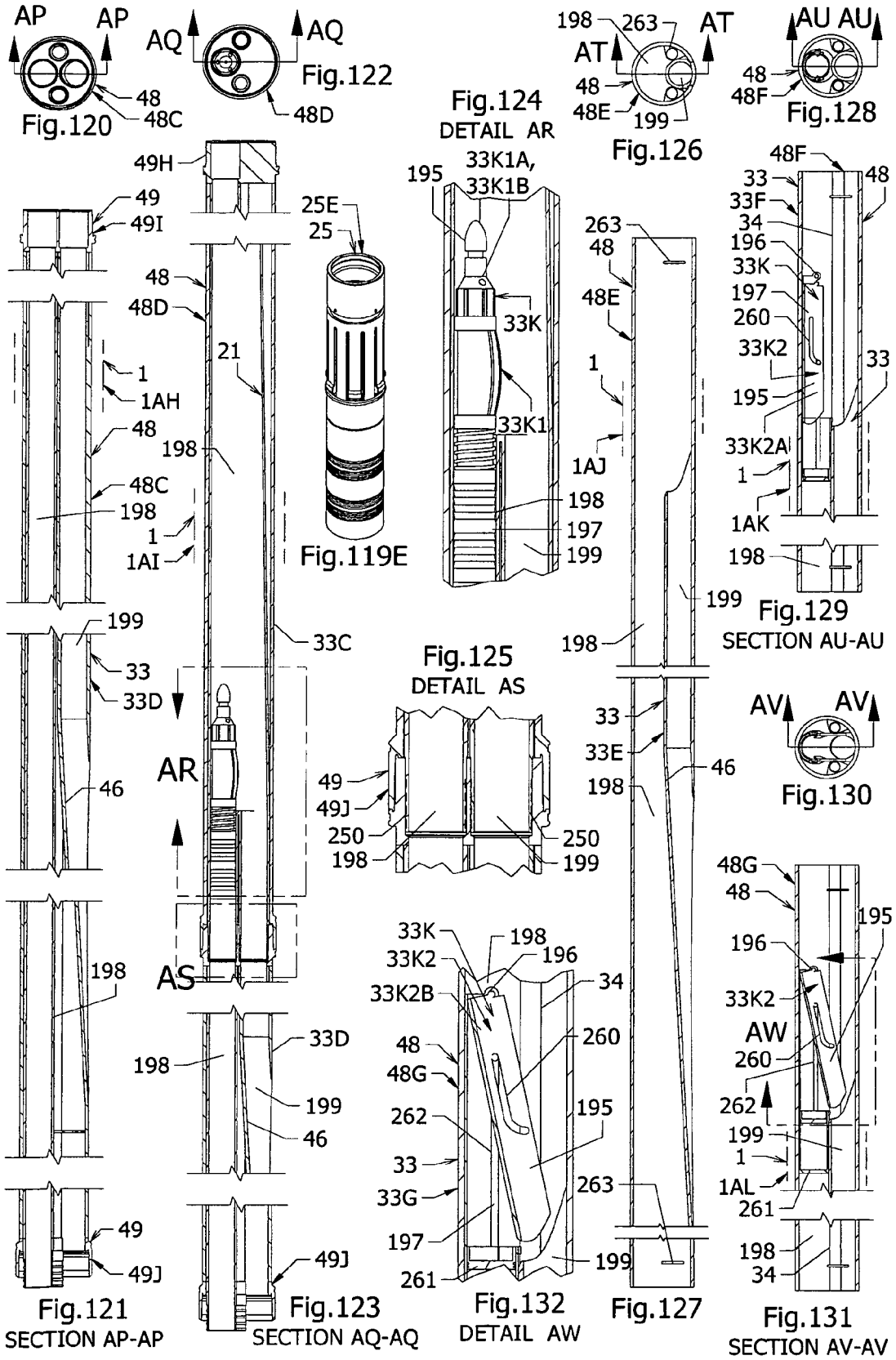

Referring now to FIGS. 120 and 121, the Figures show a plan view with line AP-AP and a cross section elevation view along line AP-AP with break-lines representing removed portions of a side-pocket (48) whip-stock (46) embodiment (48C) with axially autonomous snap-together connector (49) embodiments (491, 49J) of a LDHP conduit system (1) embodiment (1AH), shown as a dashed line. The Figures illustrate a side pocket (33) embodiment (33D) comprising a conduit body (48) with upper (491) and lower (49J) end connectors for an autonomous (34) bore (199) side pocket usable for urging a strata passage and hanging a protective metal lining, e.g. a liner hanger (167), axially downward and laterally outward from a lower end whipstock (46) exiting the outside diameter conduit body (48), wherein a kick-over tool may be placed in the through passage (198) to deflect passage to the lateral bore (199). The upper end connector (491) of the conduit assembly (48C) may be used to engage kick-over tools, e.g. (33K1) of FIG. 119 or a chamber junction arrangement (e.g. 48B o FIGS. 113-118).

FIGS. 122, 123, 124 and 125 depict a plan view with AQ-AQ, an elevation cross-section along line AQ-AQ of FIG. 122 with break lines representing removed sections and detail lines AR and AS, a magnified detail view within line AR of FIG. 123 and a magnified detail view within line AS of FIG. 123, depicting a side-pocket (48) whip-stock (46) embodiment (48D), associated with the engagement of embodiments (48B, 48C) of FIGS. 113-121, with axially autonomous snap-together connector (49) embodiments (49H, 491, 49J) of a LDHP conduit system (1) embodiment (1AI), shown as a dashed line. A diverting (25) kick-over tool (33K) embodiment (33K1) may be installed in a through passageway (198) in a first running position (33K1A) before engaging packer slips (197) and a second position (33K1B) for equipment diversion through the side pocket bore (199) use the arm (195) for placing and retrieving the apparatus or fluids after engaging the slips.

Referring now to FIGS. 126 and 127, these Figures depict a plan view with line AT-AT and an elevation cross section view along line AT-AT with break lines representing removed portions a side-pocket conduit (48) whip-stock (46) embodiment (48E) of a LDHP conduit system (1) embodiment (1AJ), shown as a dashed line. A side pocket (33) embodiment (33E) within a conduit body (48) having upper and lower ends engagable with any form of subterranean connector, may be accessed from the through bore (198), wherein an axially autonomous (34) bore (199) side pocket is formed on the inside diameter, between the upper and lower ends thereof. The lateral bore (199) may be used for urging a subterranean strata passage and hanging a protective metal lining when a kick-over tool is used to access said autonomous bore (199) from said through passageway (198), as shown in FIGS. 128-132. Additional supporting axially autonomous conduits may also be placed secured with a bracket (263).

FIGS. 128 and 129 depict a plan view with line AU-AU and an elevation cross section view along line AU-AU with break lines representing removed portions, which shows a side-pocket conduit (48) whip-stock (46) embodiment (48F), and a side pocket (33) embodiment (33F) and kick-over tool (33K) embodiment (33K2), illustrating the kick-over tool in the running position (33K2A) within a LDHP conduit system (1) embodiment (1AK), shown as a dashed line.

The kick-over tool (33K) embodiment (33F) is usable for placing or retrieving well equipment via a through passage (198) of a conduit adjacent to a side pocket whipstock lateral bore (199), wherein said kick-over tool may comprise an elongate body (197) with an arm (195) movable with said body and axially rotatable from a pivot point (196) using, e.g., a j-slot (260) arrangement with said elongate body, between a first, kick-over tool running and retrieving position (33K2A), and a second position (33K2B of FIGS. 130-132) for the arm to place or retrieve equipment to and from the lateral bore (199) of said side pocket (33) whipstock conduit (48). The tool (33K2) may be placed and retrieved with any form of running tool to place the elongate body (197) approximately adjacent to the lateral bore (199) so as to divert well equipment, e.g. drill strings, casing liners, perforating guns, packers or any other suitable downhole apparatus, to and from said lateral bore.

Referring now to FIGS. 130, 131 and 132, the Figures depict a plan view with line AV-AV, an elevation cross section along line AV-AV of FIG. 130 with detail line AW and break lines representing remove sections and a magnified detail view within line AW of FIG. 132, depicting a side-pocket (33) whip-stock (46) conduit (48) embodiment (48G) with a kick-over tool (33K) embodiment (33K2) in a diverting position (33K2B) within a LDHP conduit system (1) embodiment (1AL), shown as a dashed line. Any type of piston packer (261) and rod (262) and/or springs and weight set mechanisms may be used to extend the arm (195) of the kick-over tool (33K2) to the diverting position (33K2B) and/or retract it to a running and retrieving position (33K2A). The tool (33K2) may be engaged to the through bore (198) with a kidney shaped profile orienting the arm and providing an axial position for setting a packer with slips to anchor the kick-over tool, after which the force of separating from the anchored tool may be used with, e.g., a piston (261) and rod (262) moved axially upward to operate the j-slot (260) and pivot point (196) of the diverting arm (195). The piston and rod may again be operated downward for retraction of the arm to the running position, after which the tool may be disengaged from the pass through bore (198) and retrieved to surface. Any means of operating a kick-over tool, e.g. an adaptation of a kick-over tool used for gas lift valves modified for the larger bores may be used.

The length of the pass through bore (198) of conduit (48) between side pockets (33) may be significant, for example it may be measured in hundreds of feet or meters so as to allow a drill string comprising, e.g., a pendulum assembly, rotary steerable, bent housing and motor operating drill collars, stabilizers, bits, bi-centre bits, hole openers and/or other boring devices used for directionally drilling at inclinations of, e.g., 1-3 degrees per 30 meters or 100 feet when exiting the side pocket (33), which may be of a similar length to allow the installation of a liner hanger.

The use of a side-pocket (33) whipstock conduit (48) and kick-over tool of the present invention is generally not applicable to conventional well design which lack sufficient space and/or pressure bearing capacity, hence a LDHP conduit system (1) may effectively be used to operate a side pocket and kick-tool to create level 6 multilaterals, wherein a cased, cemented and pressure tight junction is present, in larger hole diameters than are conventionally possible using conventional apparatuses designed for single bore liners. Various prior and conventional multilateral tool may be adapted to use with the present invention, to provide the same benefits of using larger hole sizes with higher pressure ratings.

The construction of subterranean wells, generally, began with bamboo poles and dropping heavy cable tools to cut a circular hole of up to 35.6 cm (14") by the Chinese around 600 to 260 BC. Cable tool drilling was used in Europe from around 1825 AD until a two cone drill bit was patented in 1879 AD and a tri-cone bit introduced in 1933, after which rotary drilling dominated well construction. An industry that was first plagued by boom and bust through over supply was ultimately controlled by coordinated actions of companies that instituted standardization to lower costs. During the later parts of the last century significant advances in supplying torque and weight to subterranean boring bits and construction of large diameter steel casings occurred, however the industry has continued to search for hydrocarbons that fit the bore hole sizes which were designed for easily accessible "conventional" subterranean deposits that dominated the industry's history during periods when insufficient power was available to drill larger bore holes economically.

Accordingly, the present invention is neither obvious to practitioners who have used substantially the same well bore size since at least 200 BC, as evidenced by industry conduit standard 5CT of the American Petroleum Institute (API) regarding the qualification of well conduits up to 50.8 cm (20"), nor is it necessarily the lowest cost option for use in various areas where surface strata is particularly difficult to bore, even with our current level of technology; however, a very serious need exists to access unconventional and extremely difficult subterranean deposits, wherein providing subterranean processing in remote and subsea locations reduces the required infrastructure and reduces the number of penetrations through ground water systems and/or moderates the use of surface areas in environmentally sensitive areas, forests, farmlands and/or populated areas where drilling and well production have significant negative impact. The large diameter high pressure conduit system (1) described herein, may be used to meet such needs in a more cost and carbon footprint conscious manner, by reducing surface impact to vegetation, minimising fuels and resources used to construct a plurality of wells and providing a design for more economically producing and maximising recover of cleaner burning fuels, such as gas, wherein present modern advances in subterranean technologies may be used to control producible and/or injectable subterranean single or simultaneous fluid flow streams of varying velocities to and/or from one or more wells through a single main bore with pressure bearing capacities greater than are presently practiced using larger diameter conduits to access conventional and unconventional subterranean deposits with a design that is usable with virtually any off-the-shelf field proven technology and which may be standardized to further reduce costs and environmental impact.

While various embodiments of the present invention have been described with emphasis, it should be understood that within the scope of the appended claims, the present invention might be practiced other than as specifically described herein.

Reference numerals have been incorporated in the claims purely to assist understanding during prosecution.

The embodiments of the invention in which an exclusive property or privilege is claimed are defined as follows:

1. A well conduit system (1), comprising:

a first (2) circumferentially elastic outer conduit wall;

at least one second (3) circumferentially elastic inner conduit wall positioned within the first circumferentially elastic outer conduit wall to define an annulus between the first circumferentially elastic outer conduit wall and said at least one second circumferentially elastic inner conduit wall; and a plurality of radial load surfaces (5, 6, 41, 42, 49, 123) extending across the annulus and radially between at least two of said conduit walls to concentrically abut against at least one other of said conduit walls to form at least two elastic hoop stress adjoined pipe bodies (4) with at least one concentric annulus space (7) between said at least two elastic hoop stress adjoined pipe bodies and said plurality of radial load surfaces, wherein one or more passageways through subterranean strata is formed by inserting an inner pipe body comprising said at least one second circumferentially elastic inner conduit wall into an outer pipe body comprising the first circumferentially elastic outer conduit wall, wherein the inner pipe body comprises an outer diameter greater than an inner diameter of the outer pipe body, and wherein the inner pipe body is inserted into the outer pipe body below at least one wellhead assembly (10), using a circumferentially elastic expansion of said outer pipe body and a circumferentially elastic compression of said inner pipe body resulting from a hoop force exerted therebetween, and wherein the release of said hoop force after said insertion releases said circumferentially elastic expansion and said circumferentially elastic compression to abut said plurality of radial load surfaces of said outer pipe body to said inner pipe body for forming adjoined pipe bodies, and to cause a concentric sharing of elastic hoop stress resistance (8) between said adjoined pipe bodies for forming a greater effective wall thickness (9) that is capable of containing higher pressures than said conduit walls could otherwise bear without said concentric sharing of said elastic hoop stress resistance.

2. The well conduit system according to claim 1, wherein said radial loading surfaces comprise a portion of at least one of said pipe bodies (4), a portion of an independent bearing intermediate to the at least one of said pipe bodies, or combinations thereof.

3. The well conduit system according to claim 1, wherein said radial loading surfaces comprise a plastic deformable portion or an elastically expandable portion usable to provide said abutment of said plurality of radial load surfaces and said concentric sharing of said elastic hoop stress resistance (8) between said adjoined pipe bodies.

4. The well conduit system according to claim 1, wherein said hoop force comprises gravity forces, hammering forces, mechanical forces (38), fluid or pneumatic forces (39), or combinations thereof.

5. The well conduit system according to claim 1, further comprising a wellhead assembly (10) of at least one fluid communication conduit hanger spool (14) subassembly, engagable with securable (15) and sealable (16) components to a first (17) conduit head subassembly and at least one second (18) conduit head subassembly, wherein the first (17) and at least one second (18) conduit head subassemblies are associated with and secured to an upper end of said first (2) circumferentially elastic outer conduit wall and said at least one second (3) circumferentially elastic inner conduit wall to form said wellhead assembly.

6. The well conduit system according to claim 5, wherein single olive (41) or double olive (42) compression fittings are used to secure and seal at least two conduit walls engaged to said wellhead assembly.

7. The well conduit system according to claim 5, further comprising at least one boring assembly (1B, 1C, 1G, 1H) engagable with said wellhead assembly to urge said one or more passageways through the subterranean strata.

8. The well conduit system according to claim 5, wherein a subterranean fluid processing tank (13) is formed within said pipe bodies, between said at least one wellhead assembly and the lower end of said pipe bodies, and wherein said fluid processing tank surrounds and fluidly communicates with at least one of said one or more passageways through the subterranean strata.

9. The well conduit system according to claim 8, wherein said subterranean fluid processing tank (13) is used to form a subterranean separator (11) comprising connecting substantially concentric or axially autonomous conduit walls and passageways that form inlets (26), chimneys (27), downcomers (28), diverters (29), spreaders (30), mist extractors (31), or combinations thereof, to separate fluids during said fluid processing.

10. The well conduit system according to claim 8, wherein said subterranean fluid processing tank (13) forms a heat exchanger (12) using said connecting substantially concentric or axially autonomous conduit walls to exchange heat between fluid within said connecting substantially concentric or axially autonomous conduit walls and fluid about said connecting substantially concentric or axially autonomous conduit walls within said subterranean fluid processing tank, to further provide said subterranean fluid processing.

11. The well conduit system according to claim 1, wherein a plurality of substantially concentric conduits (35), axially autonomous conduits (34), or combinations thereof (47), form composite joints that are disposable through said pipe bodies to form said one or more passageways through the subterranean strata.

12. The well conduit system according to claim 11, wherein said composite joints comprise a plurality of parallel axially autonomous concurrently engagable conduit (34) snap connectors (49) that comprise elastically compressible inner circumferences and elastically expandable outer circumferences (4A) for connecting substantially concentric conduits (35) or axially autonomous (34) conduits.

13. The well conduit system according to claim 11, wherein one or more valves (24) or diverting apparatuses (25, 32, 33K) are selectively disposed to control communication through said one or more passageways through the subterranean strata.

14. The well conduit system according to claim 13, wherein said controlled communication comprises using a computer (102, 108) to operate said valves or to operate said diverting apparatuses (25, 32, 33K) by using observed pressures, temperatures and flow-rates of fluids for communicating fluids through said one or more passageways through the subterranean strata.

15. The well conduit system according to claim 11, further comprising one or more autonomous bores formed with a manifold crossover (20), a chamber junction (21), a side-pocket whipstock (48), or combinations thereof.

16. The well conduit system according to claim 15, wherein said side-pocket whipstock (48) comprises a side pocket (33) with an axially autonomous (34) bore (199) extending to a lower end whipstock (46) that is laterally offset from the through passage (198).

17. The well conduit system according to claim 15, wherein at least one bore selector tool (32), a kick-over tool (33K), or combinations thereof, are selectively disposed through and oriented to said one or more passageways to access said one or more autonomous bores.

18. The well conduit system according to claim 17, wherein said kick-over tool (33K) comprises an elongate body (197) with a movable arm (195), an axially rotatable pivot point (196), or combinations thereof, usable for placing or retrieving well equipment through said side-pocket whipstock lateral bore (199) via said through passage (198).

19. A method of using a well conduit system (1), said method comprising the steps of:

providing a circumferentially elastic outer conduit wall (2) and at least one second circumferentially elastic inner conduit wall (3), with a plurality of radial load surfaces (5, 6, 41, 42, 49, 123) extending across at least a portion of and radially between at least two of said conduit walls to concentrically abut against at least one of said conduit walls to form at least two elastic hoop stress adjoined pipe bodies (4) forming one or more passageways of said well with at least one concentric annulus space (7) between said adjoined pipe bodies and said plurality of radial load surfaces;

forming said one or more passageways through subterranean strata by inserting an inner pipe body comprising said at least one second circumferentially elastic inner conduit wall into an outer pipe body comprising the circumferentially elastic outer conduit wall, wherein the inner pipe body comprises an outer diameter greater than an inner diameter of the outer pipe body, and wherein the inner pipe body is inserted into the outer pipe body below at least one wellhead assembly (10) using circumferentially elastic expansion of said outer pipe body and a circumferentially elastic compression of said inner pipe body resulting from a hoop force exerted therebetween; and releasing said hoop force after said insertion to release said circumferentially elastic expansion and said circumferentially elastic compression and abut said plurality of radial load surfaces of said outer pipe body to said inner pipe body for forming adjoined pipe bodies and to cause a concentric sharing of elastic hoop stress resistance (8) between said adjoined pipe bodies for forming a greater effective wall thickness (9) that is capable of containing higher pressures than said conduit walls could otherwise bear without said concentric sharing of said elastic hoop stress resistance.

20. The method according to claim 19, further comprising using at least a part of at least one of said pipe bodies (4) as said plurality of radial load surfaces, using independent bearings intermediate to said pipe bodies as said plurality of radial load surfaces, or combinations thereof.

21. The method according to claim 19, further comprising using plastic deformable radial load surfaces or elastically expandable radial load surfaces to provide said abutment and to share said elastic hoop stress resistances (8) between said adjoined pipe bodies.

22. The method according to claim 19, further comprising using gravity hoop forces, hammering hoop forces, mechanical hoop forces (38), fluid or pneumatic hoop forces (39), or combinations thereof.

23. The method according to claim 19, further comprising the step of forming a wellhead assembly (10) with at least one fluid communication conduit hanger spool (14) subassembly engaged with securable (15) and sealable (16) components to first (17) and at least one second (18) conduit head subassemblies associated with and secured to an upper end of said circumferentially elastic outer conduit wall (2) and said at least one second circumferentially elastic inner conduit wall (3).

24. The method according to claim 23, further comprising using single olive (41) or double olive (42) compression fittings to secure and seal at least two walls engaged to said wellhead assembly.

25. The method according to claim 23, further comprising using at least one boring assembly (1B, 1C, 1G, 1H) engagable with said wellhead assembly to urge said one or more passageways through the subterranean strata.

26. The method according to claim 23, further comprising the step of communicating fluids using a subterranean fluid processing tank (13) formed within said pipe bodies, between said at least one wellhead assembly and the lower end of said pipe bodies, wherein said fluid processing tank surrounds and fluidly communicates with at least one of said one or more passageways through the subterranean strata.

27. The method according to claim 26, further comprising using said subterranean fluid processing tank (13) to form a subterranean separator (11) with connecting substantially concentric or axially autonomous conduit walls and passageways for forming inlets (26), chimneys (27), downcomers (28), diverters (29), spreaders (30), mist extractors (31), or combinations thereof, to separate fluids during said fluid processing.

28. The method according to claim 26, further comprising using said subterranean fluid processing tank (13) to form a heat exchanger (12) using said substantially concentric or axially autonomous conduit walls to exchange heat between fluid within said walls and fluid about said walls within said subterranean fluid processing tank, to further provide said subterranean fluid processing.

29. The method according to claim 19, further comprising providing composite joints formed with a plurality of substantially concentric conduits (35), axially autonomous conduits (34), or combinations thereof (47), disposable through said pipe bodies to further form said one or more passageways through the subterranean strata.

30. The method according to claim 29, further comprising using a plurality of parallel axially autonomous concurrently engagable conduit (34) snap connectors (49) with elastically compressible inner circumferences and elastically expandable outer circumferences (4A) to connect said substantially concentric conduits (35) or axially autonomous (34) conduits.

31. The method according to claim 29, further comprising selectively disposing one or more valves (24) or diverting apparatuses (25, 32, 33K) in said one or more passageways to control communication through said one or more passageways.

32. The method according to claim 31, further comprising using a computer (102, 108) to control fluid communication by operating said valves or said diverting apparatuses using observed pressures, temperatures or flow-rates of fluids communicated through said one or more passageways through the subterranean strata.

33. The method according to claim 29, further comprising the step of forming one or more autonomous bores with a manifold crossover (20), chamber junction (21), side-pocket whipstock (48), or combinations thereof.

34. The method according to claim 33, further comprising selectively disposing and orienting at least one bore selector tool (32), kick-over tool (33K), or combinations within said one or more passageway to access said one or more autonomous bores.

35. The method according to claim 34, further comprising providing said kick-over tool (33K) with an elongate body (197) and a movable arm (195), an axially rotatable pivot point (196), or combinations thereof, usable for placing or retrieving well equipment through said side-pocket whipstock lateral bore (199) via said through passage (198).

36. The method according to claim 29, further comprising the step of forming a side-pocket whipstock (48) using a side pocket (33) with an axially autonomous (34) bore (199) extending to a lower end whipstock (46) that is laterally offset from an associated through passage (198).

* * * * *